US010918210B2

(12) United States Patent
Stefan et al.

(10) Patent No.: US 10,918,210 B2
(45) Date of Patent: Feb. 16, 2021

(54) COMPARTMENT DIVIDER ASSEMBLY

(71) Applicants: Daniel Warren Stefan, Blue Jay, CA (US); Timothy Daniel Stefan, Blue Jay, CA (US)

(72) Inventors: Daniel Warren Stefan, Blue Jay, CA (US); Timothy Daniel Stefan, Blue Jay, CA (US)

( * ) Notice: Subject to any disclaimer, the term of this patent is extended or adjusted under 35 U.S.C. 154(b) by 0 days.

(21) Appl. No.: 16/564,194

(22) Filed: Sep. 9, 2019

(65) Prior Publication Data

US 2020/0000227 A1 Jan. 2, 2020

Related U.S. Application Data

(60) Division of application No. 15/802,188, filed on Nov. 2, 2017, now Pat. No. 10,441,077, which is a continuation-in-part of application No. 15/379,021, filed on Dec. 14, 2016, now Pat. No. 9,839,289.

(51) Int. Cl.

| | |
|---|---|
| ***A47B 88/975*** | (2017.01) |
| ***A47B 88/994*** | (2017.01) |
| ***A47B 88/90*** | (2017.01) |
| ***A47B 57/58*** | (2006.01) |

(52) U.S. Cl.

CPC ..... *A47B 88/975* (2017.01); *A47B 88/994* (2017.01); *A47B 57/58* (2013.01); *A47B 2088/902* (2017.01); *A47B 2230/0077* (2013.01); *A47B 2230/16* (2013.01)

(58) Field of Classification Search

CPC ..... A47B 88/975; A47B 88/994; A47B 2088/902; A47B 57/58; A47B 2230/0077; A47B 2230/16; A47B 88/90; A47F 5/132; A47F 7/144; Y10T 403/7094; Y10T 403/7018; Y10T 403/7064; Y10T 403/7005

USPC ..... 211/10, 182, 94.01; 312/348.3; 248/222.51, 222.52, 223.41, 224.51; 403/381, 355, 374.1

See application file for complete search history.

(56) References Cited

U.S. PATENT DOCUMENTS 2,859,710 A * 11/1958 Elsner ..... B64D 11/0696 248/502
3,321,223 A * 5/1967 Snow ..... F16B 12/32 403/220
3,429,602 A * 2/1969 Necdet ..... E04B 1/2403 403/295

(Continued)

*Primary Examiner* — Jennifer E. Novosad
(74) *Attorney, Agent, or Firm* — Kevin Schraven; Anooj Patel; Hankin Patent Law, APC

(57) ABSTRACT

A compartment divider assembly. The compartment divider assembly may comprise: one or more dividers and at least one coupler. The one or more dividers may comprise a first divider and a second divider. The at least one coupler may comprise at least one support coupler and at least one set of prongs. The one or more dividers may further comprise at least one dovetail groove traversing along a longitudinal axis. The one or more dividers may be positioned substantially horizontally. The first divider may be positioned substantially perpendicular to the second divider. The at least one set of prongs may further comprise at least one planar face and at least one non-planar face. The at least one non-planar face of the at least one set of prongs may be adapted to engage with at least one dovetail groove of the one or more dividers.

12 Claims, 71 Drawing Sheets

(56) References Cited

U.S. PATENT DOCUMENTS 3,491,896 A * 1/1970 Crary ..... A47B 47/0041 108/60
3,547,472 A * 12/1970 Ehrman ..... A47B 47/0041 403/381
3,552,817 A * 1/1971 Marcolongo ..... A47B 87/02 312/107
3,661,434 A * 5/1972 Alster ..... A47B 47/005 312/111
3,874,753 A * 4/1975 Naito ..... A47B 47/0041 312/111
3,901,572 A * 8/1975 Litchfield ..... A47B 88/941 312/348.2
3,944,377 A * 3/1976 Defrese ..... F16B 12/26 403/189
3,977,742 A * 8/1976 Rovere ..... A47B 47/0041 312/111
4,125,338 A * 11/1978 Lew ..... A47B 47/0041 403/169
4,164,105 A * 8/1979 Herbst ..... E06B 3/28 160/394
4,191,439 A * 3/1980 Cohen ..... A47B 88/941 312/111
4,212,445 A * 7/1980 Hagen ..... F16B 12/34 248/222.52
4,222,209 A * 9/1980 Peterson ..... E06B 3/667 403/295
4,222,508 A * 9/1980 Bott ..... B60R 9/04 224/324
4,279,455 A * 7/1981 Santo ..... A47B 88/00 312/348.2
4,592,601 A * 6/1986 Hlinsky ..... A47B 87/02 206/504
4,676,038 A * 6/1987 Doyon ..... A47B 47/0041 403/231
4,683,634 A * 8/1987 Cole ..... E06B 3/667 29/412
4,691,486 A * 9/1987 Niekrasz ..... A47F 3/0434 219/218
4,712,942 A * 12/1987 Brown ..... F16B 5/00 403/174
4,805,784 A * 2/1989 Solheim ..... A47F 5/0846 211/59.1
4,826,022 A * 5/1989 Duarte ..... A47F 5/0846 211/59.1
4,903,934 A * 2/1990 Fremstad ..... A47G 1/0655 248/222.52
4,934,765 A * 6/1990 Slifer, Sr. ..... A47B 88/941 312/258
4,997,155 A * 3/1991 Reuter ..... F16M 11/2014 248/278.1
5,003,741 A * 4/1991 Yeh ..... A47B 47/0008 312/140
5,240,317 A * 8/1993 Presnick ..... F16B 12/44 312/111
5,466,057 A * 11/1995 Blankenburg ..... A47B 47/0041 312/108
5,470,139 A * 11/1995 Hsiao ..... A47B 47/005 312/111
5,477,594 A * 12/1995 Lepage ..... E04H 13/006 211/194
5,588,726 A * 12/1996 Lee ..... F16B 12/02 312/263
5,615,818 A * 4/1997 Linden ..... B60R 9/045 224/321
5,647,181 A * 7/1997 Hunts ..... A63H 33/10 312/111
5,836,035 A * 11/1998 McElfish ..... A46B 17/02 15/160
5,888,114 A * 3/1999 Slocum ..... A47B 47/0075 446/118
5,893,617 A * 4/1999 Lee ..... A47B 47/0041 312/263
5,897,001 A * 4/1999 Dembicks ..... B25B 13/56 206/378
6,124,015 A * 9/2000 Baker ..... B32B 7/08 428/99
6,179,515 B1 * 1/2001 Grieser ..... F16B 12/46 403/402
6,332,657 B1 * 12/2001 Fischer ..... A47B 47/0008 312/111
6,474,901 B1 * 11/2002 Thurston ..... F16B 12/50 403/381
6,564,949 B1 * 5/2003 Saathoff ..... B25H 3/006 211/70.6
7,028,854 B1 * 4/2006 Londrico ..... A47L 13/512 211/89.01
7,546,716 B1 * 6/2009 Asadurian ..... E04C 1/395 52/223.7
7,717,278 B2 * 5/2010 Kao ..... B25H 3/04 206/349
7,743,583 B2 * 6/2010 Kozel ..... E04B 1/2403 52/745.09
7,967,401 B2 * 6/2011 Hsu ..... A47B 47/0008 312/108
8,267,363 B2 * 9/2012 Begic ..... A47B 96/067 211/4
8,459,472 B2 * 6/2013 Hofman ..... A47F 5/0815 211/106.01
8,474,632 B2 * 7/2013 Yang ..... A47K 3/281 211/119.009
8,496,215 B2 * 7/2013 Stephan ..... F16L 3/00 248/221.11
8,733,561 B2 * 5/2014 Kao ..... B25H 3/04 206/378
8,733,851 B2 * 5/2014 Lee ..... A47B 47/0075 312/111
8,789,325 B2 * 7/2014 Verhaeghe ..... E04B 2/705 52/233
8,915,382 B2 * 12/2014 Totman ..... A63C 11/028 211/70.5
9,295,326 B2 * 3/2016 Sassman ..... F16B 11/006
9,591,931 B1 * 3/2017 Oren ..... A47B 96/1433
9,839,289 B1 * 12/2017 Stefan ..... A47B 88/975
10,085,553 B2 * 10/2018 Funfgeld ..... F16B 12/14
10,441,077 B2 * 10/2019 Stefan ..... A47B 88/975
2007/0017886 A1 * 1/2007 Kao ..... B25H 3/04 211/94.01
2007/0256996 A1 * 11/2007 Jackle ..... A47F 5/0846 211/94.01
2007/0256997 A1 * 11/2007 Collins ..... A47F 5/005 211/184
2008/0011696 A1 * 1/2008 Richter ..... A47F 1/126 211/59.2
2010/0072154 A1 * 3/2010 Johnson ..... B60R 7/02 211/184

* cited by examiner

COMPARTMENT DIVIDER ASSEMBLY

CROSS-REFERENCE TO RELATED APPLICATION

This patent application is a Divisional Application of U.S. Non-Provisional patent application Ser. No. 15/802,188, filed on Nov. 2, 2017, titled "Compartment Divider Assembly", by inventors Daniel Warren Stefan and Timothy Daniel Stefan, now U.S. Pat. No. 10,441,077, which is a Continuation-in-Part of U.S. Non-Provisional patent application Ser. No. 15/379,021, now U.S. Pat. No. 9,839,289, filed on Dec. 14, 2016, titled "Compartment Divider Assembly", by inventors Daniel Warren Stefan and Timothy Daniel Stefan, the contents of both are expressly incorporated herein by this reference as though set forth in their entirety and to which priority is claimed.

FIELD OF USE

The present disclosure relates generally to modular and customizable dividers for storage compartments such as drawers, and more particularly, to various dividers, couplers, and accessory holders that form one or more sub-compartments spaces for organization.

BACKGROUND

People have generally desired to find ways to organize various personal possessions and household items, especially as a way to physically de-clutter their lives. Many individuals, for instance, use physical folders to sort, organize, and file important documents while others may utilize racks such as clothing racks and shoe racks to help assort various clothing, shoes, and accessories. The primary reasons for organizing such items may include: increasing efficiency of a limited space, boosting productivity, and creating more room and space.

One of the most common devices that is used to organize personal items is storage compartments. Storage compartments may include drawers, shelves, trays, tool boxes, and the like. Organizational products directed to these storage compartments are typically drawer dividers and storage trays, both of which may create smaller sub-compartments for these spaces.

Unfortunately, these organizational products are designed to accommodate a certain type of item, space, or compartment. Storage dividers, for instance, tend to be sized to a particular length, whereas trays tend to hold certain items of specific dimensions. Some of these proposed devices also offer a small degree of adjustability (e.g., to handle items of different sizes). The steps required to make the adjustments, however, typically can be quite cumbersome or unsatisfying.

Therefore, there is a need for a new and improved compartment divider assembly that is customizable to a user's preference. Preferably, the new compartment divider assembly is modular and robust, such that the compartment divider assembly may divide and help organize compartments of various sizes and shapes.

SUMMARY OF ILLUSTRATIVE EMBODIMENTS

To minimize the limitations in the cited references, and to minimize other limitations that will become apparent upon reading and understanding the illustrative embodiments, the present disclosure teaches a new and useful compartment divider assembly.

One embodiment may be a compartment divider assembly, comprising two or more dividers and at least one corner coupler. The two or more dividers may comprise at least a first divider and a second divider. The at least one corner coupler may comprise at least one support coupler and four prongs, a first prong set and a second prong set. Each of the first prong set and the second prong set may comprise a top protrusion and a bottom protrusion. Each of the two dividers may further comprise at least one dovetail groove traversing along a longitudinal axis. The top protrusion and the bottom protrusion of the first prong set may engage with the at least one dovetail groove of the first divider, such that the at least one corner coupler may be held substantially in place by tension or friction relative to the first divider. The engagement might be through the prongs or the protrusions deforming. The top protrusion and the bottom protrusion of the second prong set may engage with the at least one dovetail groove of the second divider, such that the at least one corner coupler may be held substantially in place by tension or friction relative to the second divider. Each of the first prong set and the second prong set may be one unitary prong that may have a base, the top protrusion, and the bottom protrusion. Each of the first prong set and the second prong set may comprise two vertically spaced prongs, a top prong and a bottom prong, wherein the top prong may comprise a base and the top protrusion, and wherein the bottom prong may comprise a base and the bottom protrusion. The two dividers may be positioned in a substantially vertical manner relative to a compartment in which the assembly rests. The first prong set and the second prong set may be positioned substantially perpendicular to each other on the at least one support coupler, such that the first divider may be positioned substantially perpendicular to the second divider. The first prong set and the second prong set may be positioned at less than 90° to each other on the at least one support coupler, such that the first divider may be positioned at less than 90° to the second divider. The first prong set and the second prong set may be positioned at greater than 90° to each other on the at least one support coupler, such that the first divider may be positioned at greater than 90° to the second divider. The four prongs may engage with the at least one dovetail groove of the first divider by deforming into the at least one dovetail groove.

Another embodiment may be a compartment divider assembly, comprising a first divider having at least one dovetail groove traversing along a longitudinal axis, a divider support groove assembly, and a corner coupler. The divider support groove may comprise a first support groove and a second support groove. The first support groove may comprise a first groove portion and a first dovetail portion. The second support groove may comprise a second groove portion and a second dovetail portion. The first dovetail portion may have a first planar face sloping outwardly at a first dovetail angle and a second planar face sloping at a sliding angle away from the first planar face. The second dovetail portion may have a third planar face sloping outwardly at a second dovetail angle and a fourth planar face sloping at said sliding angle away from the third planar face. The first dovetail portion and the second dovetail portion may form a first male dovetail when the second planar face contacts the fourth planar face. The first male dovetail may be adapted to slideably engage with the at least one dovetail groove. The second planar face of the first dovetail portion may be adapted to contact and slide with the fourth planar face of the second dovetail portion at the sliding angle in a back and forth manner, such that the divider support groove assembly may comprise at least two configurations: a lock configuration and a release configuration. The lock configuration may occur when the first planar face of the first dovetail portion contacts and engages a first inner side of the at least one dovetail groove and when the second third planar face of the second dovetail portion contacts and engages with a second inner side of the at least one dovetail groove while the second planar face and the fourth planar face are in contact with each other. The release configuration may occur when the first groove portion and the second groove portion are slid proximally towards each other and the second planar face and the fourth planar face are in contact with each other, such that the first planar face of the first dovetail portion is no longer in contact with the first inner side of the at least one dovetail groove and when the third planar face of the second dovetail portion is no longer in contact with the second inner side of the at least one dovetail groove. The lock configuration may create a gap between the first groove portion and the second groove portion. The gap may be fitted to engage with an end of a second divider. When the divider support groove assembly is in the release configuration, the divider support groove assembly may be removed from the at least one dovetail groove. The corner coupler may comprise at least a second male dovetail and a third male dovetail. The second male dovetail and the third male dovetail may be adapted to slideably engage with the at least one dovetail groove. The second male dovetail may be disposed at an angle substantially perpendicular to the third male dovetail. The second male dovetail and the third male dovetail may be positioned at an angle greater than 90° to each other. The second male dovetail and the third male dovetail may be positioned at an angle less than 90° to each other.

Another embodiment may be a compartment divider assembly, comprising at least two dividers, comprising at least a first divider and a second divider, and at least two couplers, comprising at least a first coupler and a second coupler. Each of the at least two couplers may comprise at least one support coupler and at least one prong. The first divider may comprise at least one dovetail groove traversing along a longitudinal axis. Each of the at least one prong may comprise a top protrusion and a bottom protrusion. The top protrusion and the bottom protrusion of the first prong may engage with the at least one dovetail groove of the first divider, such that the first coupler may be held substantially in place by tension or friction relative to the first divider. The top protrusion and the bottom protrusion of the second prong may engage with the at least one dovetail groove of the first divider, such that the second coupler may be held substantially in place by tension or friction relative to the first divider. The first and second couplers may be positioned along the dovetail groove of the first divider such that a gap may be created, wherein the gap may be fitted to engage with an end of the second divider. When the gap receives the end of the second divider, the second divider may be positioned substantially perpendicular to the first divider. The second divider may be in a vertical configuration relative to a compartment that contains the compartment divider assembly.

Another embodiment may be a compartment divider assembly, comprising at least two dividers, comprising at least a first divider and a second divider, and at least two twist couplers, comprising at least a first twist coupler and a second twist coupler. Each of the at least two twist couplers may comprise at least one support coupler and a twist prong. The first divider may comprise at least one dovetail groove traversing along a longitudinal axis. The first twist prong and the second twist prong may have a height that is greater than a width such that when the first and second twist couplers are rotated to a substantially horizontal position the first and second twist prongs may pass into the at least one dovetail groove, and when the first and second twist couplers are rotated to a substantially vertical position when engaged with at least one dovetail groove, the first and second twist prongs may be prevented from being pulled out of the at least one dovetail groove. The first and second twist couplers may engage with the at least one dovetail groove and may be held substantially in place by tension or friction relative to the first divider. The first and second twist couplers may be positioned along the dovetail groove of the first divider such that a gap is created, wherein the gap is fitted to engage with an end of the second divider. When the gap receives the end of the second divider, the second divider may be positioned substantially perpendicular to the first divider. The second divider may be in a vertical configuration relative to a compartment that contains the compartment divider assembly.

Another embodiment may be a compartment divider assembly, comprising at least two dividers, comprising at least a first divider and a second divider, and one or more couplers. Each of the one or more couplers may comprise at least one support coupler, at least one prong, and a male connector. Each of the at least two dividers may comprise at least one dovetail groove traversing along a longitudinal axis. The at least one prong may comprise a top protrusion and a bottom protrusion. The top protrusion and the bottom protrusion may engage with the at least one dovetail groove of the first divider, such that the first coupler may be held substantially in place by tension or friction relative to the first divider. The male connector may slideably engage with the dovetail groove of the second divider. When the male connector slideably engages with the second divider, the second divider may be positioned substantially perpendicular to the first divider. The second divider and the male connector may each be in a horizontal configuration relative to a compartment that contains the compartment divider assembly. The one or more couplers may be one coupler. The one coupler may comprise two prongs, a top prong and a bottom prong. The top prong may comprise the top protrusion and the bottom prong may comprise the bottom protrusion. The two prongs may engage with at least one dovetail groove of the first divider by deforming into the at least one dovetail groove.

Another embodiment may be a compartment divider assembly, comprising at least two dividers, comprising at least a first divider and a second divider, and one or more twist couplers. Each of the one or more twist couplers may comprise at least one support coupler, at least one twist prong, and a male connector. Each of the at least two dividers may comprise at least one dovetail groove traversing along a longitudinal axis. The at least one twist prong may have a height that is greater than a width such that when the one or more twist couplers are rotated to a substantially horizontal position the at least one twist prong may pass into the at least one dovetail groove of the first divider, and when the one or more twist couplers are rotated to a substantially vertical position when engaged with at least one dovetail groove, the one or more twist prongs may be prevented from being pulled out of the at least one dovetail groove of the first divider. The one or more twist couplers may engage with the at least one dovetail groove of the first divider and may be held substantially in place by tension or friction relative to the first divider. The male connector may slideably engage with the dovetail groove of the second divider. When the male connector slideably engages with the second divider, the second divider may be positioned substantially perpendicular to the first divider. The second divider and the male connector may be each in a horizontal configuration relative to a compartment that contains the compartment divider assembly.

Another embodiment may be a compartment divider assembly, comprising at least two dividers, comprising at least a first divider and a second divider, and at least one coupler. Each of the at least one coupler may comprise at least two coupler supports, a first coupler support and a second coupler support, and at least one prong. The first and second support couplers may be substantially parallel to each other and may be spaced apart from each other to form a gap. The first divider may comprise at least one groove traversing along a longitudinal axis. The at least one prong may be configured to matingly engage with the at least one groove of the first divider and the gap may be configured to engage with an end of the second divider. When the gap receives the end of the second divider, the second divider may be positioned substantially perpendicular to the first divider and such that the at least one coupler may be held in place in the first divider by the second divider. The first and second support couplers may be vertically disposed and substantially perpendicular to the prong, such that the second divider may be in a vertical configuration relative to a compartment that contains the compartment divider assembly. When the prong engages with the groove of the first divider, the coupler may be held removably in place by friction. The at least one coupler may be one coupler. The one coupler may comprise one prong. The one prong may engage with the at least one groove of the first divider by deforming into the at least one groove.

Another embodiment may be a compartment divider assembly, comprising two or more dividers, comprising at least a first divider and a second divider, and one or more couplers. Each of the one or more couplers may comprise at least one support coupler and at least one prong. Each of the at least two dividers may comprise at least one dovetail groove traversing along a longitudinal axis. At least one of the at least one dovetail groove of the first divider may longitudinally align with at least one of the at least one dovetail groove of the second divider when the two dividers are positioned side by side longitudinally. The at least one prong may comprise a top protrusion and a bottom protrusion. The top protrusion and the bottom protrusion may engage with both the at least one dovetail groove of the first divider and the at least one dovetail groove of the second divider such that the first coupler may be held substantially in place by tension or friction relative to the first divider and the second divider, and wherein the first and second divider may be held in place next to each other in an end to end manner. Each of at least one prong may be one unitary prong that may have a base, the top protrusion, and the bottom protrusion. At least one prong may comprise two vertically spaced prongs, a top prong and a bottom prong, wherein the top prong may comprise a base and the top protrusion, and wherein the bottom prong may comprise a base and the bottom protrusion. The two dividers may be positioned in a substantially vertical manner relative to a compartment in which the assembly rests. The two dividers may be positioned in a substantially horizontal manner relative to a compartment in which the assembly rests. The one or more couplers may be one coupler. The one coupler may comprise two prongs, a top prong and a bottom prong. The top prong may comprise the top protrusion and the bottom prong may comprise the bottom protrusion. The two prongs may engage with the at least one dovetail groove of the first divider by deforming into the at least one dovetail groove.

The compartment divider assembly may be customizable and readily adaptable to a wide variety of different applications without structural modification.

The compartment divider assembly may be an assembly that utilizes a variety of dividers, couplers, and accessory receiving devices when customizing according to the user's preferences.

The compartment divider assembly may be an assembly that is versatile, powerful, cost-effective to manufacture, and effortlessly easy to use.

Other features and advantages are inherent in the compartment divider assembly claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE DRAWINGS

Figure 1A:
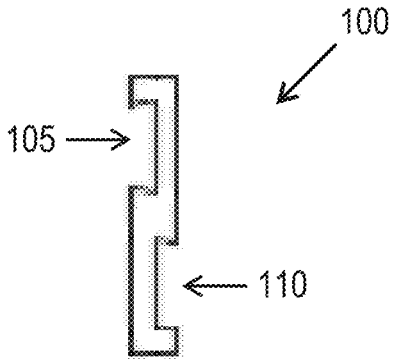
FIGS. 1A through 1D are illustrations of one embodiment of a divider.

In the following detailed description of various embodiments of the present disclosure, numerous specific details are set forth in order to provide a thorough understanding of various aspects of one or more embodiments of the present disclosure. However, one or more embodiments of the present disclosure may be practiced without some or all of these specific details. In other instances, well-known methods, procedures, and/or components have not been described in detail so as not to unnecessarily obscure aspects of embodiments of the present disclosure.

While multiple embodiments are disclosed, still other embodiments of the present disclosure will become apparent to those skilled in the art from the following detailed description, which shows and describes illustrative embodiments of the present disclosure. As will be realized, the device of the present disclosure is capable of modifications in various obvious aspects, all without departing from the spirit and scope of the present disclosure. Accordingly, the screen shot figures, and the detailed descriptions thereof, are to be regarded as illustrative in nature and not restrictive. Also, the reference or non-reference to a particular embodiment of the present disclosure shall not be interpreted to limit the scope of the present disclosure.

In the following description, certain terminology is used to describe certain features of one or more embodiments of the present disclosure. For instance, the term "divider" refers to any device or strip of material that is used to couple with another divider in order to compartmentalize and/or divide a given space. As used herein, the term "accessory" generally refers to a tool or device that is used to fit within a space of a compartment, such as a confined space, drawer, file cabinet, file cabinet drawer, and/or the like.

As used herein, the term "dovetail groove" generally refers to any substantially elongated slot, depression, or trench on a divider, wherein the inner side or relief of the slot, depression, or trench facing a mouth or opening is greater in size than the mouth or opening itself. An example of a dovetail groove may include T-Tracks. The dovetail groove may be constructed of any shape, so long as the inner side is larger than the mouth or opening of the slot, depression, or trench.

As used herein, the term "dovetail" generally refers to any anchoring device, including tapered projection devices or inwardly-projecting anchoring devices, having a terminal end that is larger than the connected or truncated end. In various embodiments, the "dovetail" may be capable of forming a joint with a dovetail groove. An example of a dovetail may also include a T-dovetail.

As used herein, the term "prong" generally refers to a male connector, such as a prong, protrusion, twist protrusion, or other horizontally disposed portion that protrudes outward from a coupler and is configured to engage a female portion, such as a dovetail groove.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the term "substantially perpendicular" refers to an angle of roughly or approximately 90° to a given line, plane, or surface. In various embodiments. "substantially perpendicular" may also refer to reasonably acute angles and reasonably obtuse angles.

As used herein, the terms "approximately" and "about" generally refer to a deviance of within 15% of the indicated number or range of numbers. In one embodiment, the term "approximately" and "about", refer to a deviance of between 0.0001-40% from the indicated number or range of numbers.

Figure 1B:
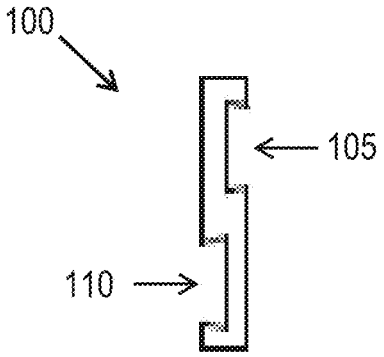
Figure 1C:
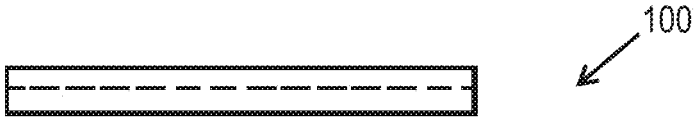
Figure 1D:
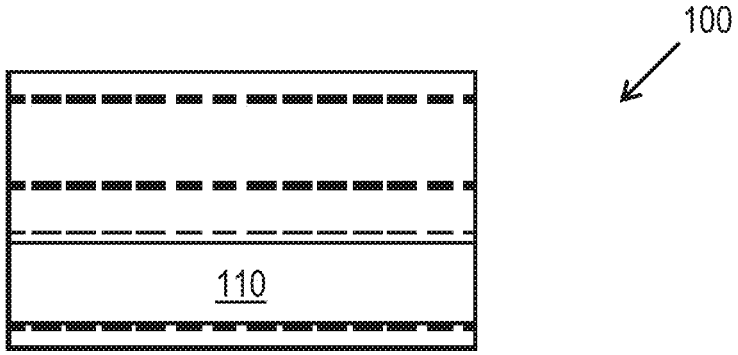

FIGS. 1A through 1D are illustrations of several views of one embodiment of a divider. FIG. 1A is an elevational right-side view of the divider 100. FIG. 1B is an elevational left-side view of the divider 100. FIG. 1C is a top plan view of the divider 100. FIG. 1D is a front elevational view of the divider 100. As shown in FIGS. 1A through 1D, one embodiment of the divider 100 may comprise dovetail grooves 105, 110 that traverse or travel across a longitudinal path. These dovetail grooves 105, 110 generally allow the divider 100 to couple or removably attach to additional dividers via male dovetails. In particular, additional dividers having male dovetails may be inserted through the dovetail grooves 105, 110 and slide through the dovetail grooves 105, 110. The dovetail grooves 105, 110 are tapered or angled sided channels, as shown in FIGS. 1A to 1D.

Figure 2A:
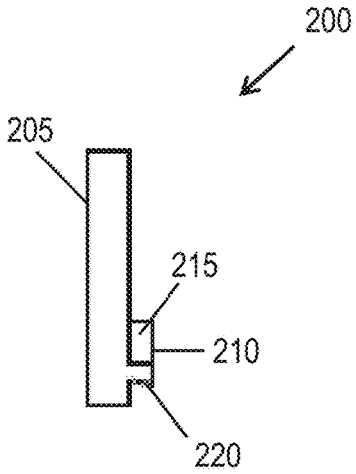
FIGS. 2A through 2C are illustrations of one embodiment of a first support groove.
Figure 2B:
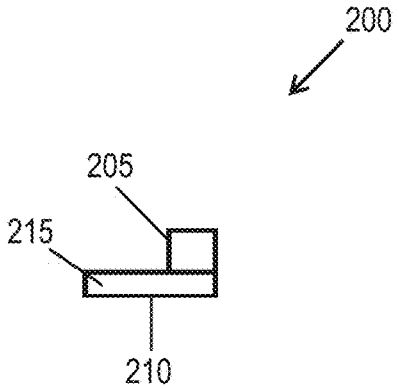
Figure 2C:
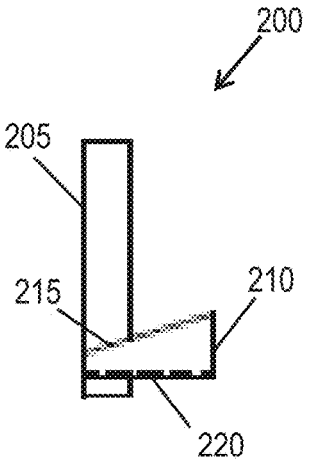

FIGS. 2A through 2C are illustrations of several views of one embodiment of a first support groove. FIG. 2A is an elevational right-side view of the first support groove 200. FIG. 2B is a top plan view of the first support groove 200. FIG. 2C is a front elevational view of the first support groove 200. As shown in FIGS. 2A through 2C, one embodiment of the first support groove 200 may comprise a first groove portion 205 and a first dovetail portion 210. The first groove portion 205 may be disposed in a substantially vertical manner, and the first dovetail portion 210 may be disposed in a generally horizontal manner. The first groove portion 205 may be coupled or integral to the first dovetail portion 210, such that at least one side of the first groove portion 205 is disposed in a substantially perpendicular or reasonably acute or obtuse angle with respect to at least one side of the first dovetail portion 210.

Importantly, FIG. 2A shows that the first dovetail portion 210 may have a first planar face 220 sloping outwardly at a first dovetail angle, and FIG. 2C shows that the first dovetail portion 210 may have a second planar face 215 sloping at a sliding angle away from the first planar face 220. This will allow the first dovetail portion 210 of the first support groove 200 to form a male dovetail when the second planar face 215 of the first dovetail portion 210 contacts a fourth planar face 315 the second dovetail portion 310 (shown in FIGS. 4A-4B). The sliding angle of the second planar face 215 also may be adapted to contact and slide with the third dovetail portion 310, thereby allowing the male dovetail to form a lock configuration and a release configuration (shown in FIG. 4B).

Figure 3A:
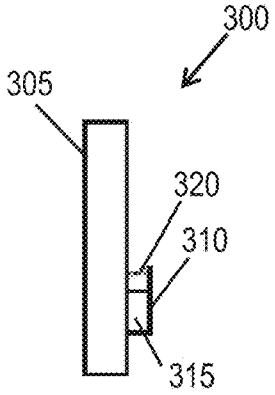
FIGS. 3A through 3C are illustrations of one embodiment of a second support groove.
Figure 3B:
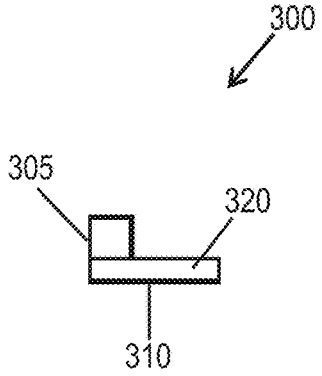
Figure 3C:
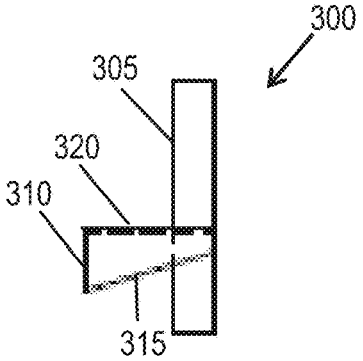

FIGS. 3A through 3C are illustrations of several views of one embodiment of a second support groove. FIG. 3A is an elevational left-side view of the second support groove 300. FIG. 3B is a top plan view of the second support groove 300. FIG. 3C is a front elevational view of the second support groove 300. As shown in FIGS. 3A through 3C, one embodiment of the second support groove 300 may comprise a second groove portion 305 and a second dovetail portion 310. The second groove portion 305 may be disposed in a substantially vertical manner, and the second dovetail portion 310 may be disposed in a generally horizontal manner. The second groove portion 305 may be coupled or integral to the second dovetail portion 310, such that at least one side of the second groove portion 305 may be disposed in a substantially perpendicular or reasonably acute or obtuse angle with respect to at least one side of the second dovetail portion 310.

Importantly, FIG. 3A shows that the second dovetail portion 310 may have a third planar face 320 sloping outwardly at a second dovetail angle, and FIG. 3C shows that the second dovetail portion 310 may have a fourth planar face 315 sloping at a sliding angle away from the third planar face 320. This will allow the second dovetail portion 310 of the second support groove 300 to form a male dovetail when the fourth planar face 315 of the second dovetail portion 310 contacts the second planar face 215 of the first dovetail portion 210 (shown in FIGS. 4A-4B). The sliding angle of the second planar face 215 also may be adapted to contact and slide with the third dovetail portion 310, thereby allowing the male dovetail to form a lock configuration and a release configuration (shown in FIG. 4B).

Figure 4A:
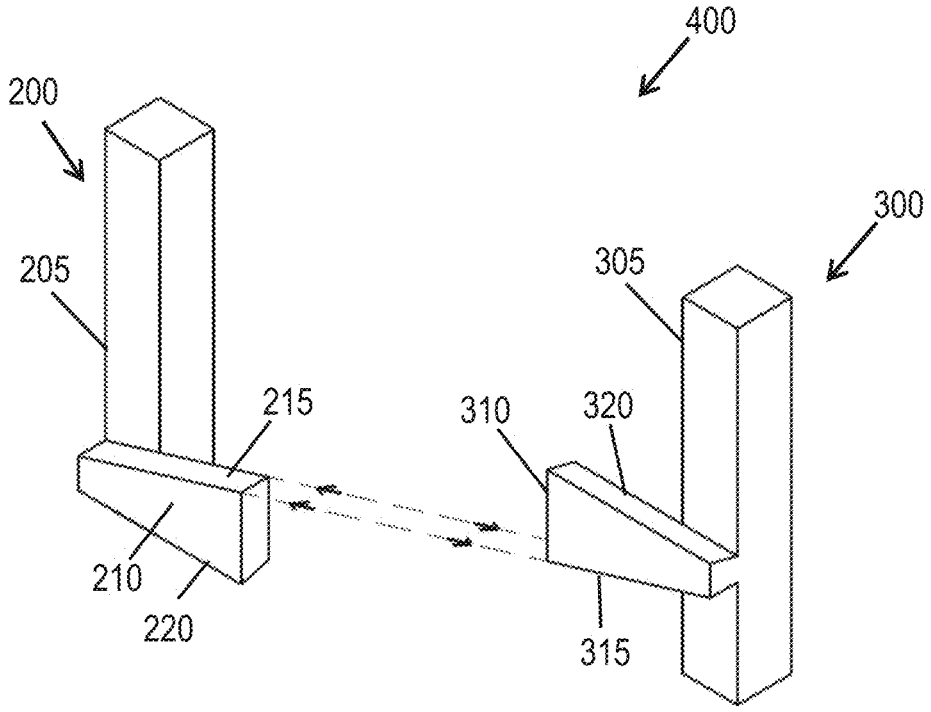
FIGS. 4A through 4B are illustrations of one embodiment of the divider support groove assembly and shows how the first support groove and second support groove engage with one another.
Figure 4B:
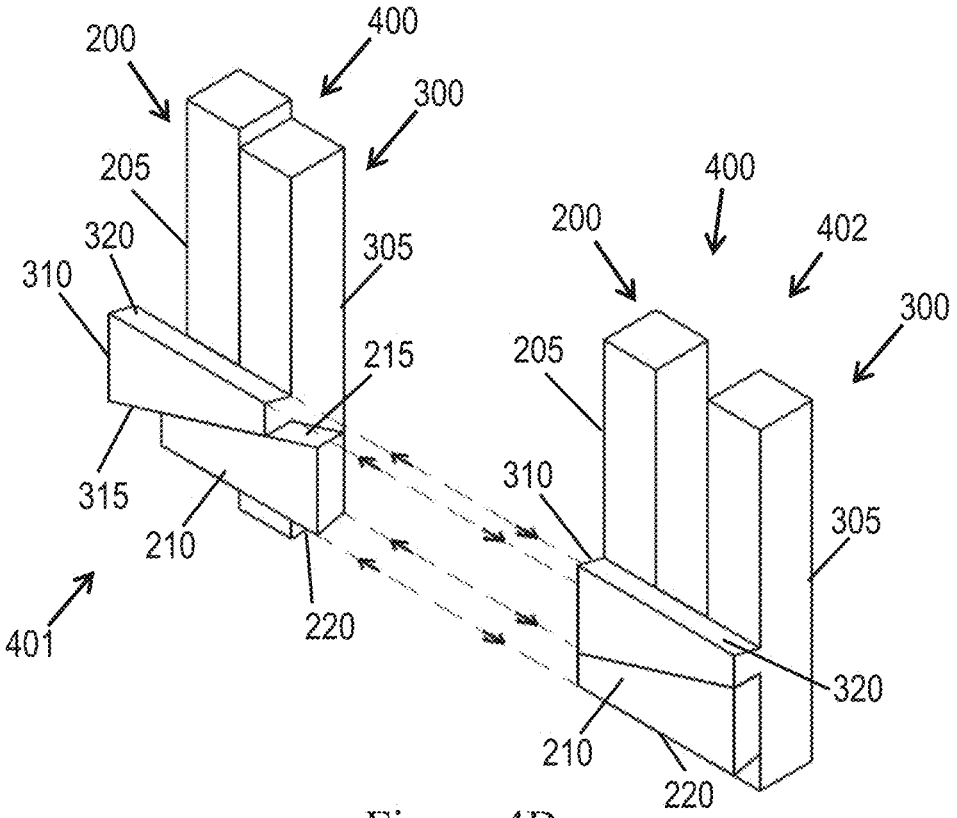

FIGS. 4A through 4B are illustrations of one embodiment of the divider support groove assembly and shows how the first support groove and second support groove engage with one another. Specifically. FIG. 4A shows the first support groove 200 and second support groove 300 separated, and FIG. 4B shows the first support groove 200 and second support groove 300 engaged together in two different positions. As shown in FIGS. 4A and 4B, one embodiment of the divider support groove assembly 400 may comprise a first support groove 200 and second support groove 300. FIG. 4A shows that the first support groove 200 may engage with the second support groove 300 by having the second planar face 215 of the first support groove 200 contact with the fourth planar face 315 of the second support groove 300. In this manner, the first dovetail portion 210 and the third dovetail portion 310 may slide with respect to one another at a sliding angle. The sliding, in turn, may cause the height or thickness of the male dovetail to increase or decrease. In particular, when the first groove portion 205 slides towards the second groove portion 305 via sliding between the second planar face 215 and the fourth planar face 315, the height of the male dovetail preferably decrease into a release configuration 401. On the other hand, when the first groove portion 205 slides away from the second groove portion 305 via sliding between the second planar face 215 and the fourth planar face 315, the height or thickness of the male dovetail preferably increases or enlarges into the lock configuration 402. This preferably allows the male dovetail of the divider support groove assembly 400 to lock into a dovetail groove.

Figure 5A:
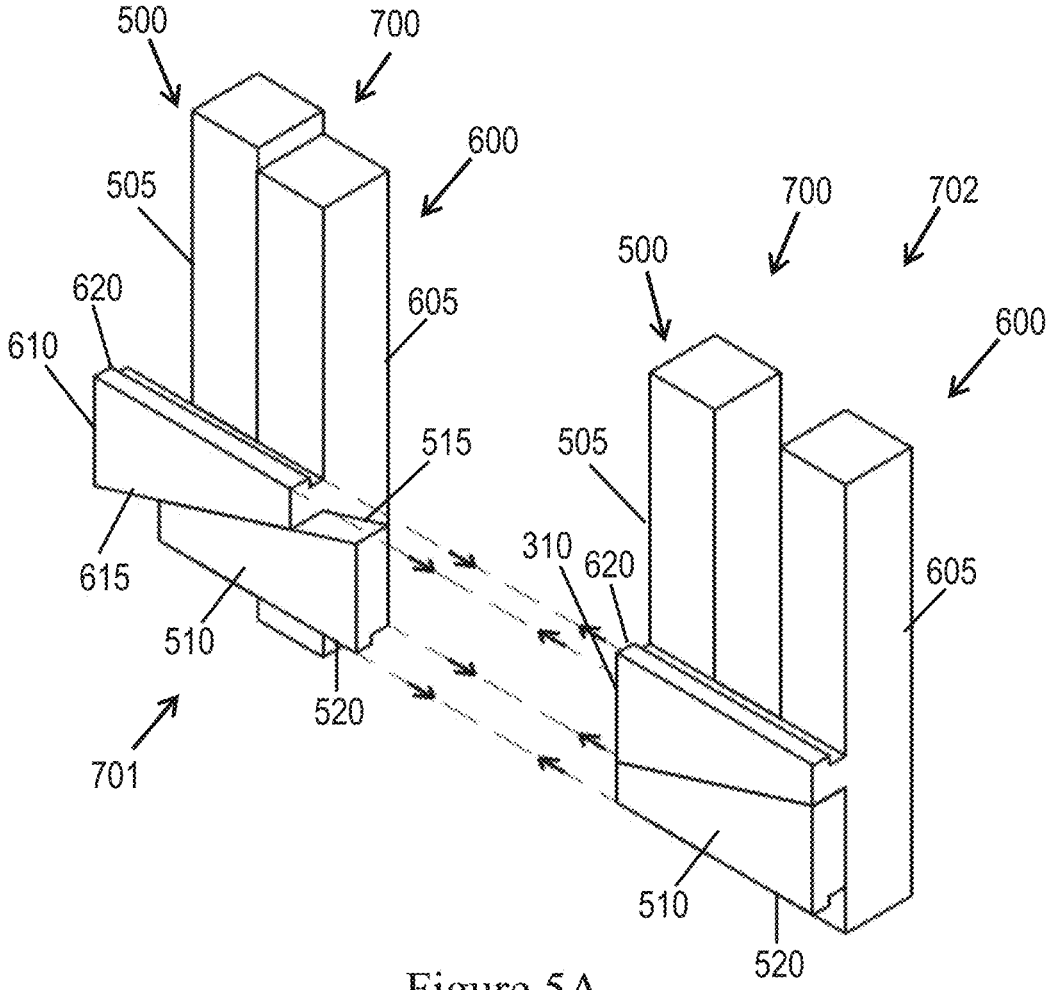
FIGS. 5A through 5B are illustrations of another embodiment of the divider support groove assembly and divider, respectively.
Figure 5B:
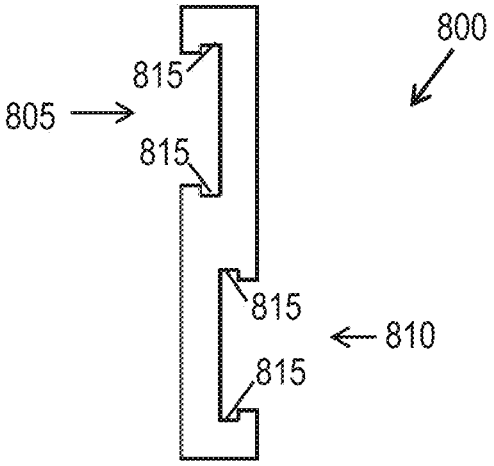

FIGS. 5A through 5B are illustrations of another embodiment of the divider support groove assembly and divider, respectively. As shown in FIG. 5A, another embodiment of the divider support groove assembly 700 may comprise a first support groove 500 and second support groove 600. Importantly, FIGS. 5A and 5B show that the divider support groove assembly and divider may utilize a male T-dovetail and T-Tracks, which are preferably another embodiment of the male dovetail and dovetail groove, respectively. FIG. 5A shows that the first support groove 500 may engage with the second support groove 600 by having the third planar face 515 of the first support groove 500 contact with the fourth planar face 615 of the second support groove 600. In this manner, the first dovetail portion 510, which may be a first T-dovetail portion, and the second dovetail portion 610, which may be a second T-dovetail portion, may contact each other to form a male T-dovetail, which may be another embodiment of the male dovetail. The first dovetail portion 510 and the second dovetail portion 610 may then slide with respect to one another at a sliding angle. The sliding, in turn, may allow the height or thickness of the male T-dovetail to increase or decrease. In particular, when the first groove portion 505 slides towards the second groove portion 605 via sliding between the third planar face 515 and fourth planar face 615, the height of the male T-dovetail preferably decrease into a release configuration 701. On the other hand, when the first groove portion 505 slides away from the second groove portion 605 via sliding between the third planar face 515 and the fourth planar face 615, the height or thickness of the male T-dovetail preferably increases or enlarges into the lock configuration 702. This preferably allows the male T-dovetail of the divider support groove assembly 700 to lock into a T-Track, which is another embodiment of the dovetail groove.

Importantly, FIG. 5A shows that the first dovetail portion 510 and the second dovetail portion 610 may comprise flanges 520, 620, which generally helps form the male T-dovetail. These flanges 520, 620 may be used to help secure the divider support groove assembly 700 onto a T-Track or dovetail groove of a divider having guides within a groove. For instance, FIG. 5B shows a side view of another embodiment of the divider 800 having grooves with guides 815. Here, the first dovetail portion 510 and second dovetail portion 610 may engage with a groove 805, 810 of the divider 800 by first forming a male T-dovetail into the release configuration 701. Once in that position, the height of the first dovetail portion 510 and second dovetail portion 610 combined may be smaller than the opening of the groove, such that the male T-dovetail may be inserted into the groove. The height of the first dovetail portion 510 and second dovetail portion 610 may then enlarge into a lock configuration 702, such that the flanges 520, 620 engage with the guides 815 of the divider 800. This preferably locks the divider support groove assembly 700 onto the groove 805, 810 of the divider 800. FIGS. 5A and 5B show that in another embodiment the T-dovetail is not angled or smoothly tapered, but may be a flange and channel design.

Figure 6A:
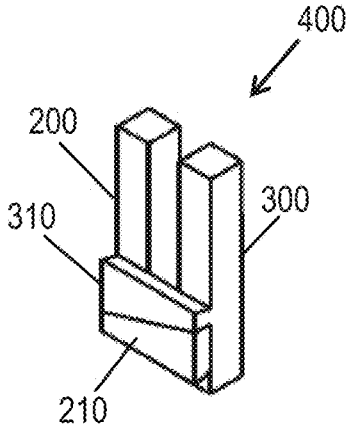
FIGS. 6A through 6C are illustrations of one embodiment of divider support groove assembly in the lock configuration.
Figure 6B:
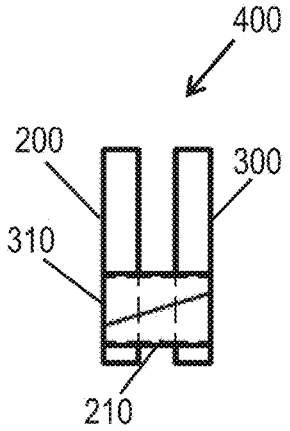
Figure 6C:
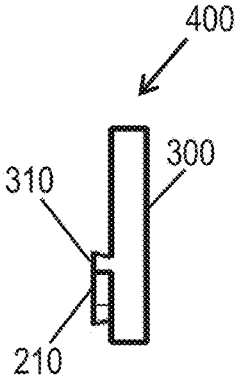

FIGS. 6A through 6C are illustrations of several views of one embodiment of the divider support groove assembly in the lock configuration. Specifically, FIG. 6A is a perspective view of the divider support groove assembly 400 in the lock configuration: FIG. 6B is a front elevational view of the divider support groove assembly 400 in the lock configuration; and FIG. 6C is a side elevational view of the divider support assembly 400 in the lock configuration. As shown in FIGS. 6A through 6C, one embodiment of the divider support groove assembly 400 may comprise a first support groove 200 and second support groove 300. FIGS. 6A through 6C also show that the height of the male dovetail formed by the first dovetail portion 210 and the third dovetail portion 310 may be larger in the lock configuration than in the release configuration, which is shown below in FIGS. 7A through 7C.

Figure 7A:
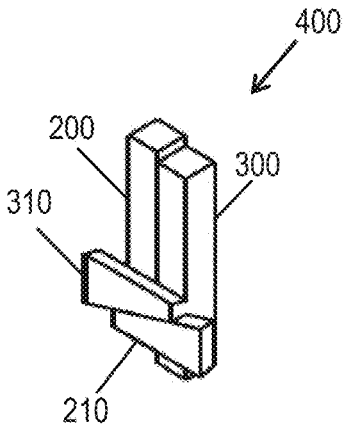
FIGS. 7A through 7C are illustrations of one embodiment of the divider support groove assembly in the release or unlocked configuration.
Figure 7B:
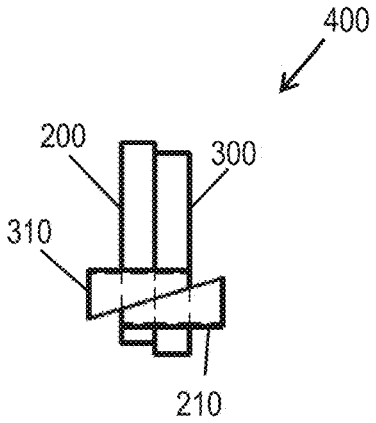
Figure 7C:
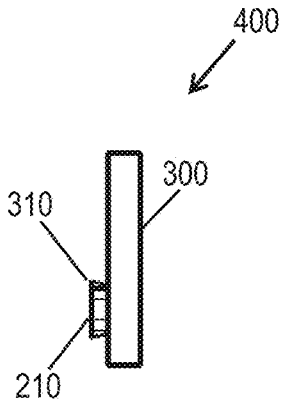

FIGS. 7A through 7C are illustrations of one embodiment of the divider support groove assembly in the release configuration. Specifically. FIG. 7A is a perspective view of the divider support groove assembly 400 in the release configuration. FIG. 7B is a front elevational view of the divider support groove assembly 400 in the release configuration, and FIG. 7C is a side elevational view of the divider support assembly 400 in the release configuration. As shown in FIGS. 7A through 7C, one embodiment of the divider support groove assembly 400 may comprise a first support groove 200 and second support groove 300. Importantly. FIGS. 7A through 7C also show that the height of the male dovetail formed by the first dovetail portion 210 and the third dovetail portion 310 may be smaller in the release configuration than in the lock configuration, which is shown above in FIGS. 6A through 6C.

Figure 8:
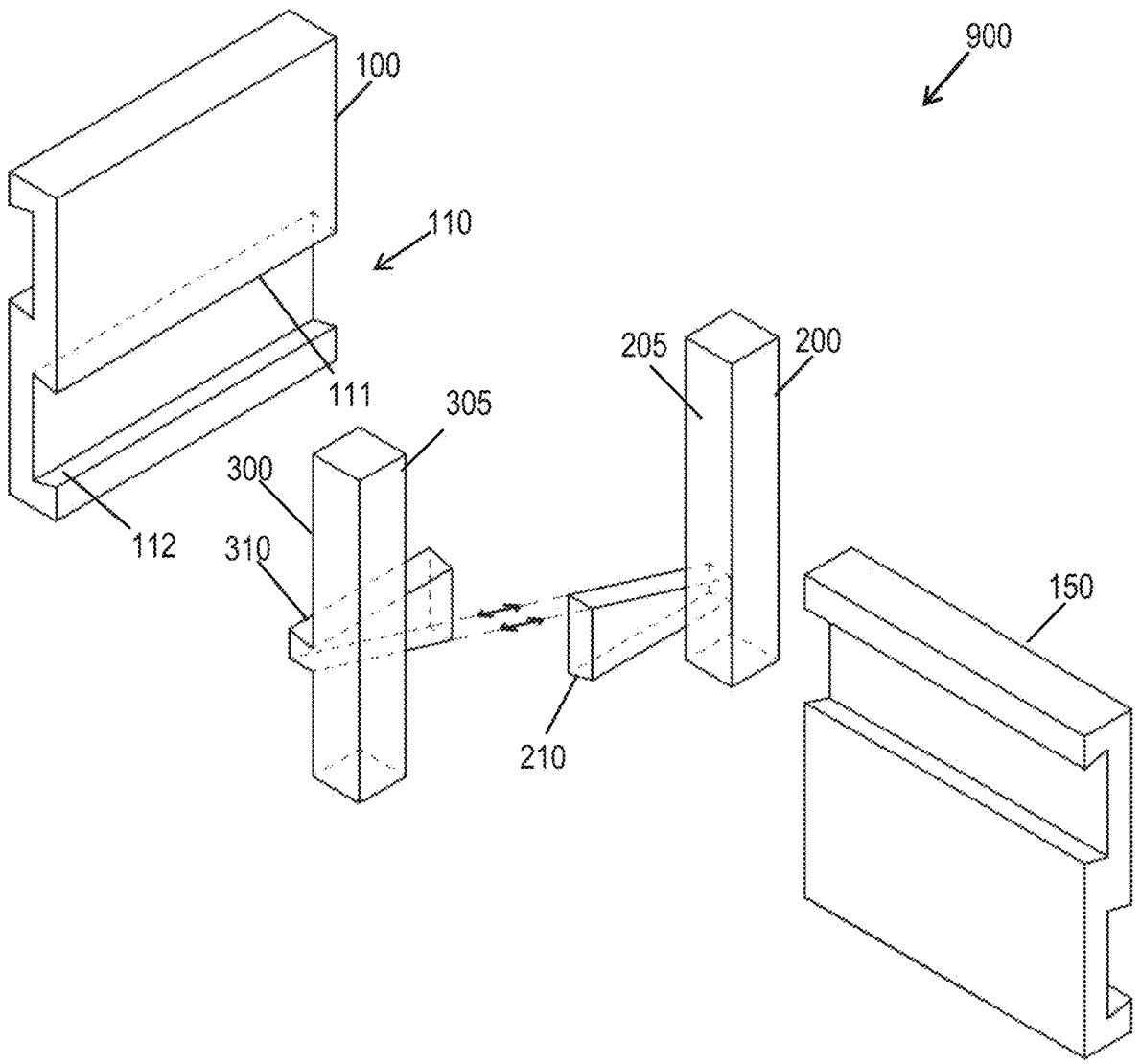
FIG. 8 is an illustration of an exploded view of one embodiment of the compartment divider assembly.

FIG. 8 is an illustration of an exploded view of one embodiment of the compartment divider assembly. As shown in FIG. 8, one embodiment of the compartment divider assembly 900 may comprise: a first divider 100, second divider 150, and divider support groove assembly, which may comprise a first support groove 200 and second support groove 300. In this embodiment, the compartment divider assembly 900 may be used to create a T connection where an end of the second divider 150 couples, attaches, or is held in place at a mid-section or area of the first divider 100. The first dovetail portion 210 of the first support groove 200 and the second dovetail portion 310 of the second support groove 300 may couple with each other and form a male dovetail in the release configuration. In this manner, the height of the male dovetail in the release configuration is then preferably adapted to fit within the edges of the dovetail groove 110, such that the male dovetail formed by the first dovetail portion 210 and the third dovetail portion 310 may be inserted within the edges of the dovetail groove 110 and fit within the inner sides 111, 112 of the dovetail groove 110.

Figure 9:
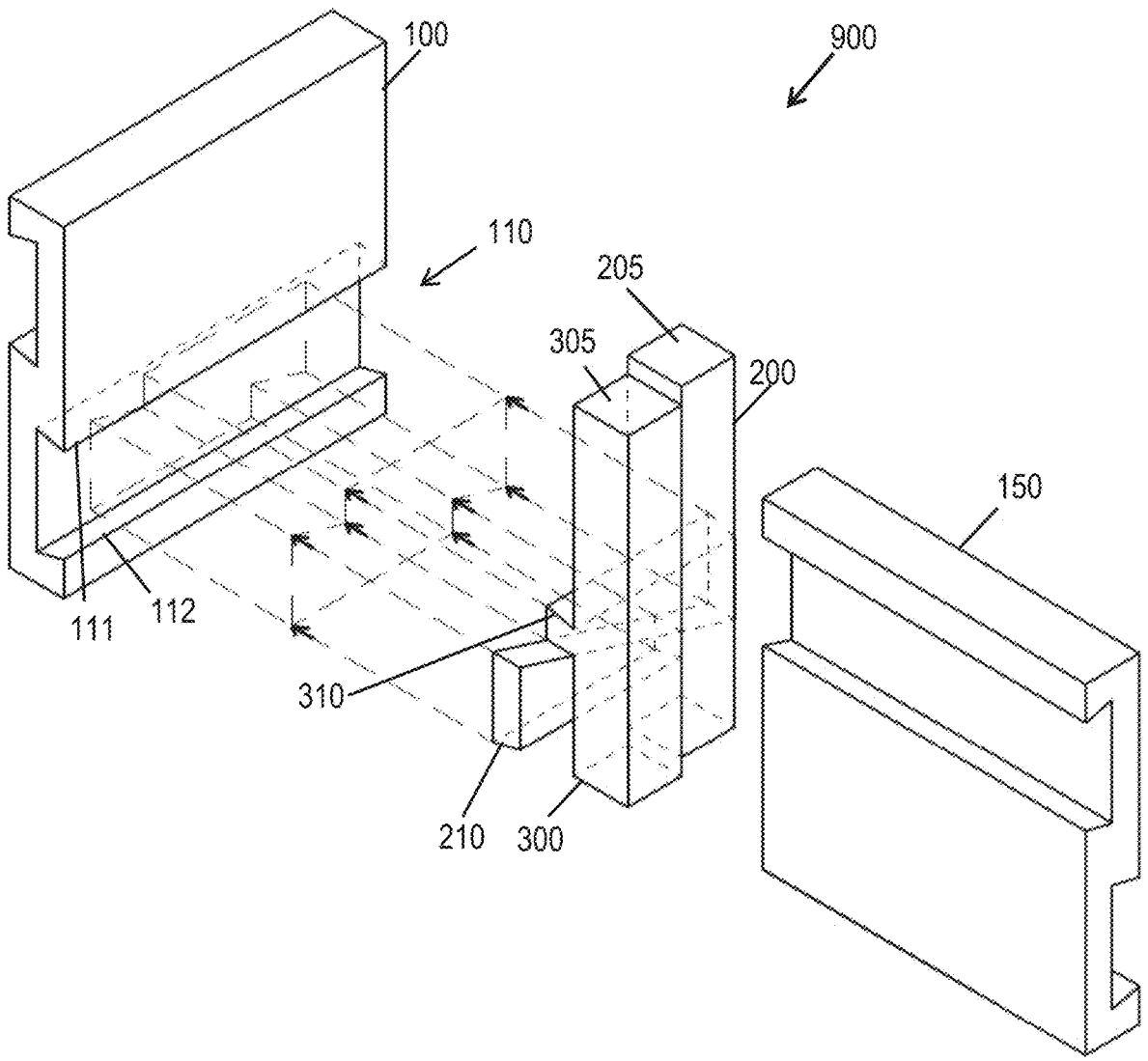
FIG. 9 is another illustration of an exploded view of one embodiment of the compartment divider assembly and shows the first support groove and second support groove in the release configuration.

FIG. 9 is another illustration of an exploded view of one embodiment of the compartment divider assembly and shows the first support groove and second support groove in the release configuration. As shown in FIG. 9, one embodiment of the compartment divider assembly 900 may comprise: a first divider 100, second divider 150, first support groove 200, and second support groove 300. FIG. 9 shows that the first support groove 200 and second support groove 300 may be engaged together in the release configuration. Once the engaged in the release configuration, the male dovetail formed by the first dovetail portion 210 and the third dovetail portion 310 may be inserted within the dovetail groove 110, as shown in FIG. 10.

Figure 10:
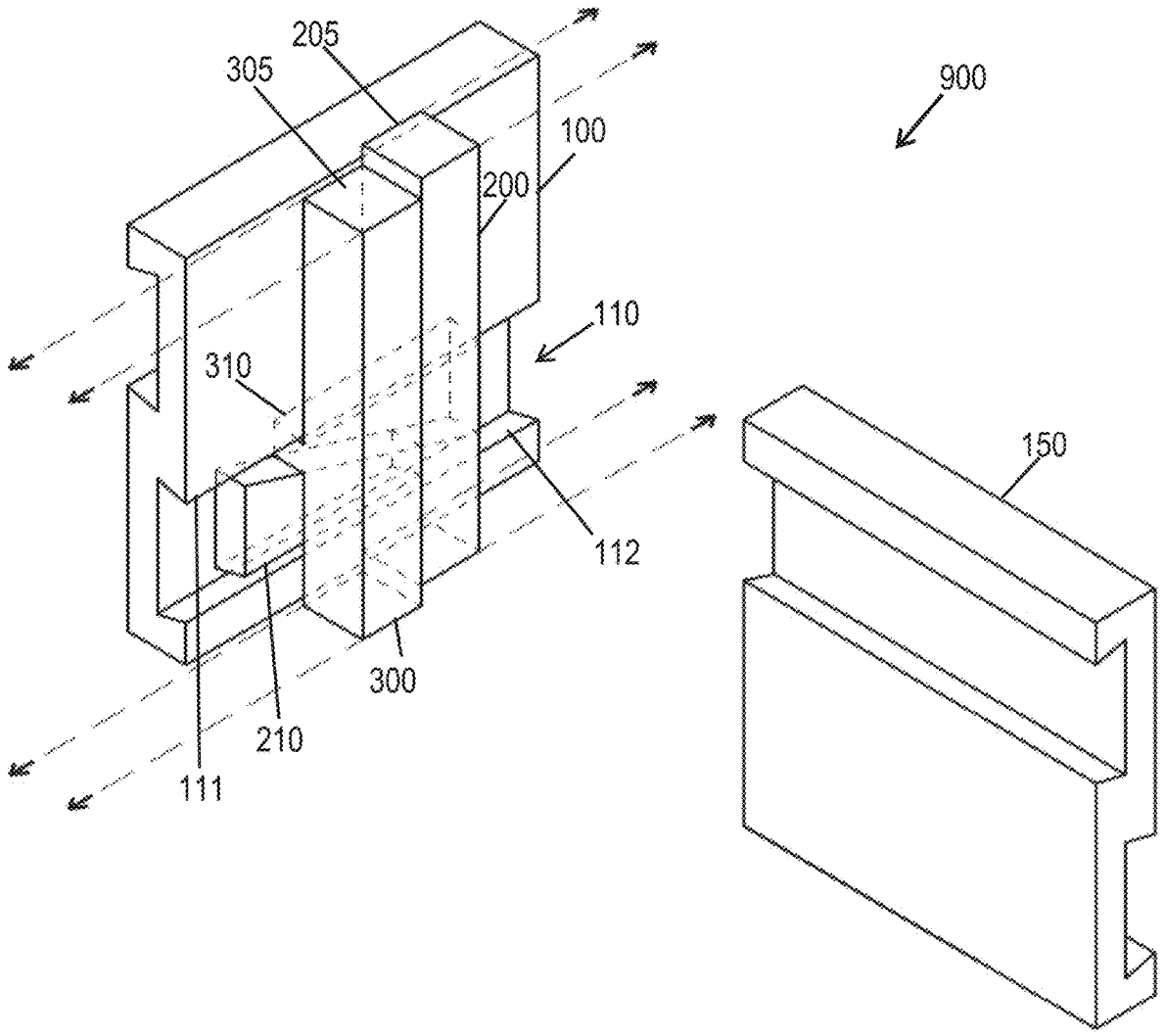
FIG. 10 is another illustration of an exploded view of one embodiment of the compartment divider assembly and shows the first support groove and second support groove in the release configuration, both of which are engaged with a dovetail groove of the first divider.

FIG. 10 is another illustration of an exploded view of one embodiment of the compartment divider assembly and shows the first support groove and second support groove in the release configuration, both of which are engaged with a dovetail groove of the first divider. As shown in FIG. 10, one embodiment of the compartment divider assembly 900 may comprise: a first divider 100, second divider 150, first support groove 200, and second support groove 300. FIG. 10 shows that the male dovetail formed by the first dovetail portion 210 and the third dovetail portion 310 may be inserted within the dovetail groove 110. Importantly, FIG. 10 shows the divider support groove assembly in the release position because the first planar face 220 and third planar face 320 of the first dovetail portion 210 and the third dovetail portion 310 may no longer be engaged or in contact with the inner sides 111, 112 of the dovetail groove 110.

Figure 11:
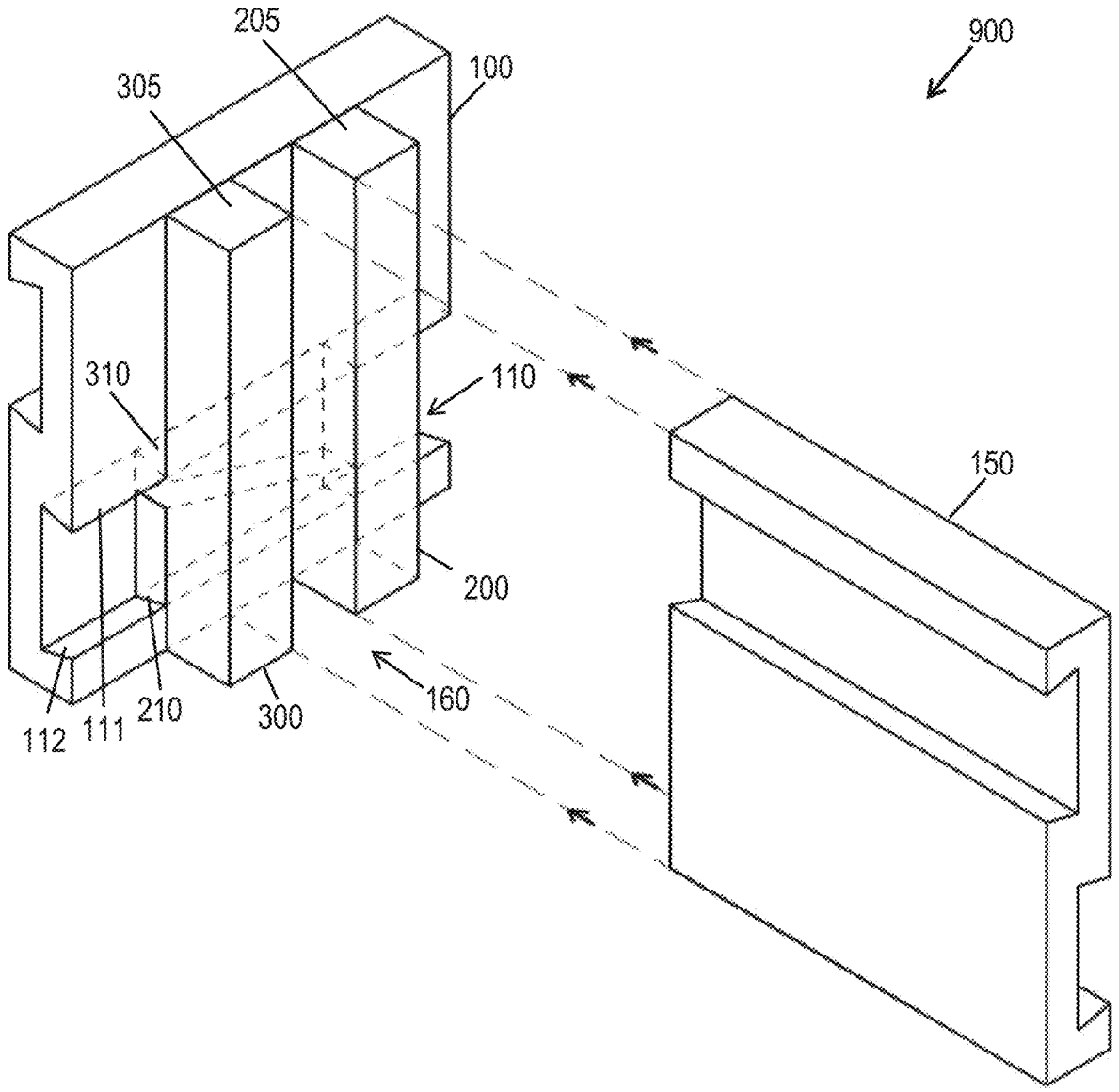
FIG. 11 is another illustration of an exploded view of one embodiment of the compartment divider assembly and shows the divider support groove assembly in the lock configuration, both of which are engaged with a dovetail groove of the first divider, before the second divider engages with a gap formed by the lock configuration of the divider support groove assembly.

FIG. 11 is another illustration of an exploded view of one embodiment of the compartment divider assembly and shows the divider support groove assembly in the lock configuration, both of which are engaged with a dovetail groove of the first divider, before the second divider engages with a gap formed by the lock configuration of the divider support groove assembly. As shown in FIG. 11, one embodiment of the compartment divider assembly 900 may comprise: a first divider 100, second divider 150, first support groove 200, and second support groove 300. FIG. 11 shows that the male dovetail formed by the first dovetail portion 210 and the third dovetail portion 310 may be inserted within the dovetail groove 110. Importantly, FIG. 11 also shows the male dovetail formed by the first dovetail portion 210 and the third dovetail portion 310 to be in the lock configuration. Here, after the first support groove 200 and second support groove 300 are slid apart, the height of the male dovetail preferably increases from the release configuration. As a result, the male dovetail preferably engages with the inner sides 111, 112 of the dovetail groove 110. This in turn allows the first planar face 220 and third planar face 320 to engage with the inner sides 111, 112, respectively, such that the male dovetail is secured and flushed within the dovetail groove 110. Preferably, a gap 160 is then formed between the first groove portion 205 and the second groove portion 305. The gap 160 is then preferably dimensioned to fittingly receive an end of the second divider 150.

Figure 12:
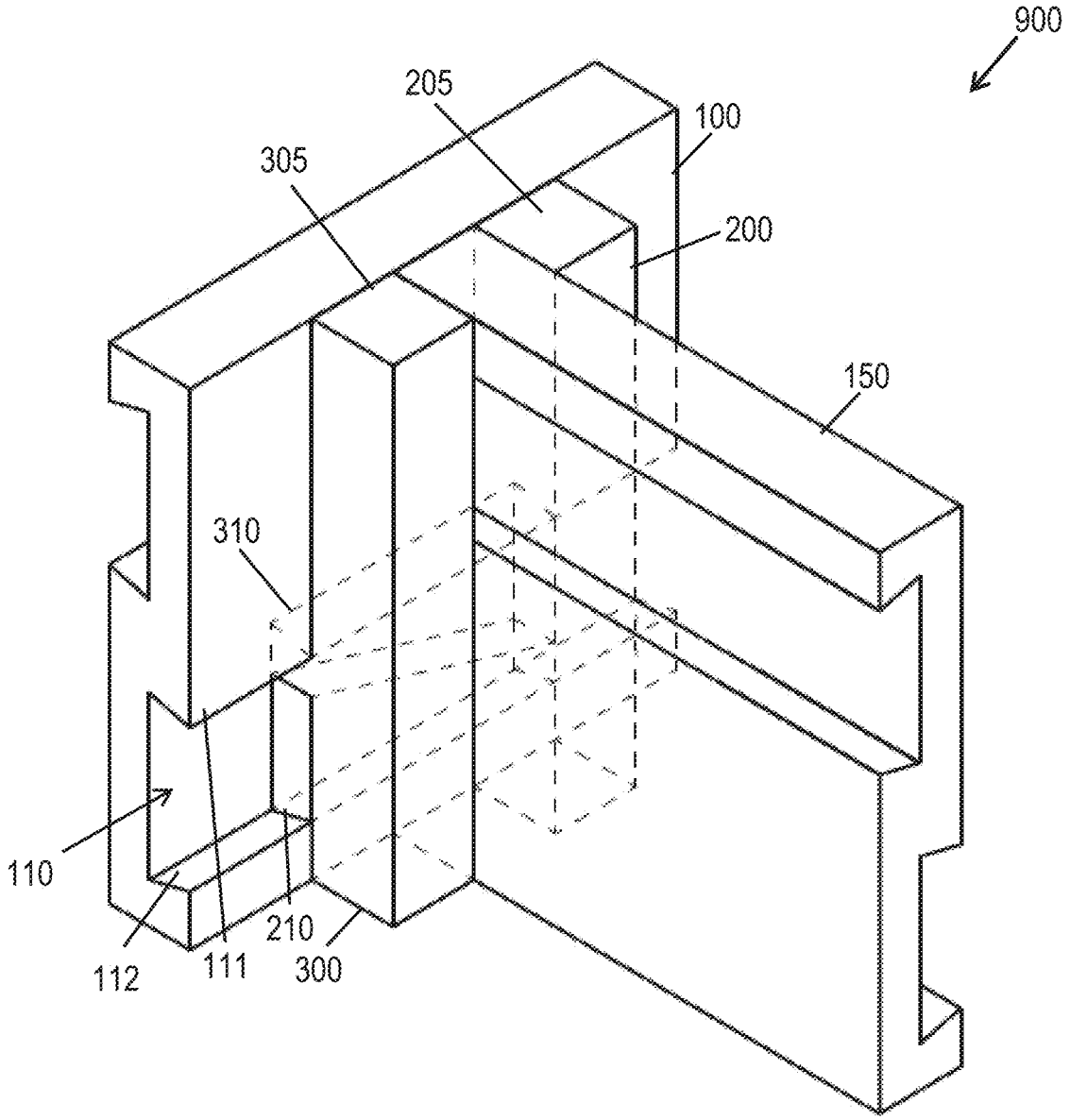
FIG. 12 is an illustration of an assembled view of one embodiment of the compartment divider assembly and shows divider support groove assembly in the lock configuration and with a second divider engaged with the gap formed by the lock configuration of the divider support groove assembly.

FIG. 12 is an illustration of an assembled view of one embodiment of the compartment divider assembly and shows divider support groove assembly in the lock configuration and with a second divider engaged with the gap formed by the lock configuration of the divider support groove assembly. As shown in FIG. 12, one embodiment of the compartment divider assembly 900 may comprise: a first divider 100, second divider 150, and divider support groove assembly, which may comprise a first support groove 200 and second support groove 300. FIG. 12 shows that after the male dovetail of the divider support groove assembly is engaged with the dovetail groove 110 of the first divider 100, the first groove portion 205 and the second groove portion 305 may create a gap 160, which, as shown, may be used to receive an end of the second divider 150. FIG. 12 shows how the assembly 900 may be used to form a divider in a compartment that is held together by tension and/or friction. The parts are held firmly in place by the sliding dovetails. Although FIG. 12 shows second divider 150 to be perpendicular to first divider 100, the second divider 150 may be positioned in various angles. Specifically, the second divider 150 may be greater than or less than 90° degrees, such that the angle between the first divider 100 and second divider 150 is acute or obtuse.

Figure 13:
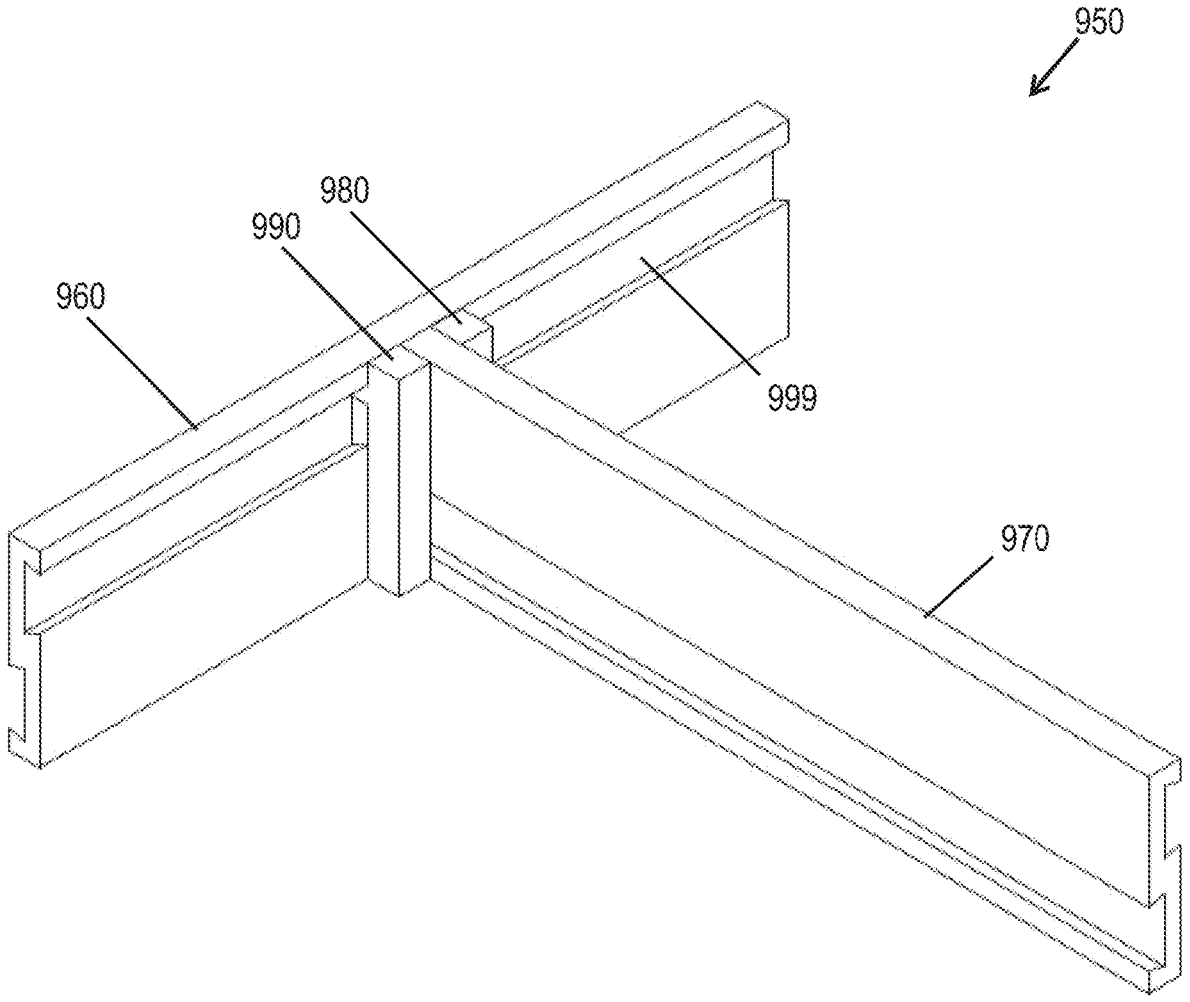
FIG. 13 is another illustration of an assembled view of another embodiment of the compartment divider assembly and shows the divider support groove assembly in the lock configuration with a second divider engaged with the gap formed by the lock configuration of the divider support groove assembly.

FIG. 13 is another illustration of an assembled view of another embodiment of the compartment divider assembly and shows the divider support groove assembly in the lock configuration with a second divider engaged with the gap formed by the lock configuration of the divider support groove assembly. As shown in FIG. 13, another embodiment of the compartment divider assembly 950 may comprise: a first divider 960, second divider 970, first support groove 980, and second support groove 990. Unlike the embodiment of the compartment divider assembly 900 shown in FIGS. 8 through 12, where the dovetail groove 110 disposed at the lower portion of the first divider 100, the compartment divider assembly 950 shown in FIG. 13 has the dovetail groove 999 disposed at the upper portion of the first divider 960. This illustrates how the compartment divider assembly 900, 950 is adapted to various orientations and allows the divider support groove assembly to be coupled or engaged with the first divider 960 at various areas.

Figure 14:
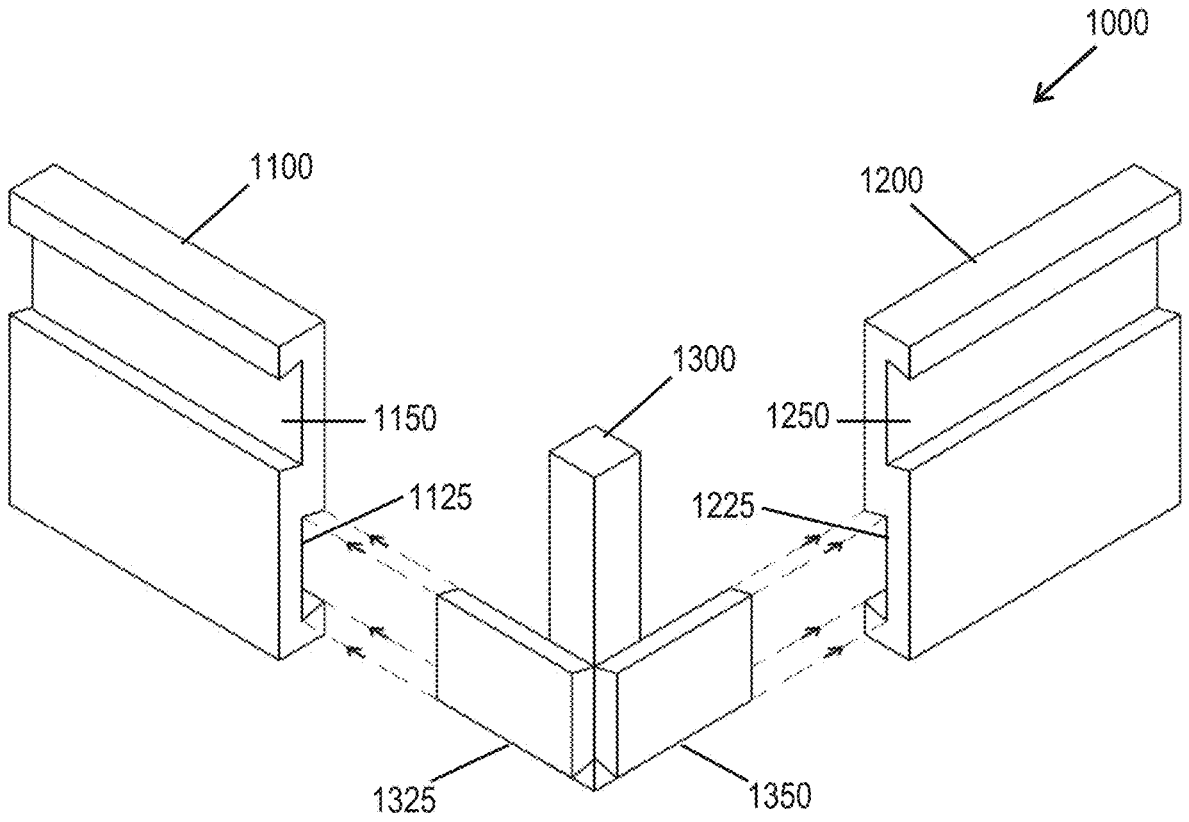
FIG. 14 is an illustration of a front exploded view of one embodiment of a corner assembly with a corner coupler having male dovetails disposed at substantially the same height.

FIG. 14 is an illustration of a front exploded view of one embodiment of a corner assembly with a corner coupler having male dovetails disposed at substantially the same height. As shown in FIG. 14, one embodiment of the corner assembly 1000 may comprise dividers 1100, 1200 and a corner coupler 1300. FIG. 14 shows that each divider 1100, 1200 may comprise two dovetail grooves 1125, 1150, 1225, 1250, such that each divider 1100, 1200 may have a two unit of height of measurement. In other embodiments, each divider may have different heights such as a single unit, triple unit, or higher unit of measurement.

FIG. 14 also shows that corner coupler 1300 may comprise male dovetails 1325, 1350. The male dovetails 1325, 1350 may be adapted to engage and slide within the dovetail grooves 1125, 1150, 1225, 1250 of the dividers 1100, 1200. This will allow the dividers 1100, 1200 to couple with one another at their ends to create a corner assembly 1000 (shown in FIG. 16). In other embodiments, the dividers 1100, 1200 may be adapted to also couple and slide with one another via the corner coupler 1300 to create a T connection as well. When coupled, the dividers 1100, 1200 are substantially immobile on an axis perpendicular to the sliding movement.

FIG. 14 shows that the male dovetails 1325, 1350 of corner coupler 1300 may be disposed near the bottom end of the corner coupler 1300 and may be at substantially the same height as the dovetail grooves 1125, 1225. This will allow the male dovetails 1325, 1350 to engage and slide with the dovetail grooves 1125, 1225, located near or at the bottom portion of the dividers 1100, 1200. Although FIG. 14 shows the male dovetails 1325, 1350 of corner coupler 1300 to be at substantially the same height and near the bottom end of the corner coupler 1300, the male dovetails 1325, 1350 may be disposed at different heights with one another and may be disposed near the top end of the corner coupler. The parts of the assembly 1000 may also be turned around, inverted, and/or flipped, such that they may connect in different ways and heights.

Figure 15:
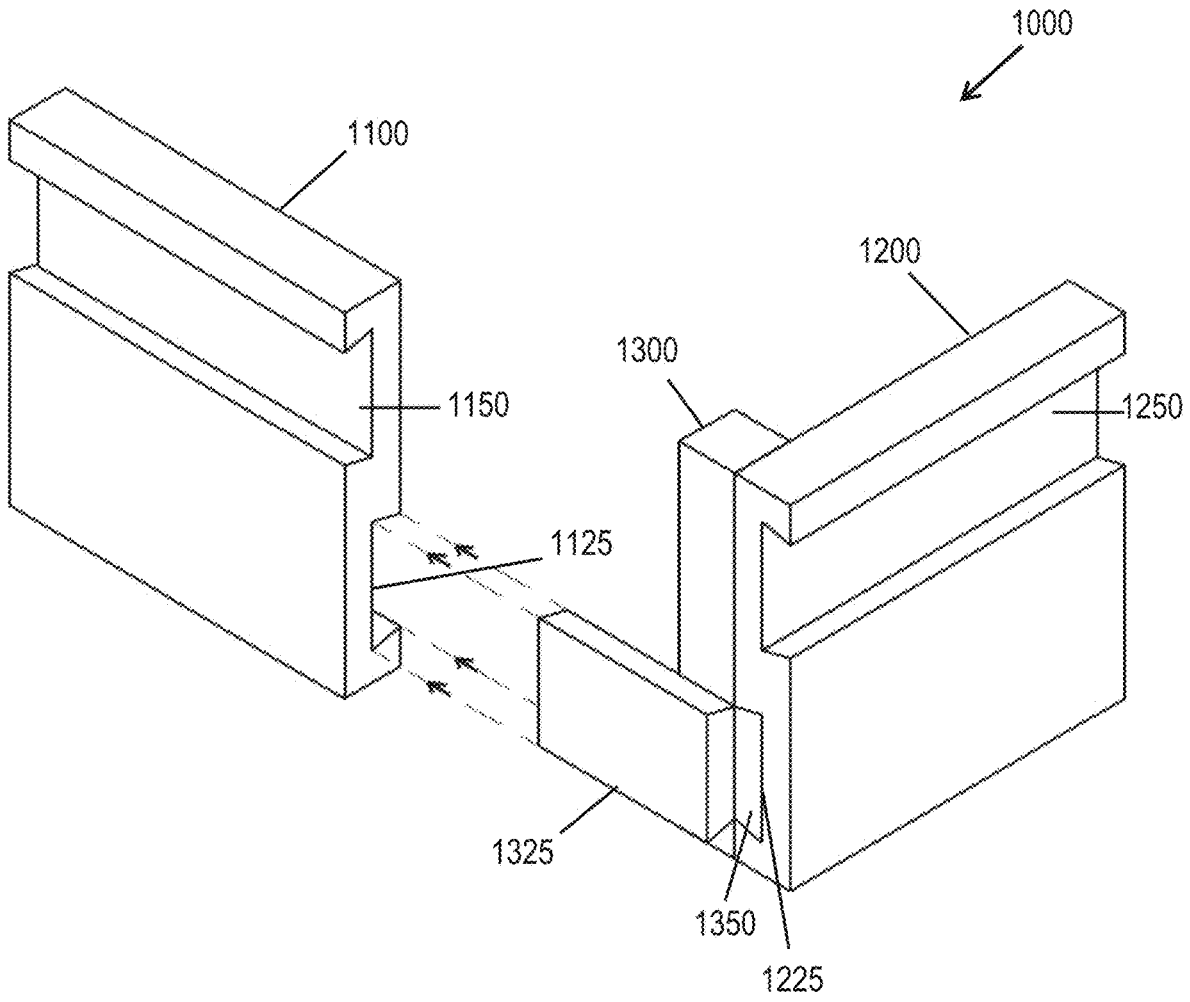
FIG. 15 is another illustration of a front exploded view of one embodiment of the corner assembly, shown in FIG. 14, and shows the second divider engaged with the corner coupler.

FIG. 15 is another illustration of a front exploded view of one embodiment of the corner assembly, shown in FIG. 14, and shows the second divider engaged with the corner coupler. As shown in FIG. 15, one embodiment of the corner assembly 1000 may comprise dividers 1100, 1200 and a corner coupler 1300. FIG. 15 shows that dovetail groove 1225 of divider 1200 may be engaged with male dovetail 1350 of corner coupler 1300. FIG. 15 shows that divider 1200 may only slide to engage with male dovetail 1350, and that the dovetailing prevents divider 1200 from being pulled perpendicularly away from corner coupler 1300.

Figure 16:
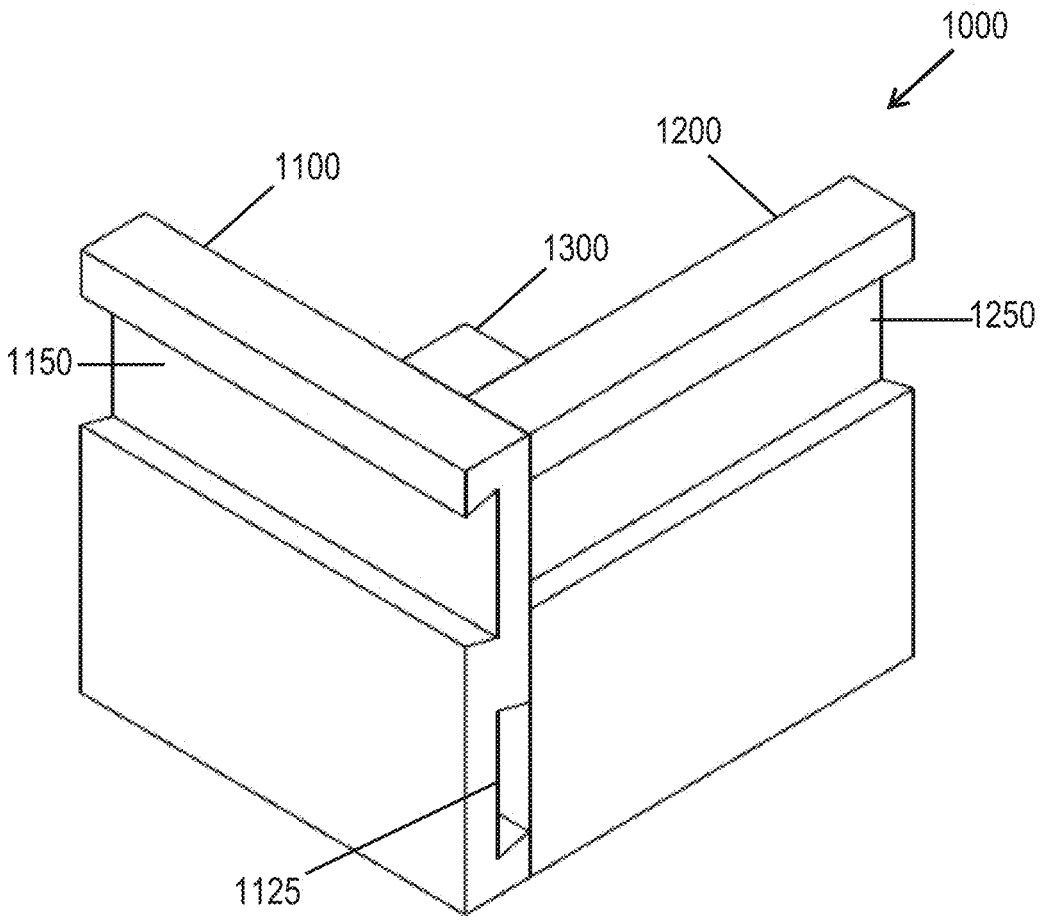
FIG. 16 is another illustration of a front assembled view of one embodiment of the corner assembly, shown in FIG. 14.

FIG. 16 is another illustration of a front assembled view of one embodiment of the corner assembly, shown in FIG. 14. As shown in FIG. 16, one embodiment of the corner assembly 1000 may comprise dividers 1100, 1200 and a corner coupler 1300. FIG. 16 shows that dovetail groove 1225 of divider 1200 may be engaged with male dovetail 1350 of corner coupler 1300 and that dovetail groove 1125 of divider 1100 may be engaged with male dovetail 1325 of corner coupler 1300. Importantly, FIG. 16 shows that divider 1100 may slide further inwards such that divider 1100 may overlap an end of the divider 1200. Either divider may slide further at the expense of the other divider. Although the stacked dovetail grooves 1125 and 1150 are show on opposite sides, it should be understood that the stacked dovetail grooves 1125 and 1150 may be on the same side in other embodiments. In other embodiments, the dovetail grooves might be on opposite sides of the divider, but at the same height, or at a partially overlapping height.

Figure 17:
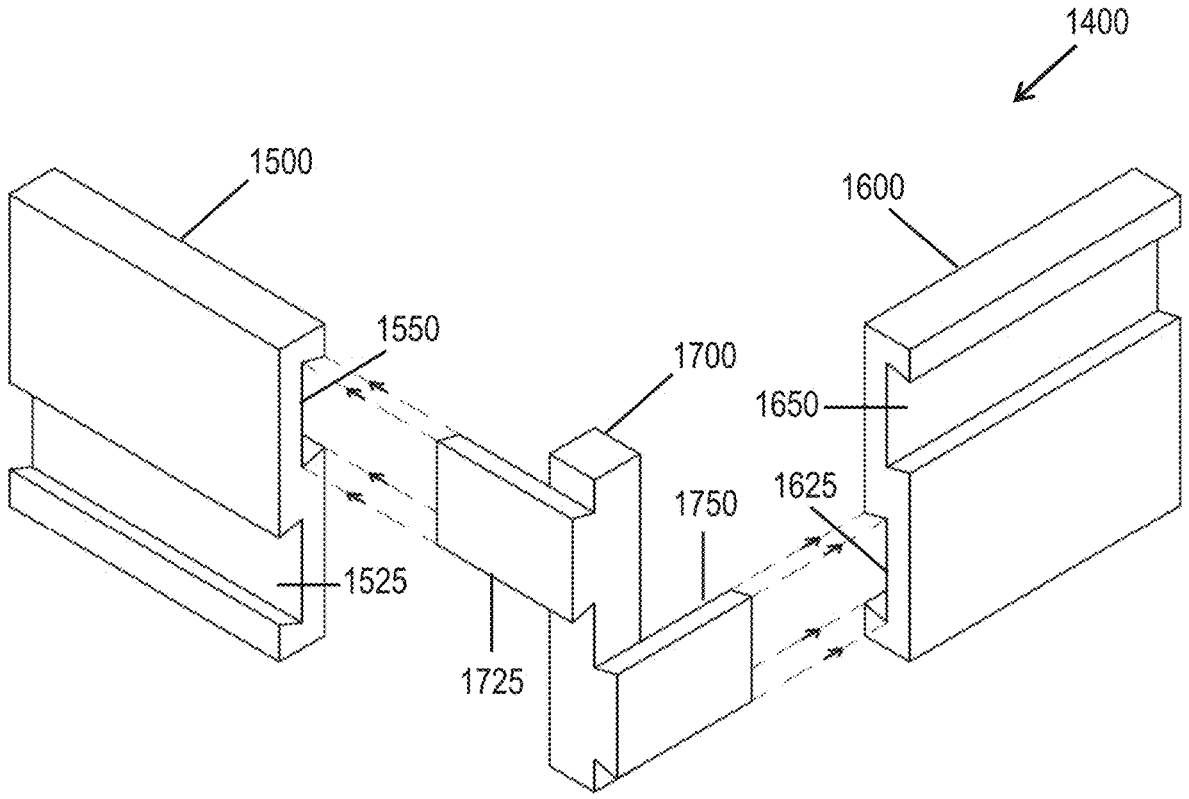
FIG. 17 is an illustration of a front exploded view of another embodiment of a corner assembly with a corner coupler having male dovetails disposed at different heights.

FIG. 17 is an illustration of a front exploded view of another embodiment of a corner assembly with a corner coupler having male dovetails disposed at different heights. As shown in FIG. 14, another embodiment of the corner assembly 1400 may comprise dividers 1500, 1600 and a corner coupler 1700. FIG. 17 shows that each divider 1500, 1600 may each comprise two dovetail grooves 1525, 1550, 1625, 1650, such that each divider 1500, 1600 may also have a two unit or double unit height of measurement. In other embodiments, each divider may have different heights as a single unit, triple unit, or higher unit of measurement. Generally, the dovetail grooves and male dovetails may be disclosed horizontally along the dividers or corner couplers, such that they may engage each other at various heights and ways.

FIG. 17 also shows that corner coupler 1700 may comprise male dovetails 1725, 1750. The male dovetails 1725, 1750 may be adapted to engage and slide within the dovetail grooves 1525, 1550, 1625, 1650 of the dividers 1500, 1600. This will allow the dividers 1500, 1600 to couple with one another at their ends to create a corner assembly 1400 (shown in FIG. 19). In other embodiments, the dividers 1500, 1600 may be adapted to also couple and slide with one another via the corner coupler 1700 to create a T connection as well.

FIG. 17 shows that male dovetail 1725 may be disposed near the top end of the corner coupler 1700 and that male dovetail 1750 may be disposed near the bottom end of the corner coupler 1700, such that the male dovetails 1725, 1750 are disposed at different heights with respect to one another. This will allow the male dovetails 1725, 1750 to engage and slide with the dovetail grooves 1550, 1625 of the dividers 1500, 1600. Although FIG. 17 shows the male dovetails 1725 of corner coupler 1700 to be near the top end of the corner coupler 1700 and that male dovetail 1750 to be near the bottom end of corner coupler 1700, male dovetail 1725 may be disposed at near the bottom end of corner coupler 1700 and male dovetail 1750 may be disposed near the top end of the corner coupler 1700. Or they may be disposed at the same height.

Figure 18:
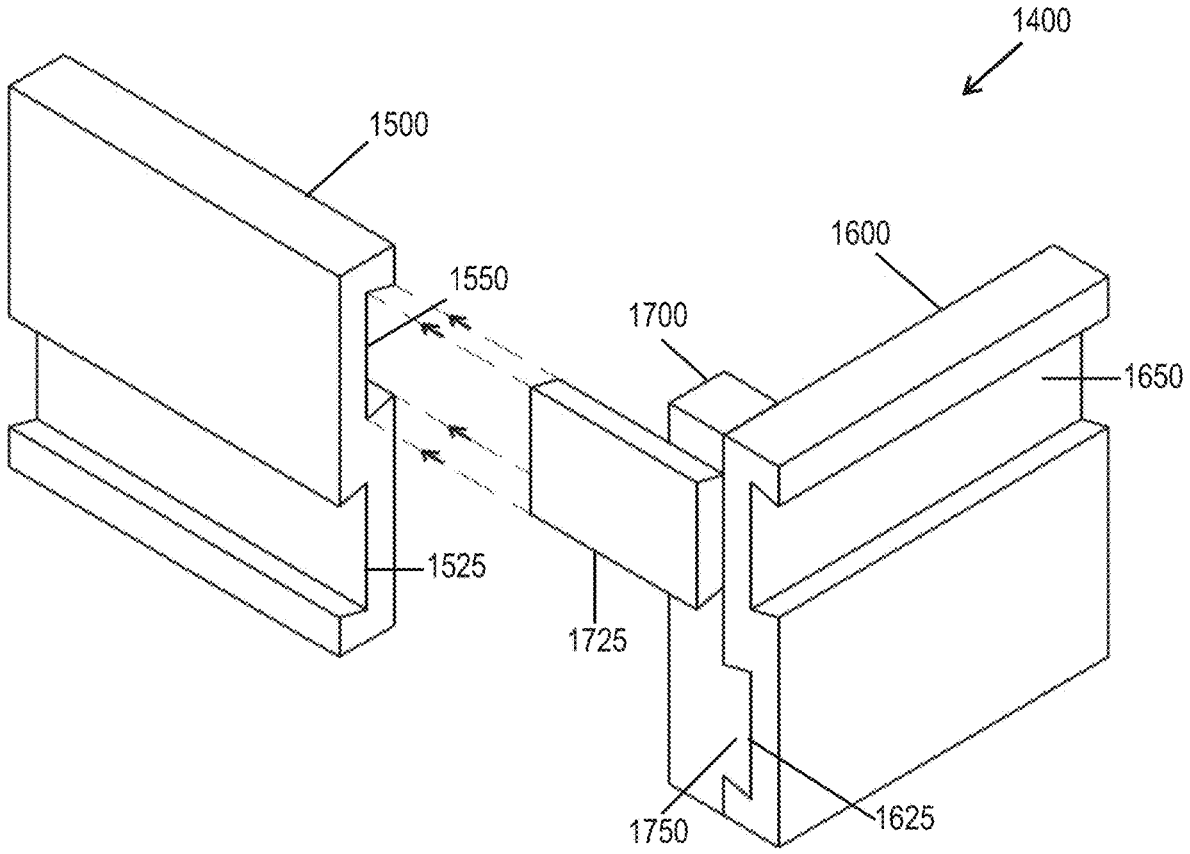
FIG. 18 is another illustration of a front exploded view of another embodiment of the corner assembly, shown in FIG. 17, and shows the second divider engaged with the corner coupler.

FIG. 18 is another illustration of a front exploded view of another embodiment of the corner assembly. As shown in FIG. 18, one embodiment of the corner assembly 1400 may comprise dividers 1500, 1600 and a corner coupler 1700. FIG. 18 shows that dovetail groove 1625 of divider 1600 may be engaged with male dovetail 1750 of corner coupler 1700.

Figure 19:
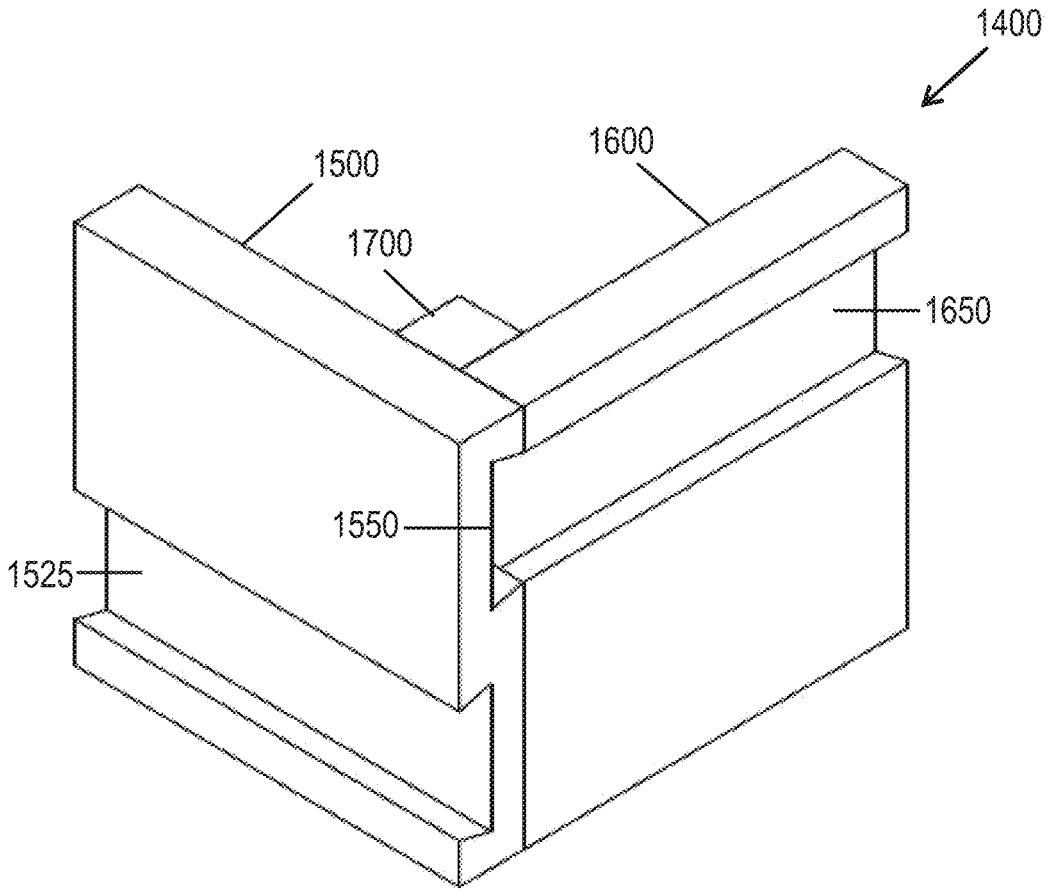
FIG. 19 is another illustration of a front assembled view of another embodiment of the corner assembly, shown in FIG. 17.

FIG. 19 is another illustration of a front assembled view of another embodiment of the corner assembly, shown in FIG. 17. As shown in FIG. 19, one embodiment of the corner assembly 1400 may comprise dividers 1500, 1600 and a corner coupler 1700. FIG. 19 shows that dovetail groove 1550 of divider 1500 may be engaged with male dovetail 1725 of corner coupler 1700 and that dovetail groove 1625 of divider 1600 may be engaged with male dovetail 1625 of corner coupler 1700. FIG. 19 shows that divider 1500 may slide further inwards such that divider 1500 may overlap an end of divider 1600, this may provide strength and support to the assembly 1400.

Figure 20:
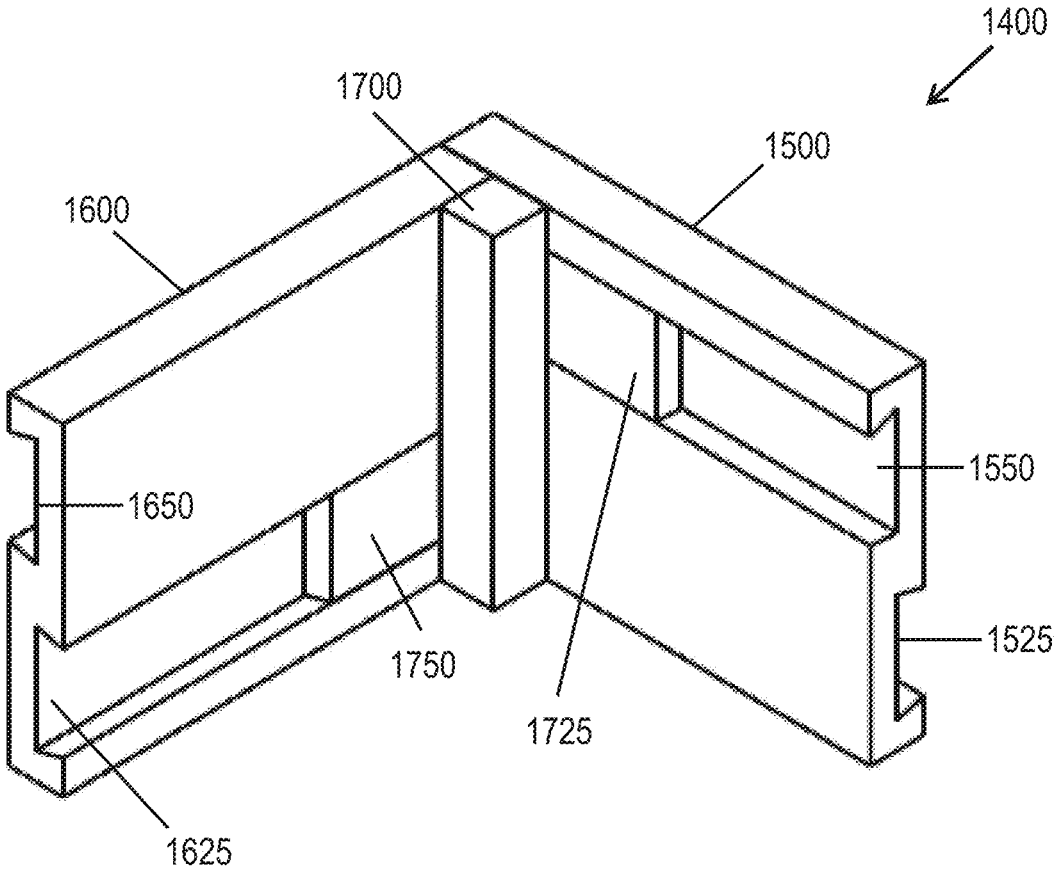
FIG. 20 is another illustration of a rear assembled view of another embodiment of the corner assembly, shown in FIG. 17.

FIG. 20 is another illustration of a rear assembled view of another embodiment of the corner assembly, shown in FIG. 17. As shown in FIG. 20, another embodiment of the corner assembly 1400 may comprise dividers 1500, 1600 and a corner coupler 1700. FIG. 20 shows that male dovetails 1725, 1750 may be engaged with dovetail grooves 1625, 1550.

Figure 21:
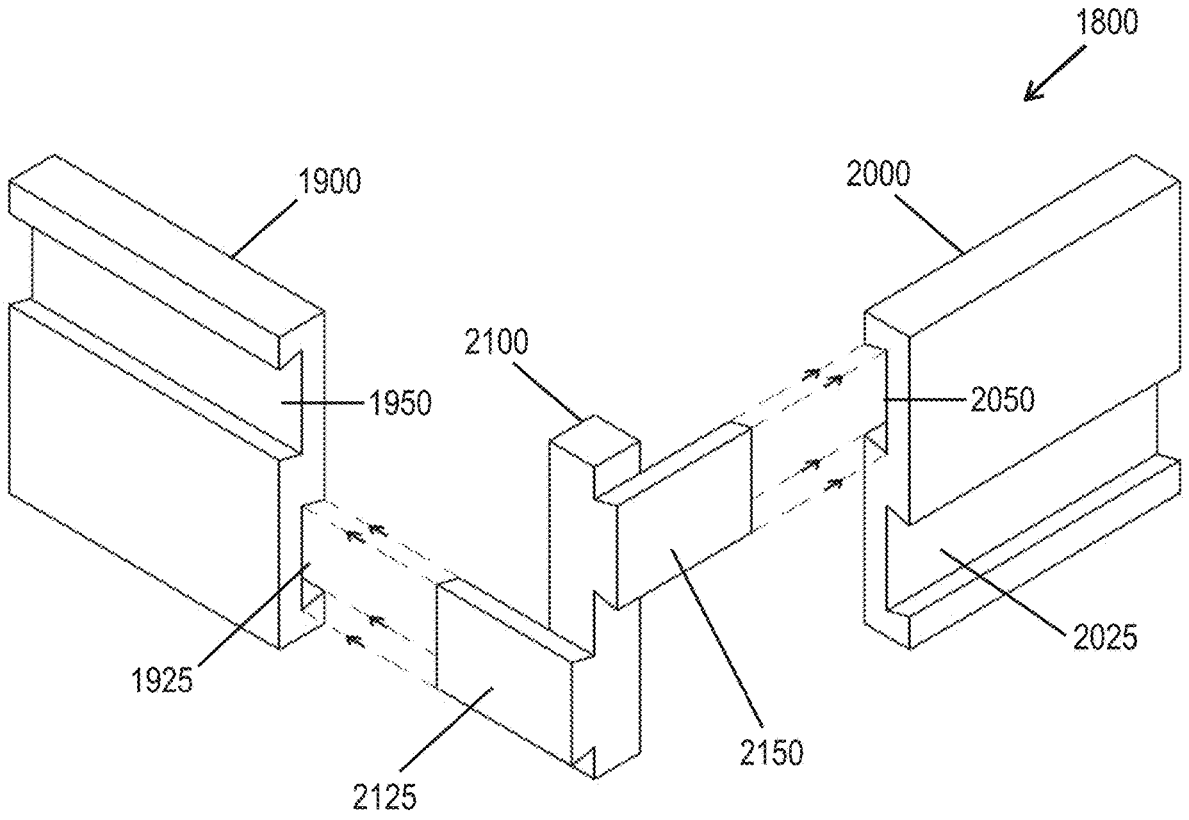
FIG. 21 is an illustration of a front exploded view of another embodiment of the corner assembly with a corner coupler having male dovetails disposed at different heights with a divider engaged with the corner coupler.

FIG. 21 is an illustration of a front exploded view of another embodiment of the corner assembly with a corner coupler having male dovetails disposed at different heights with a divider engaged with the corner coupler. As shown in FIG. 21, another embodiment of the corner assembly 1800 may comprise dividers 1900, 2000 and a corner coupler 2100. FIG. 21 shows that each divider 1900, 2000 may comprise two dovetail grooves 1925, 1950, 2025, 2050, such that each divider 1900, 2000 may also have a two unit of height of measurement. In other embodiments, each divider may have different heights such as a single unit, triple unit, or higher unit of measurement.

FIG. 21 also shows that corner coupler 2100 may comprise male dovetails 2125, 2150. The male dovetails 2125, 2150 may be adapted to engage and slide within the dovetail grooves 1925, 2050 of the dividers 1900, 2000. This will allow the dividers 1900, 2000 to couple with one another at their ends to create a corner assembly 1800 (shown in FIG. 23). In other embodiments, the dividers 1900, 2000 may be adapted to also couple and slide with one another via the corner coupler 2100 to create a T connection as well.

Importantly. FIG. 21 shows that male dovetail 2125 may be disposed near the bottom end of the corner coupler 2100 and that male dovetail 2150 may be disposed near the top end of the corner coupler 2100, such that the male dovetails 2125, 2150 are disposed at different heights with respect to one another. This will allow the male dovetails 2125, 2150 to engage and slide with the dovetail grooves 1925, 2150 of the dividers 1900, 2000. Although FIG. 20 shows the male dovetail 2125 of corner coupler 2100 to be near the bottom end of the corner coupler 2100 and that male dovetail 2150 to be near the top end of corner coupler 2100, male dovetail 2125 may be disposed at near the top end of corner coupler 2100 and male dovetail 2150 may be disposed near the bottom end of the corner coupler 2100.

Figure 22:
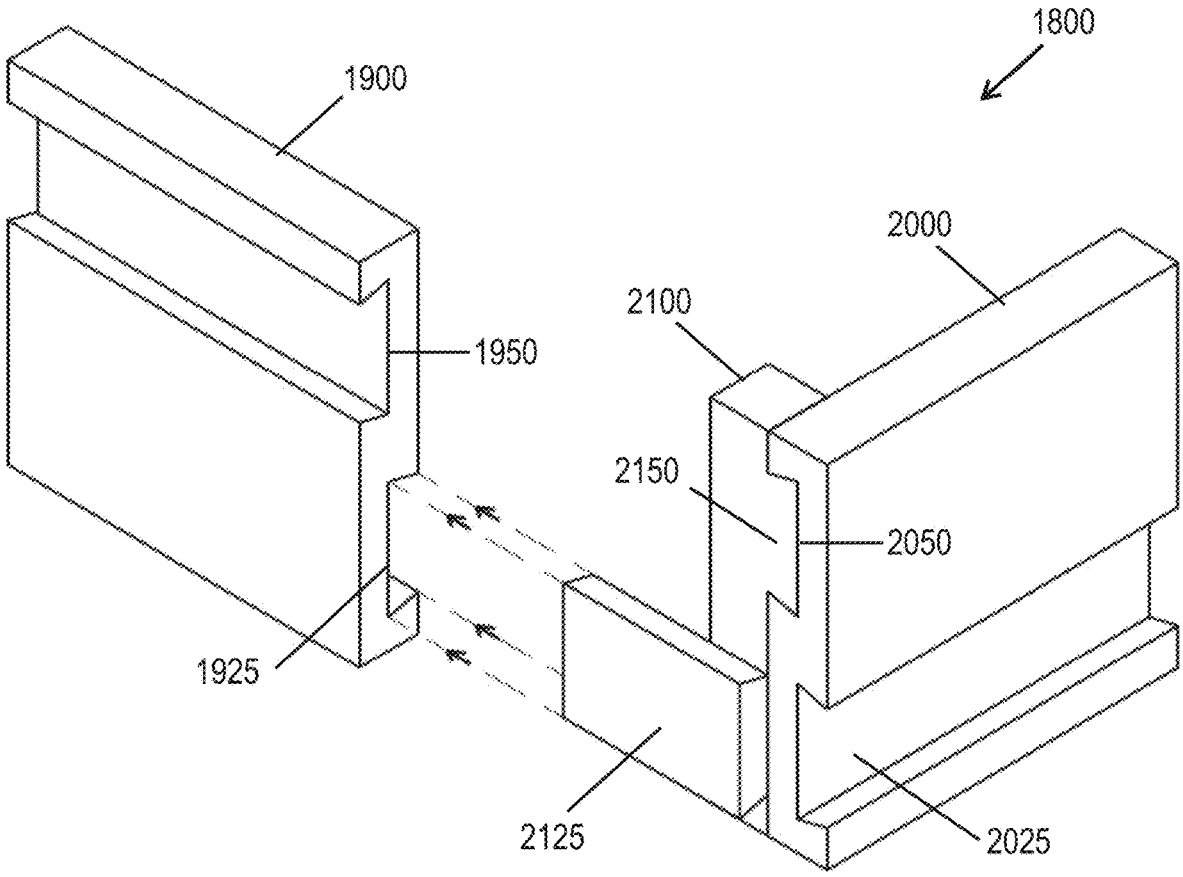
FIG. 22 is another illustration of a front exploded view of another embodiment of the corner assembly, shown in FIG. 21, and shows the second divider engaged with the corner coupler.

FIG. 22 is another illustration of a front exploded view of another embodiment of the corner assembly, shown in FIG. 21, and shows the second divider engaged with the corner coupler. As shown in FIG. 22, another embodiment of the corner assembly 1800 may comprise dividers 1900, 2000 and a corner coupler 2100. FIG. 21 shows that dovetail groove 2050 of divider 2000 may be engaged with male dovetail 2150 of corner coupler 2100.

Figure 23:
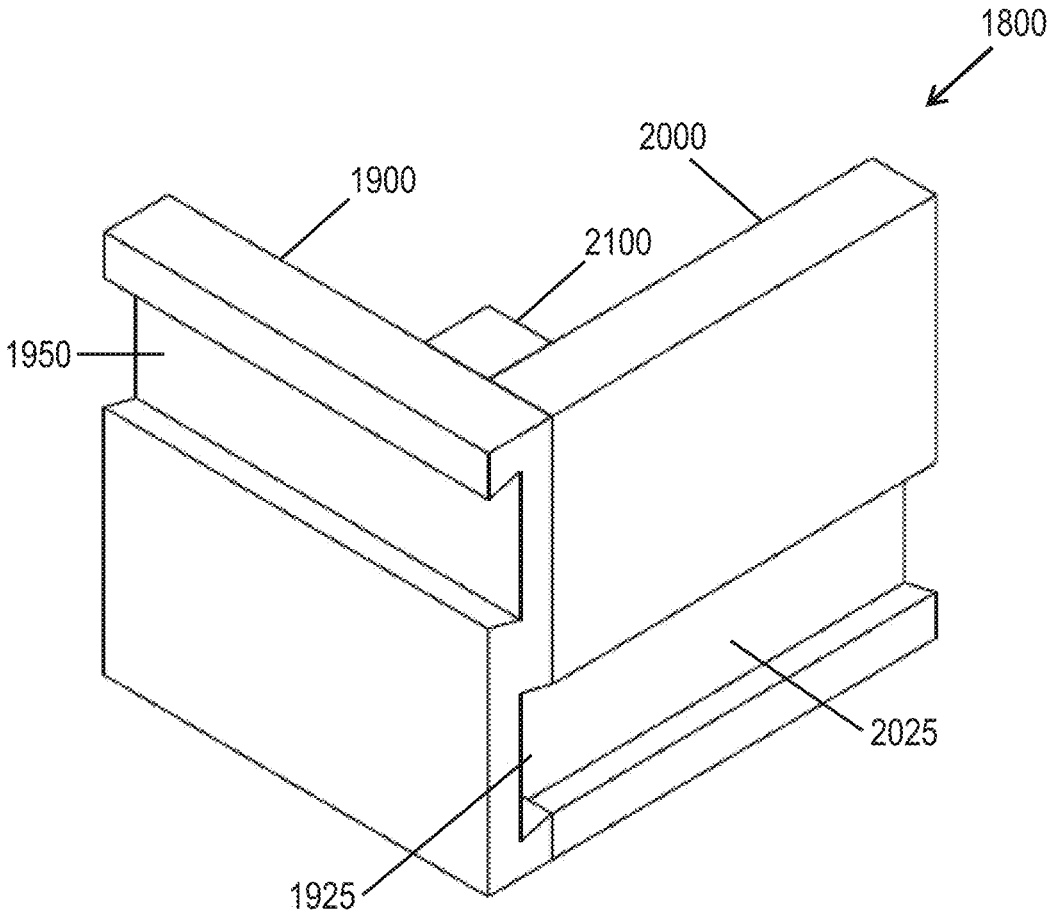
FIG. 23 is another illustration of a front assembled view of another embodiment of the corner assembly, shown in FIG. 21.

FIG. 23 is another illustration of a front assembled view of another embodiment of the corner assembly, shown in FIG. 21. As shown in FIG. 23, another embodiment of the corner assembly 1800 may comprise dividers 1900, 2000 and a corner coupler 2100. FIG. 23 shows that dovetail groove 1925 of divider 1900 may be engaged with male dovetail 2125 of corner coupler 2100 and that dovetail groove 2050 of divider 2000 may be engaged with male dovetail 2150 of corner coupler 2100. Importantly, FIG. 23 shows that divider 1900 may slide further inwards such that divider 1900 may overlap an end of divider 2000.

Figure 24:
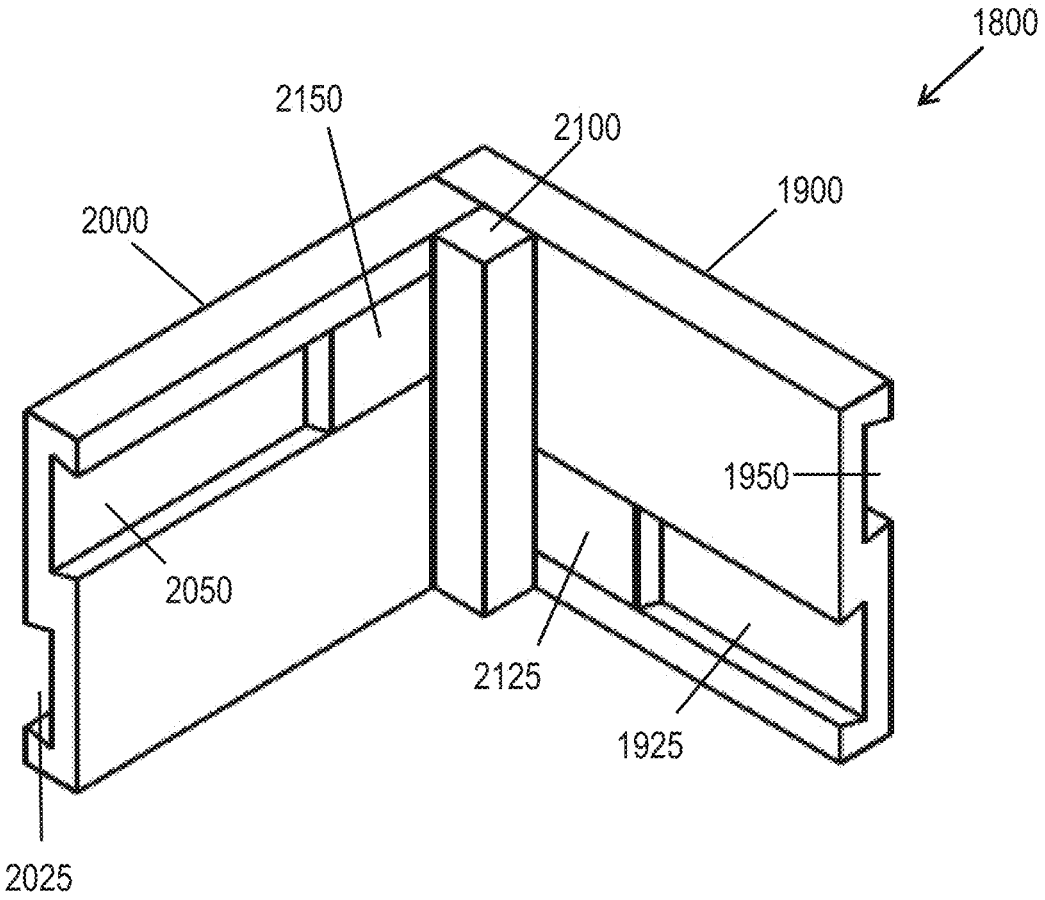
FIG. 24 is another illustration of a rear assembled view of another embodiment of the corner assembly, shown in FIG. 21.

FIG. 24 is another illustration of a rear assembled view of another embodiment of the corner assembly, shown in FIG. 21. As shown in FIG. 24, another embodiment of the corner assembly 1800 may comprise dividers 1900, 2000 and a corner coupler 2100. FIG. 24 shows that male dovetails 2125, 2150 may be engaged with dovetail grooves 1925, 2050.

Figure 25:
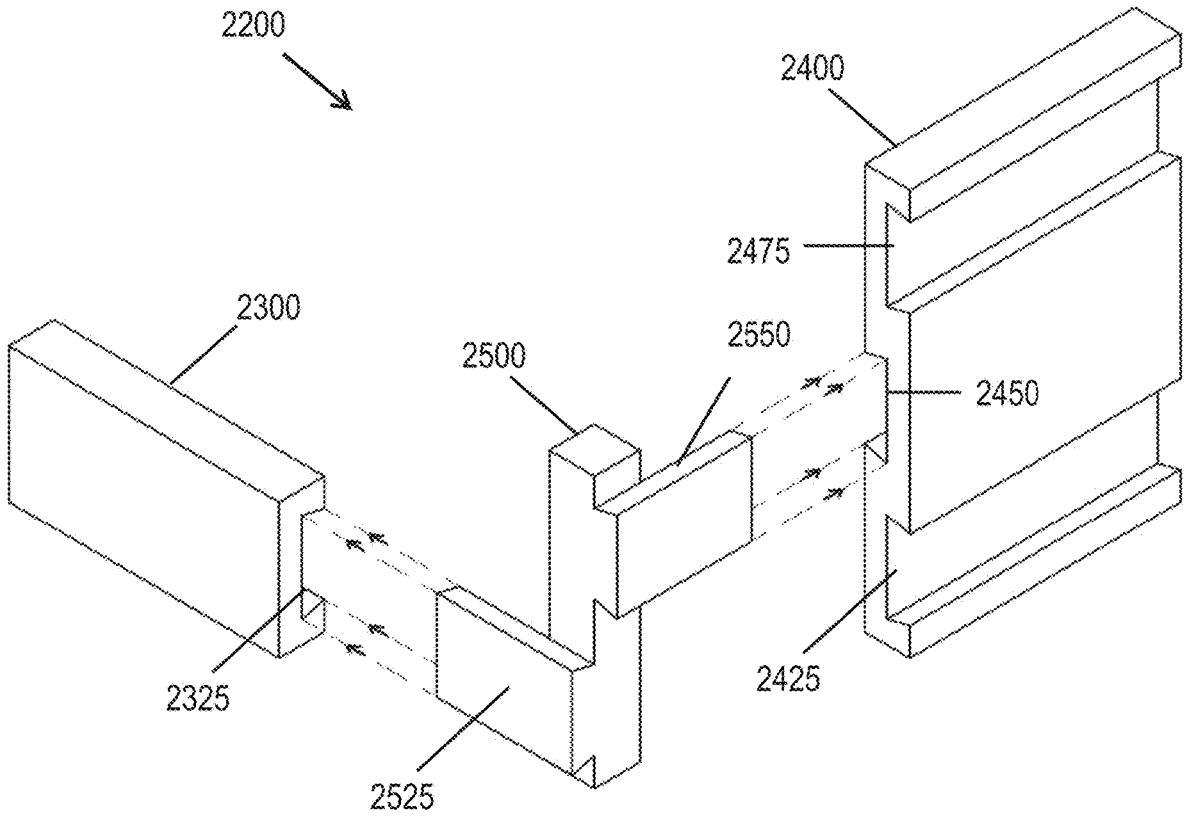
FIG. 25 is an illustration of a front exploded view of another embodiment of a corner assembly with a first divider and second divider having different heights

FIG. 25 is an illustration of a front exploded view of another embodiment of a corner assembly with a first divider and second divider having different heights. As shown in FIG. 25, another embodiment of the corner assembly 2200 may comprise dividers 2300, 2400 and a corner coupler 2500. FIG. 25 shows that divider 2300 may comprise dovetail groove 2325, such that divider 2300 may have a single unit of height of measurement. FIG. 25 also shows that divider 2400 may comprise three dovetail grooves 2425, 2450, 2475, such that divider 2400 may have three units of height of measurement. In other embodiments, each divider may have different heights such as a double unit and quadruple or more units of measurement.

FIG. 25 also shows that corner coupler 2500 may comprise male dovetails 2525, 2550. The male dovetails 2525, 2550 may be adapted to engage and slide within the dovetail grooves 2325, 2450 of dividers 2300, 2400. This will allow the dividers 2300, 2400 to couple with one another at their ends to create a corner assembly 2200. In other embodiments, the dividers 2300, 2400 may be adapted to also couple and slide with one another via the corner coupler 2500 to create a T connection as well.

FIG. 25 also shows that male dovetail 2525 may be disposed near the bottom end of the corner coupler 2500 and that male dovetail 2550 may be disposed near the top end of the corner coupler 2500, such that the male dovetails 2525, 2550 are disposed at different heights with respect to one another. This will allow the male dovetails 2525, 2550 to engage and slide with the dovetail grooves 2325, 2450 of the dividers 2300, 2400. Although FIG. 25 shows the male dovetail 2525 of corner coupler 2500 to be near the bottom end of the corner coupler 2500 and that male dovetail 2550 to be near the top end of corner coupler 2500, male dovetail 2525 may be disposed at near the top end of corner coupler 2500 and male dovetail 2550 may be disposed near the bottom end of the corner coupler 2500.

Figure 26:
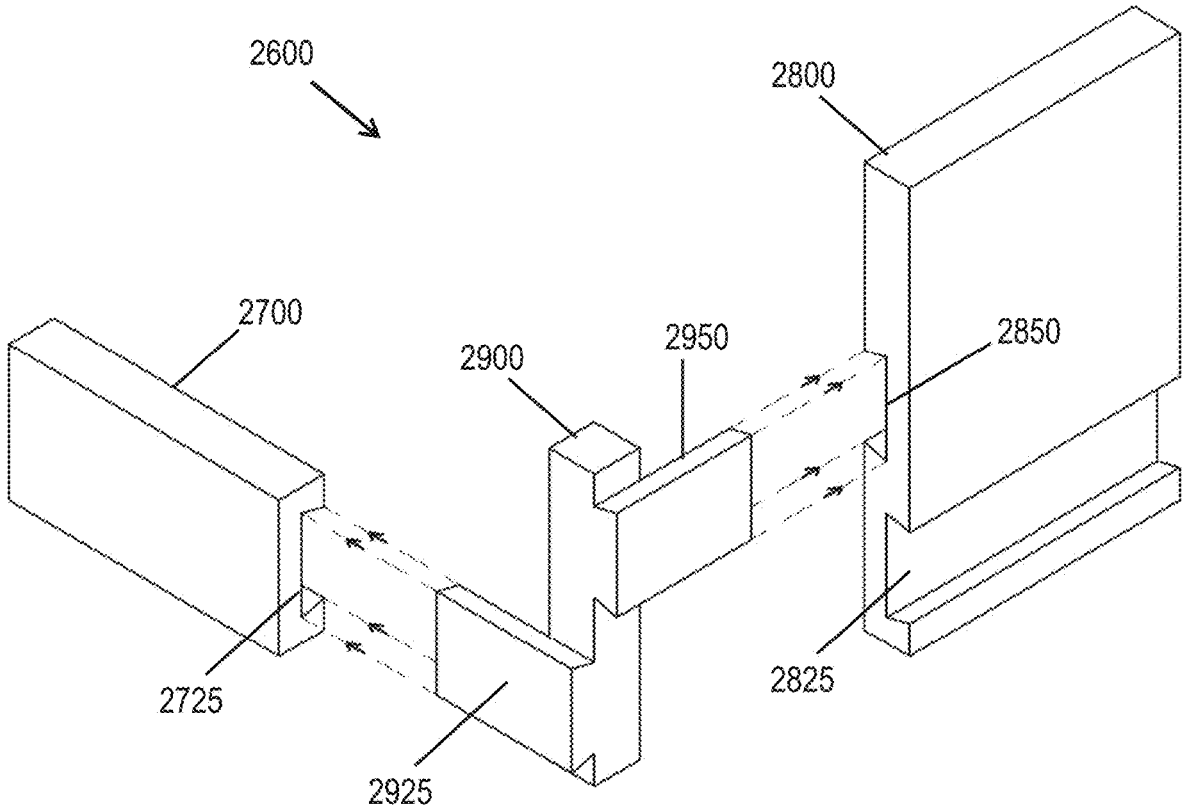
FIG. 26 is an illustration of a front exploded view of another embodiment of a corner assembly with a first divider and second divider having different heights.

FIG. 26 is an illustration of a front exploded view of another embodiment of a corner assembly with a first divider and second divider having different heights. As shown in FIG. 26, another embodiment of the corner assembly 2600 may comprise dividers 2700, 2800 and a corner coupler 2900. FIG. 26 shows that divider 2700 may comprise dovetail groove 2725, such that divider 2700 may have a single unit of height of measurement. FIG. 26 also shows that divider 2800 may comprise two dovetail grooves 2825, 2850. Although FIG. 26 shows that divider 2800 may comprise two dovetail grooves 2825, 2850, divider 2800 may be a triple unit of height of measurement. In other embodiments, each divider may have different heights such as a double unit and quadruple or more units of measurement.

FIG. 26 also shows that corner coupler 2900 may comprise male dovetails 2925, 2950. The male dovetails 2925, 2950 may be adapted to engage and slide within the dovetail grooves 2725, 2850 of dividers 2700, 2800. This will allow the dividers 2700, 2800 to couple with one another at their ends to create a corner assembly 2600. In other embodiments, the dividers 2700, 2800 may be adapted to also couple and slide with one another via the corner coupler 2900 to create a T connection as well.

FIG. 26 also shows that male dovetail 2925 may be disposed near the bottom end of the corner coupler 2900 and that male dovetail 2950 may be disposed near the top end of the corner coupler 2900, such that the male dovetails 2925, 2950 are disposed at different heights with respect to one another. This will allow the male dovetails 2925, 2950 to engage and slide with the dovetail grooves 2725, 2850 of the dividers 2700, 2800. Although FIG. 26 shows the male dovetail 2925 of corner coupler 2900 to be near the bottom end of the corner coupler 2900 and that male dovetail 2950 to be near the top end of corner coupler 2900, male dovetail 2925 may be disposed near the top end of corner coupler 2900 and male dovetail 2950 may be disposed near the bottom end of the corner coupler 2900.

Figure 27:
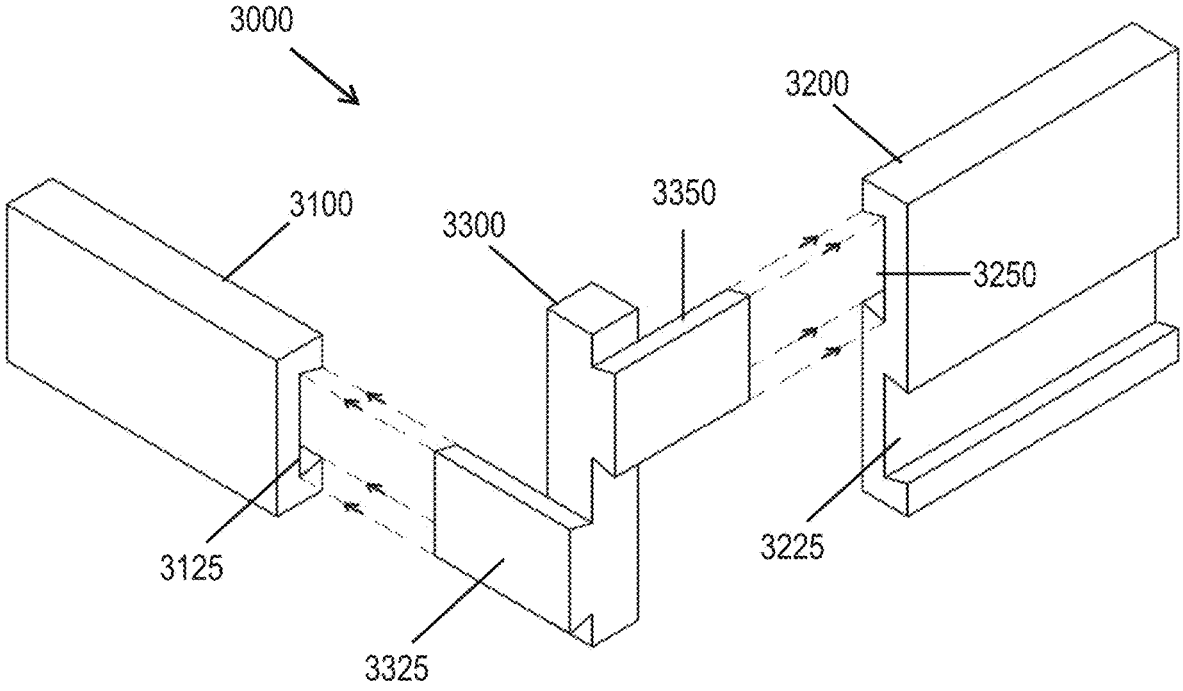
FIG. 27 is an illustration of a front exploded view of another embodiment of a corner assembly with a first divider and second divider having different heights.

FIG. 27 is an illustration of a front exploded view of another embodiment of a corner assembly with a first divider and second divider having different heights. As shown in FIG. 27, another embodiment of the corner assembly 3000 may comprise dividers 3100, 3200 and a corner coupler 3300. FIG. 27 shows that divider 3100 may comprise dovetail groove 3125, such that divider 3100 may have a single unit of height of measurement. FIG. 27 also shows that divider 3200 may comprise two dovetail grooves 3225, 3250, such that divider 3200 may be a double unit of height of measurement. In other embodiments, each divider may have different heights such as a triple unit and quadruple or more units of measurement.

FIG. 27 also shows that corner coupler 3300 may comprise male dovetails 3325, 3350. The male dovetails 3325, 3350 may be adapted to engage and slide within the dovetail grooves 3125, 3250 of dividers 3100, 3200. This will allow the dividers 3100, 3200 to couple with one another at their ends to create a corner assembly 3000. In other embodiments, the dividers 3100, 3200 may be adapted to also couple and slide with one another via the corner coupler 3300 to create a T connection as well.

FIG. 27 also shows that male dovetail 3325 may be disposed near the bottom end of the corner coupler 3300 and that male dovetail 3350 may be disposed near the top end of the corner coupler 3300, such that the male dovetails 3325, 3350 are disposed at different heights with respect to one another. This will allow the male dovetails 3325, 3350 to engage and slide with the dovetail grooves 3125, 3250 of the dividers 3100, 3200. Although FIG. 27 shows the male dovetail 3325 of corner coupler 3300 to be near the bottom end of the corner coupler 3300 and that male dovetail 3350 to be near the top end of corner coupler 3300, male dovetail 3325 may be disposed at near the top end of corner coupler 3300 and male dovetail 3350 may be disposed near the bottom end of the corner coupler 3300.

Figure 28:
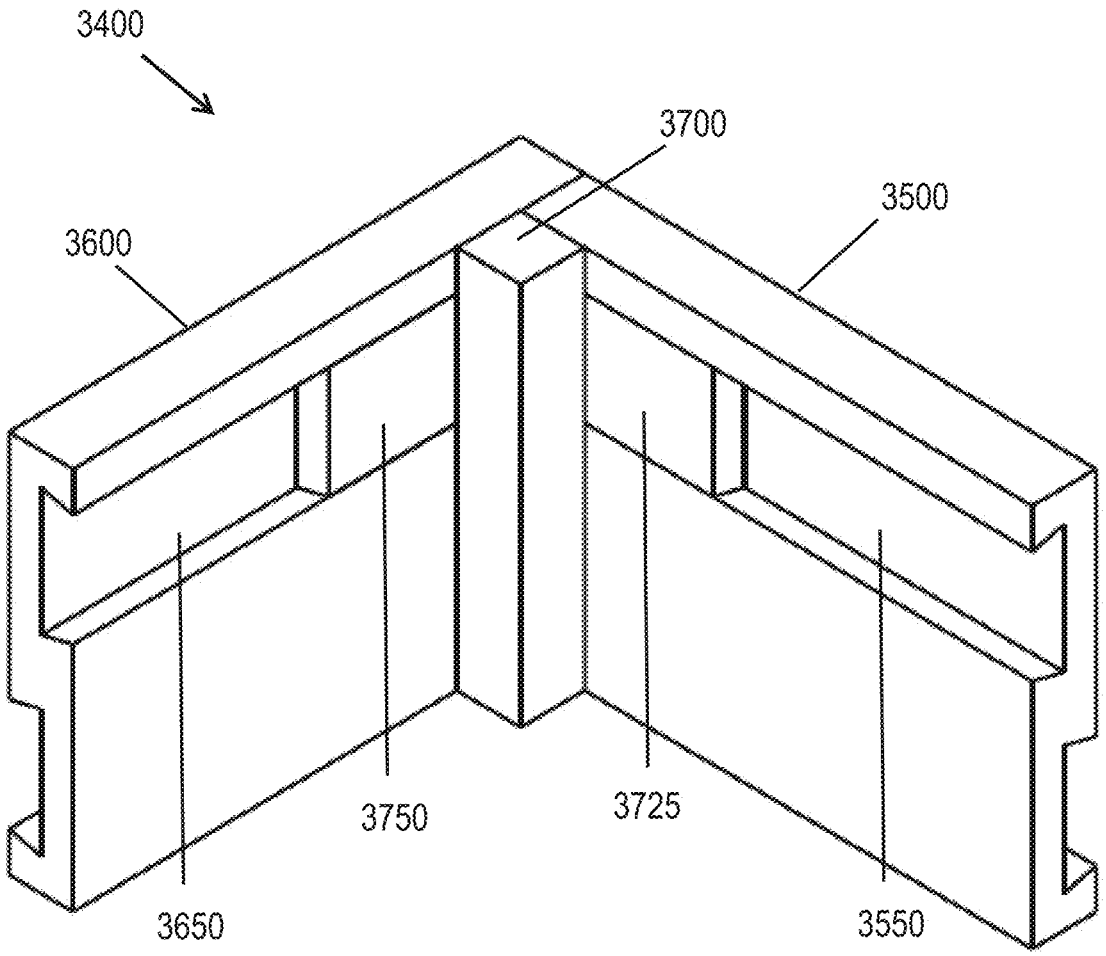
FIG. 28 is an illustration of a rear assembled view of one embodiment of the corner assembly.

FIG. 28 is an illustration of a rear assembled view of another embodiment of the corner assembly. As shown in FIG. 28, another embodiment of the corner assembly 3400 may comprise dividers 3500, 3600 and a corner coupler 3700. FIG. 28 shows that male dovetails 3750, 3725 may be engaged with dovetail grooves 3650, 3550.

The dividers shown in FIGS. 14 through 28 show various embodiments or examples of how the dovetail grooves may be arranged. By alternating the dovetail grooves in standardized increments on either side of a given divider, the flexibility of the dividers is clear.

Figure 29:
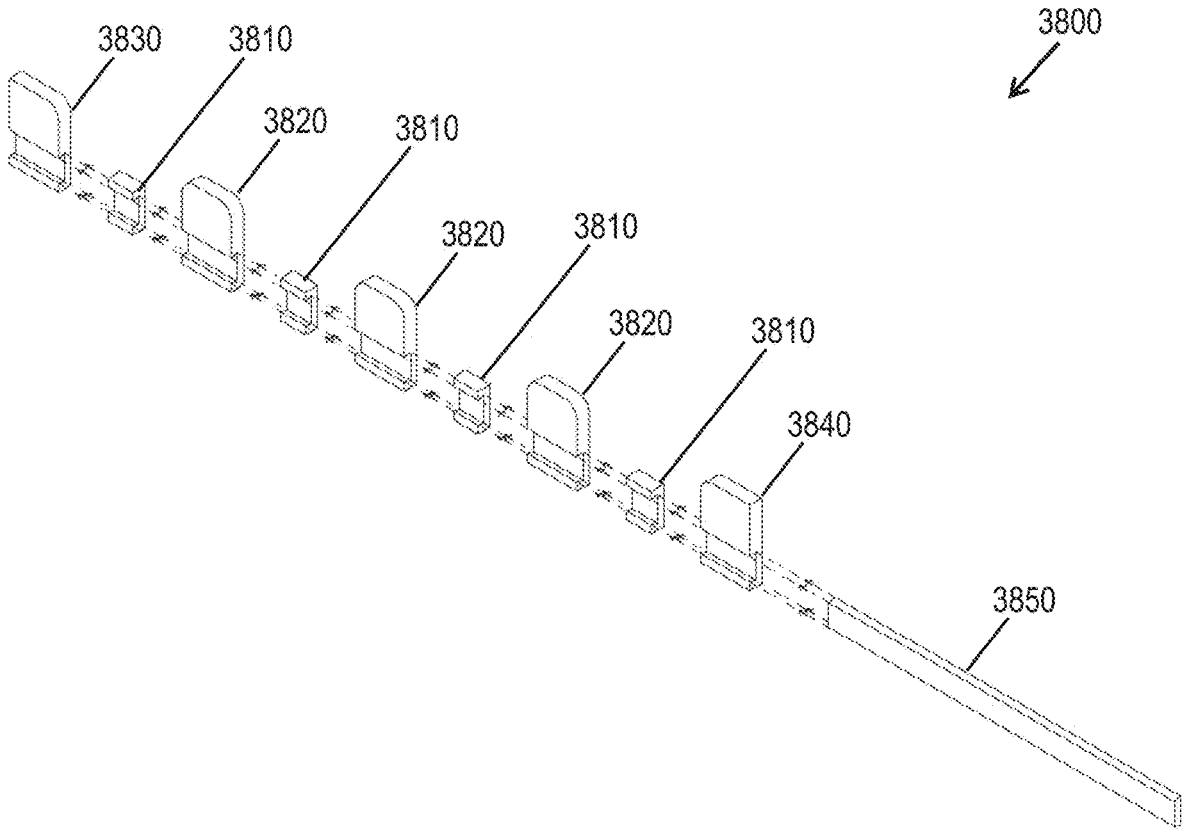
FIG. 29 is an illustration of an exploded view of one embodiment of the accessory holder assembly.

FIG. 29 is an illustration of an exploded view of one embodiment of the accessory holder assembly. As shown in FIG. 29, one embodiment of the accessory holder assembly 3800 may comprise small support pieces 3810, large support pieces 3820, 3830, 3840, and a male dovetail 3850. FIG. 29 shows that the small support pieces 3810 may have a height that is shorter than the height of the large support pieces 3820, 3830, 3840 and that the small support pieces 3810 and large support pieces 3820, 3830, 3840 may each have a dovetail groove. This may allow the small support pieces 3810 and large support pieces 3820, 3830, 3840 to align and/or couple with one another via the male dovetail 3850, which may intersect the dovetail grooves of both the small support pieces 3810 and large support pieces 3820, 3830, 3840. This may allow the large support pieces 3820, 3830, 3840 and small support pieces 3810 to form one or more receiving spaces to fit for a flexible collection of a variety of accessories. Importantly, in various embodiments, the accessory holder assembly 3800, once assembled, may also function as a divider, such that the accessory holder assembly 3800 may also be adapted to engage and securely fit one or more divider support grooves of the compartment divider assembly.

Figure 30:
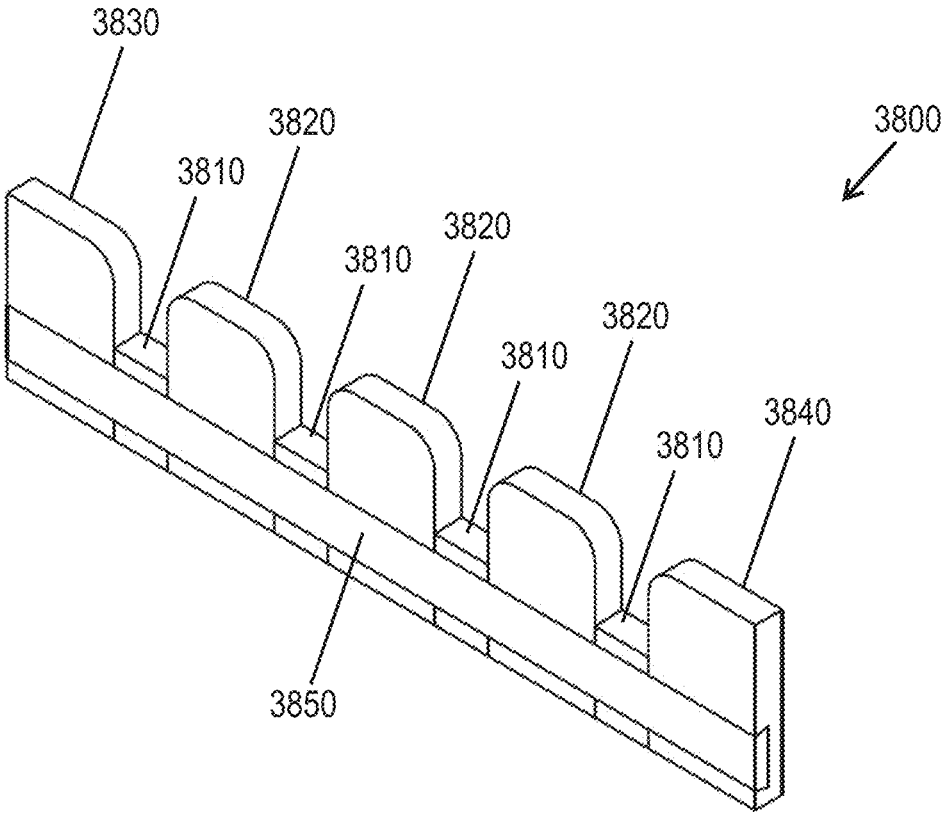
FIG. 30 is an illustration of an assembled view of one embodiment of the accessory holder assembly.

FIG. 30 is an illustration of an assembled view of one embodiment of the accessory holder assembly. As shown in FIG. 30, one embodiment of the accessory holder assembly 3800 may comprise a plurality of small support pieces 3810, a plurality of large support pieces 3820, 3830, 3840, and a male dovetail 3850. FIG. 30 shows how the small support pieces 3810 and large support pieces 3820, 3830, 3840 form a plurality of receiving spaces adapted to fit a variety of accessories such as tools or utensils. The accessory holder assembly 3800 may also function as a divider, which may engage and securely fit one or more divider support grooves of the compartment divider assembly.

Figure 31:
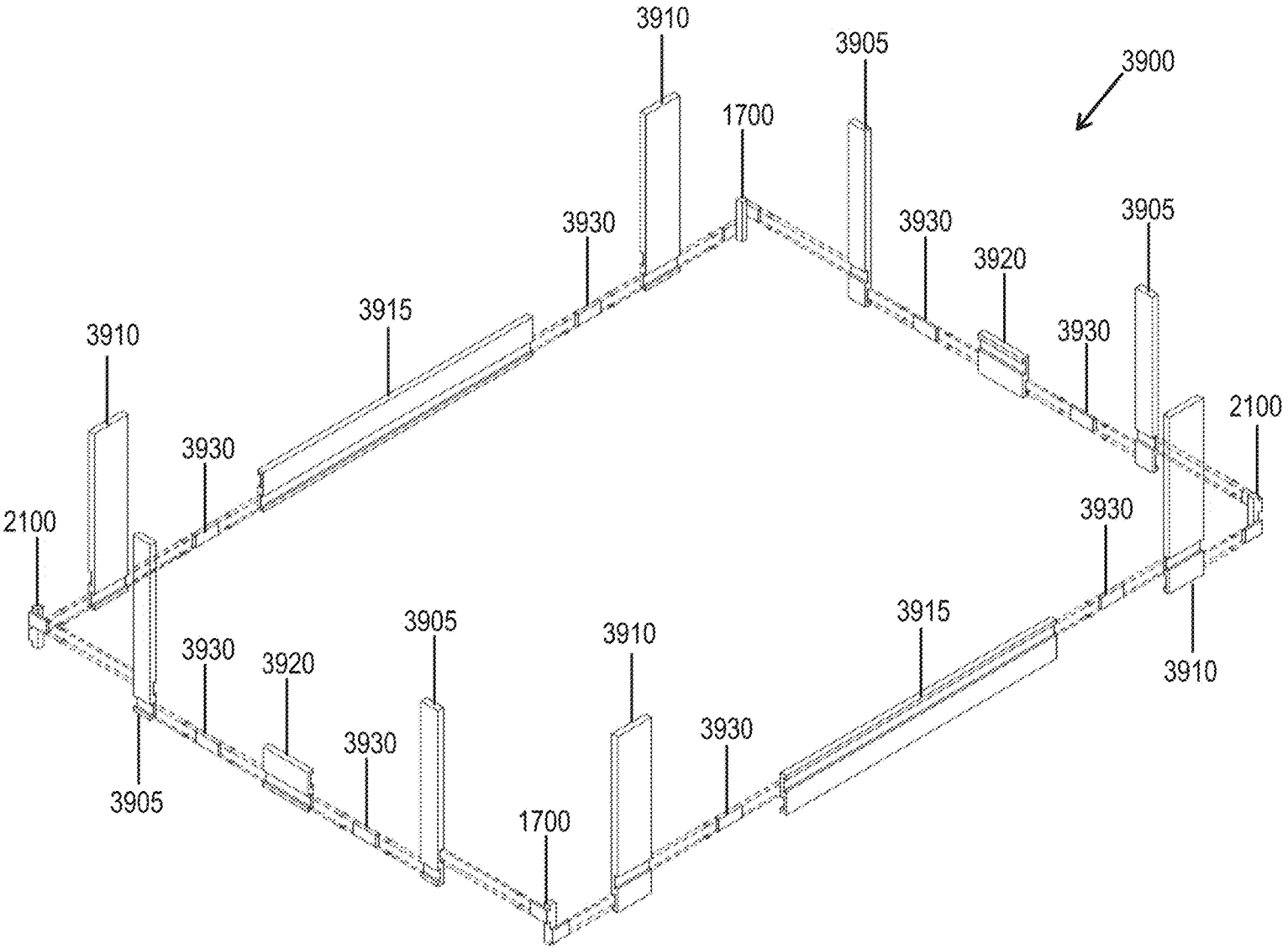
FIG. 31 is an illustration of an exploded view of one embodiment of a compartment divider assembly.

FIG. 31 is an illustration of an exploded view of one embodiment of a compartment divider assembly. As shown in FIG. 31, one embodiment of a compartment divider assembly 3900 may comprise: dividers 3915, 3920, couplers 3930, corner couplers 1700, 2100, and vertical support dividers 3905, 3910. The dividers 3915, 3920, couplers 3930, corner couplers 1700, 2100, and vertical support dividers 3905, 3910 may be coupled together to form a substantially rectangular carton kit holder (shown assembled in FIG. 32), which may be used to hold various elongated packages such as cartons of aluminum foil wax paper, plastic wraps, and the like, all of which may be used to stack neatly within a drawer compartment. The couplers 3930, 1700, 2100 are preferably male dovetail devices that fit into dovetailed grooves of the dividers 3915, 3920, 3905, 3910. In this manner they easily slide together or apart, but are substantially prevented from being pulled apart perpendicularly to the sliding direction.

Figure 32:
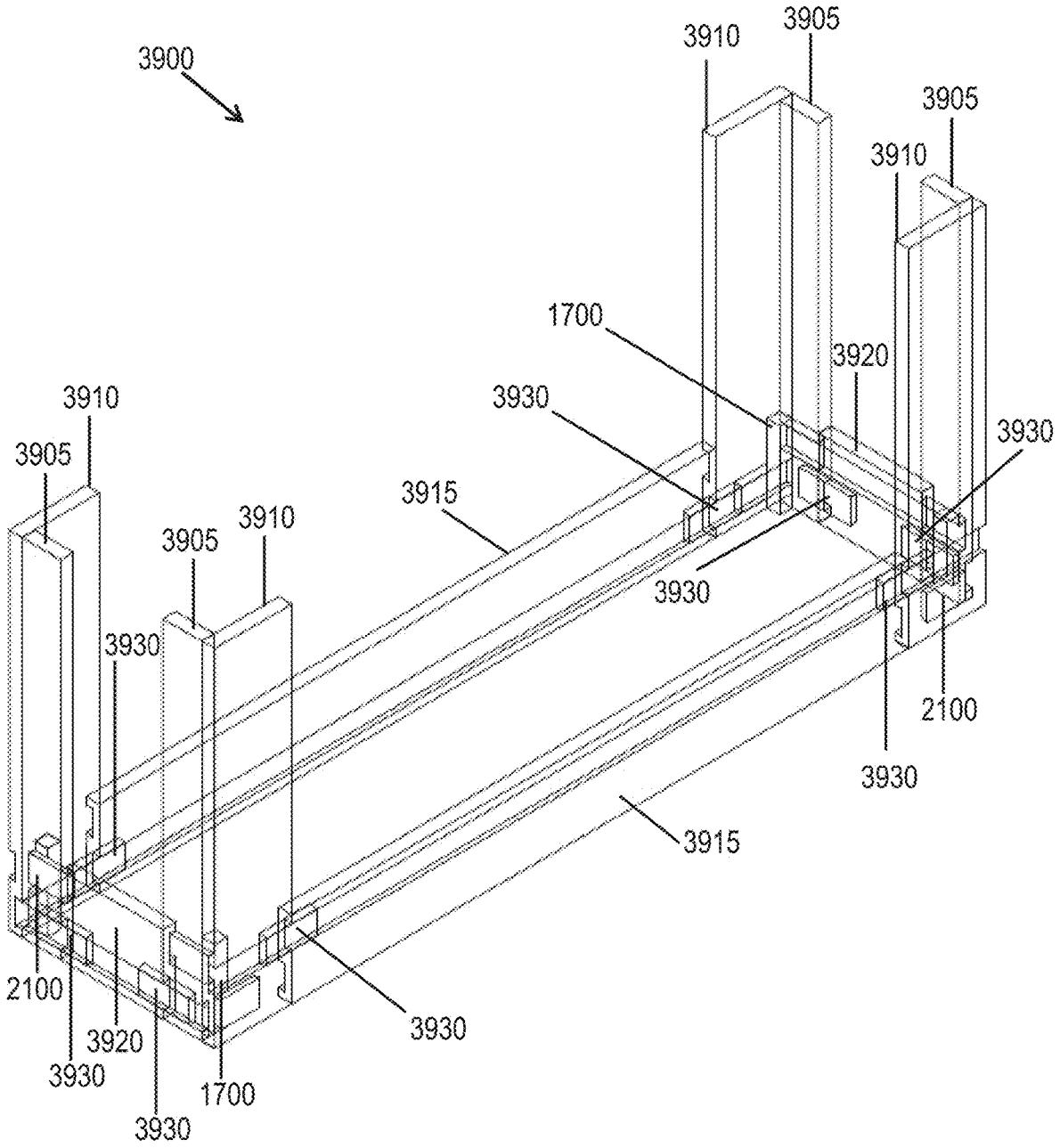
FIG. 32 is an illustration of an assembled view of one embodiment of a compartment divider assembly.

FIG. 32 is an illustration of an assembled view of one embodiment of a compartment divider assembly. As shown in FIG. 32, one embodiment of a compartment divider assembly 3900 may comprise: dividers 3915, 3920, couplers 3930, corner couplers 1700, 2100, and vertical support dividers 3905, 3910.

FIG. 32 shows how the dividers with reciprocal dovetail grooves interconnect with one another. FIG. 32 also shows how the dividers 3915, 3920 of various lengths and heights may be interconnected in numerous different ways. The divider support groove assemblies may also be used to couple to the dovetail grooves of the dividers 3915, 3920 to create additional sub-compartments within the compartment divider assembly.

Figure 33:
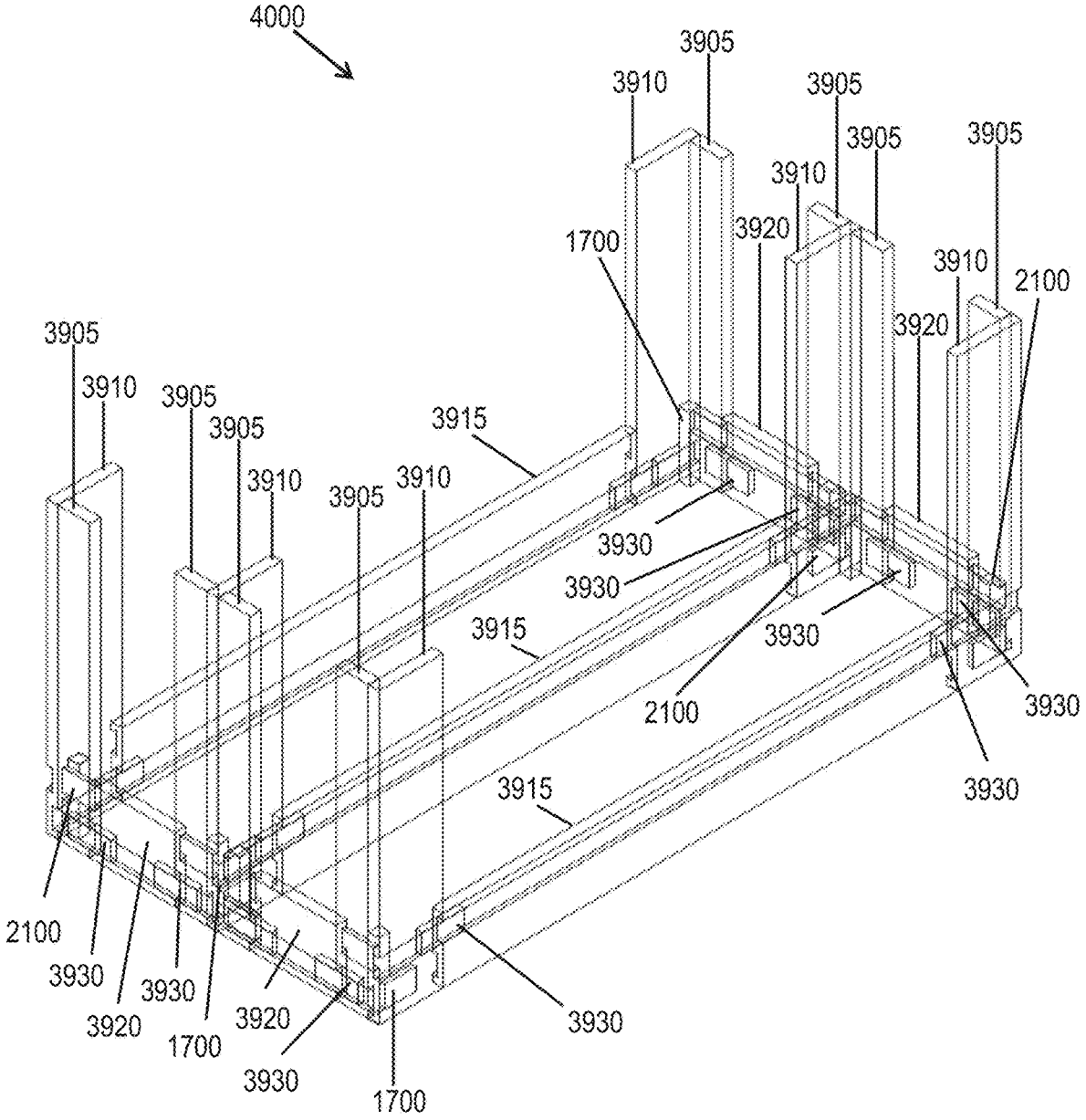
FIG. 33 is an illustration of an assembled view of another embodiment of a compartment divider assembly.

FIG. 33 is an illustration of an assembled view of another embodiment of a compartment divider assembly. As shown in FIG. 33, another embodiment of a compartment divider assembly 4000 may comprise: dividers 3915, 3920, couplers 3930, corner couplers 1700, 2100, and vertical support dividers 3905, 3910. Importantly, FIG. 33 shows how the a compartment divider assembly 4000 may include additional dividers 3915, 3920, couplers 3930, corner couplers 1700, 2100 to create a carton kit holder with a single add-on kit that holds additional elongated commodities packages. Although FIG. 33 shows a compartment divider assembly 4000 with a single add-on kit, several additional add-on kits may be added.

Figure 34:
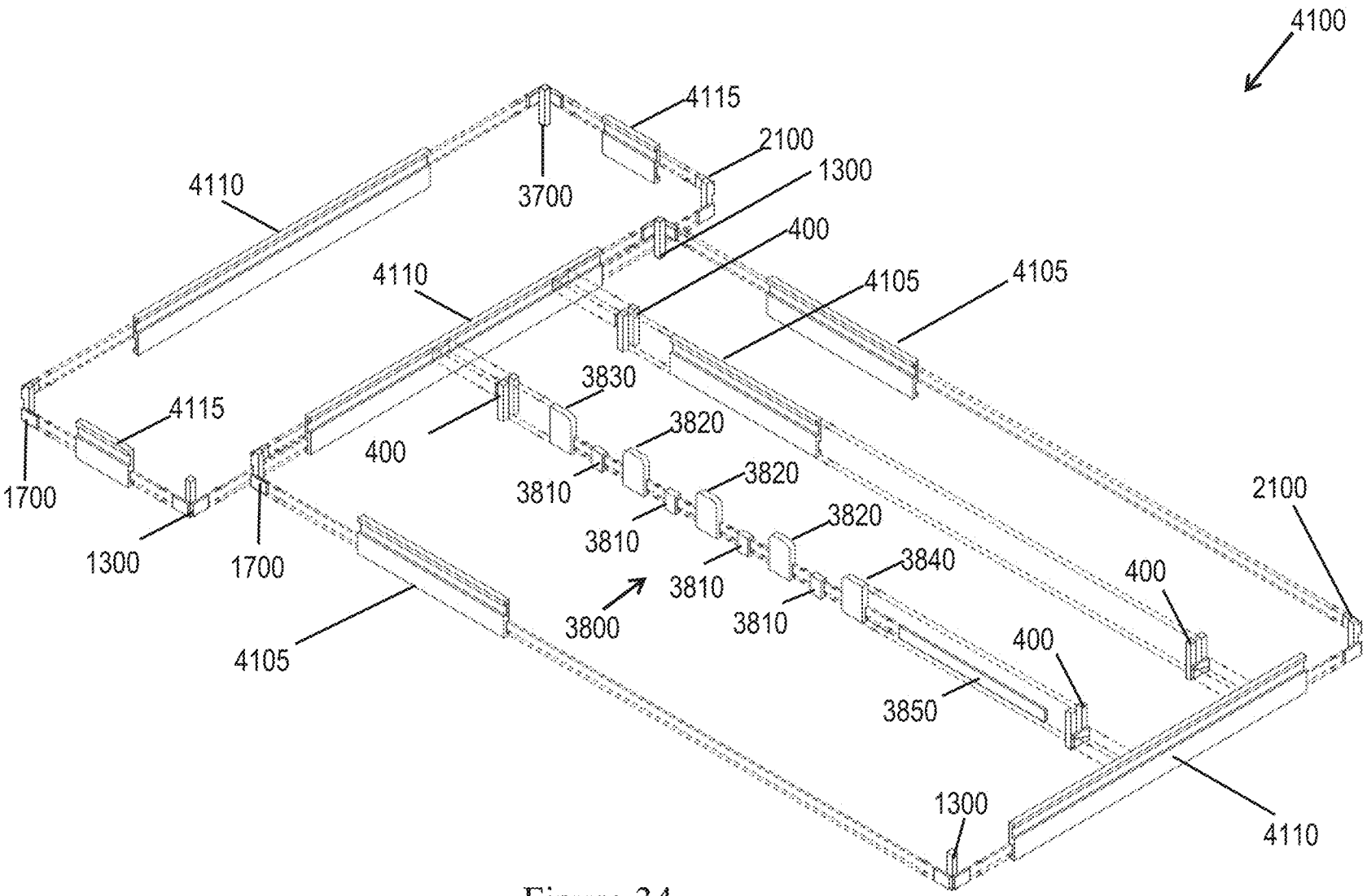
FIG. 34 is an illustration of an exploded view of one embodiment of a compartment divider assembly with an accessory holder assembly.

FIG. 34 is an illustration of an exploded view of one embodiment of a compartment divider assembly with an accessory holder assembly. As shown in FIG. 34, another embodiment of a compartment divider assembly 4100 with an accessory holder assembly 3800 may comprise: dividers 4105, 4110, 4115 corner couplers 1700, 2100, 1300 and divider support groove assemblies 400. FIG. 34 shows that the divider support groove assemblies 400 may be adapted to hold and secure the divider 4105 and accessory holder assembly 3800, which may be used to releasably hold and stack accessories such as tools and/or utensils.

Figure 35:
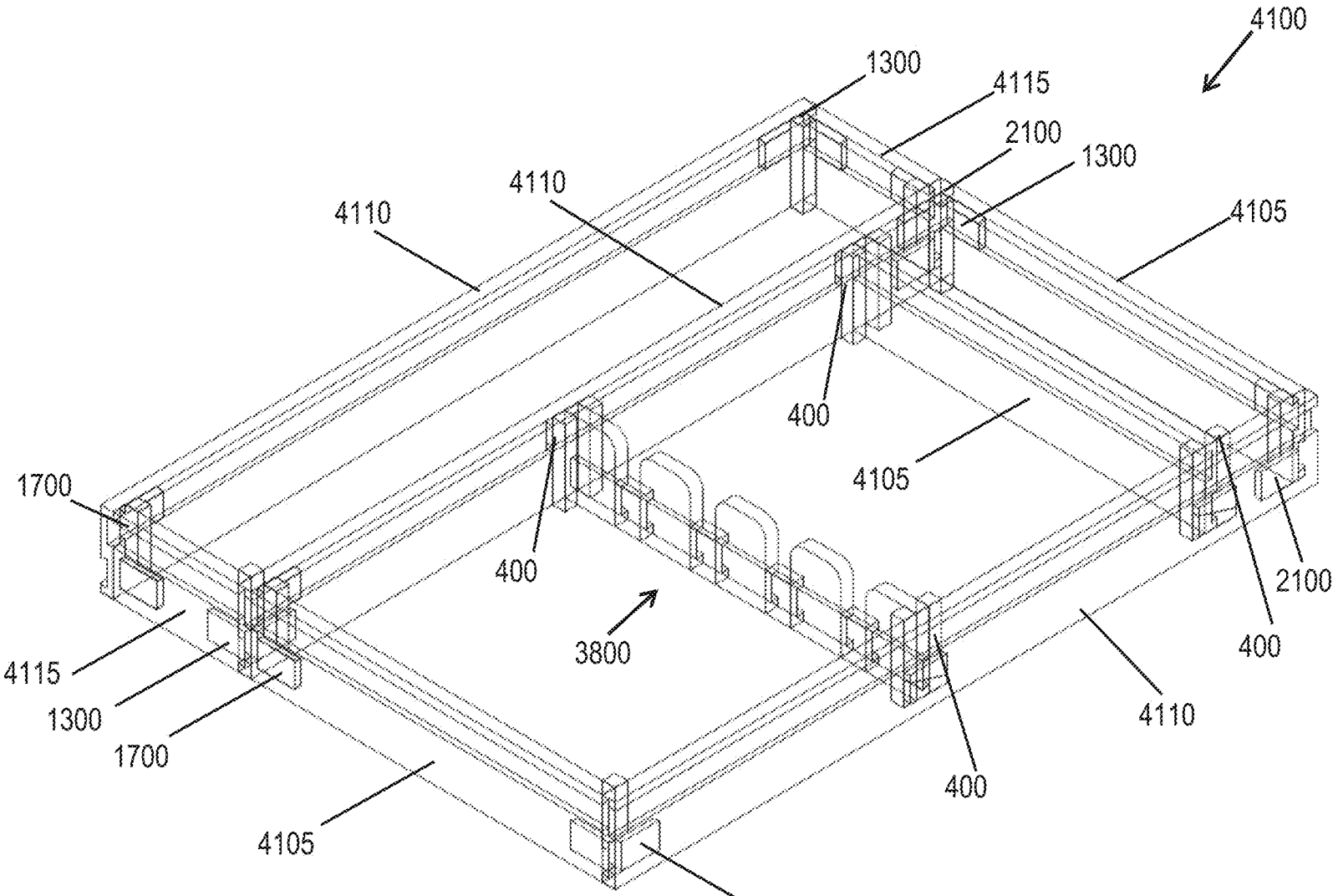
FIG. 35 is an illustration of an assembled view of one embodiment of a compartment divider assembly with an accessory holder assembly.

FIG. 35 is an illustration of an assembled view of one embodiment of a compartment divider assembly with an accessory holder assembly. As shown in FIG. 34, another embodiment of a compartment divider assembly 4100 with an accessory holder assembly 3800 may comprise: dividers 4105, 4110, 4115 corner couplers 1700, 2100, 1300 and divider support groove assemblies 400. FIG. 35 shows how the divider support groove assemblies 400 hold and secure the divider 4105 and accessory holder assembly 3800.

Figure 36:
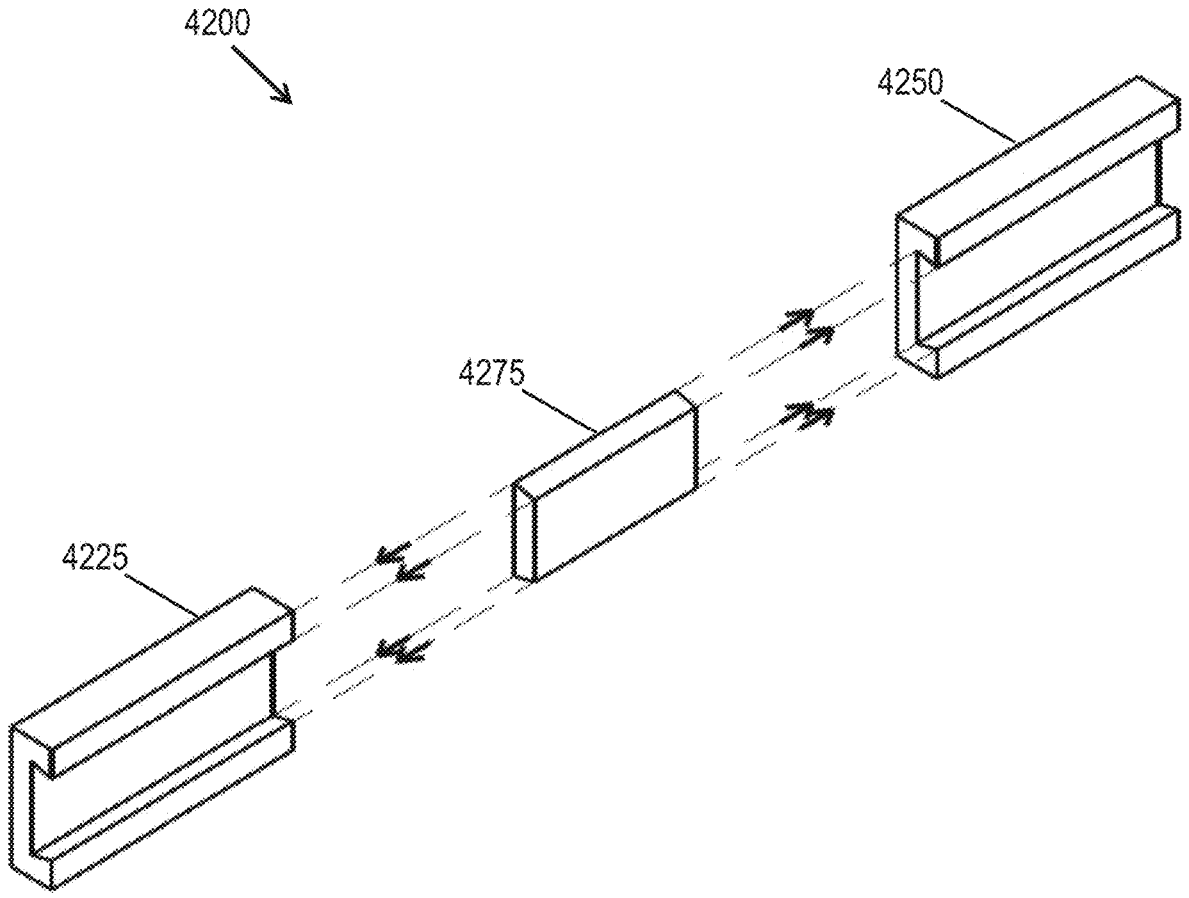
FIG. 36 is an illustration of an exploded view of another embodiment of a compartment divider assembly.

FIG. 36 is an illustration of an exploded view of another embodiment of a compartment divider assembly. As shown in FIG. 36, another embodiment of a compartment divider assembly 4200 may comprise: dividers 4225, 4250 and a coupler 4275. FIG. 36 shows that each of the dividers 4225, 4250 may comprise a dovetail groove with a single unit of height of measurement. FIG. 36 also shows that the dividers 4225, 4250 may couple with one another via coupler 4275. This may allow the dividers 4225, 4250 to align and/or couple with one another via the coupler 4275, which may intersect the dovetail grooves of both dividers 4225, 4250.

Figure 37:
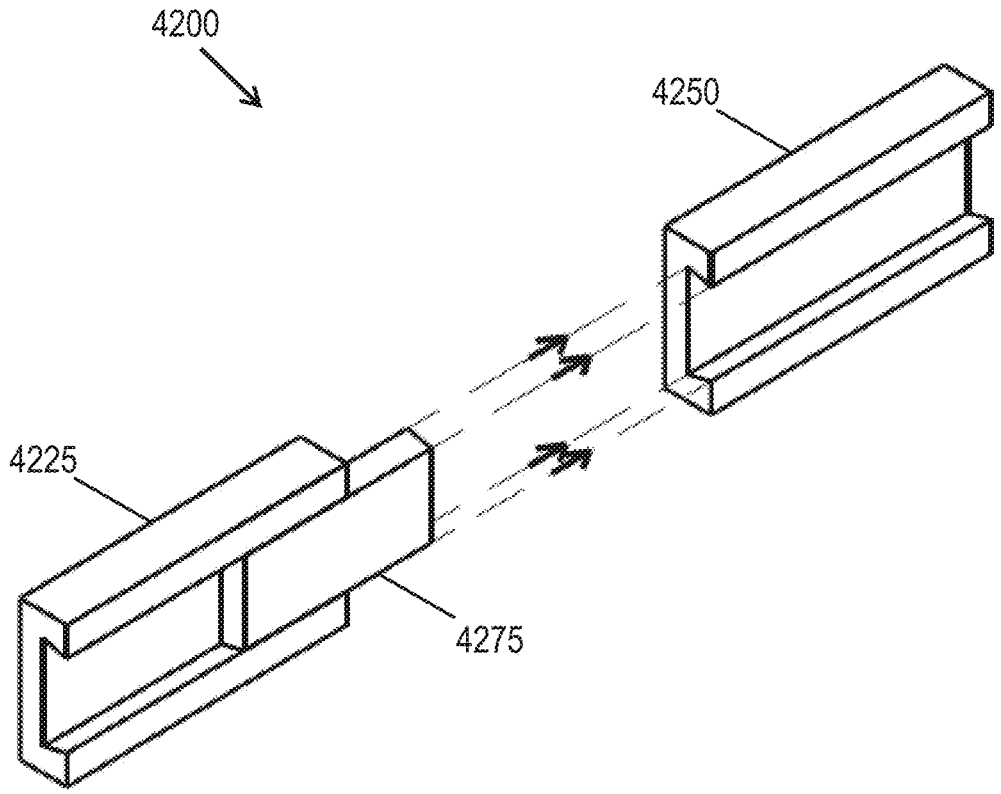
FIG. 37 is an illustration of a partial, assembled view of another embodiment of the compartment divider assembly.

FIG. 37 is an illustration of a partial, assembled view of another embodiment of the compartment divider assembly. As shown in FIG. 37, another embodiment of a compartment divider assembly 4200 may comprise: dividers 4225, 4250 and a coupler 4275. FIG. 37 shows that a first end portion of the coupler 4275 may be coupled to the dovetail groove of divider 4225. The second end portion of the coupler 4275 may be adapted to couple to the dovetail groove of divider 4250.

Figure 38:
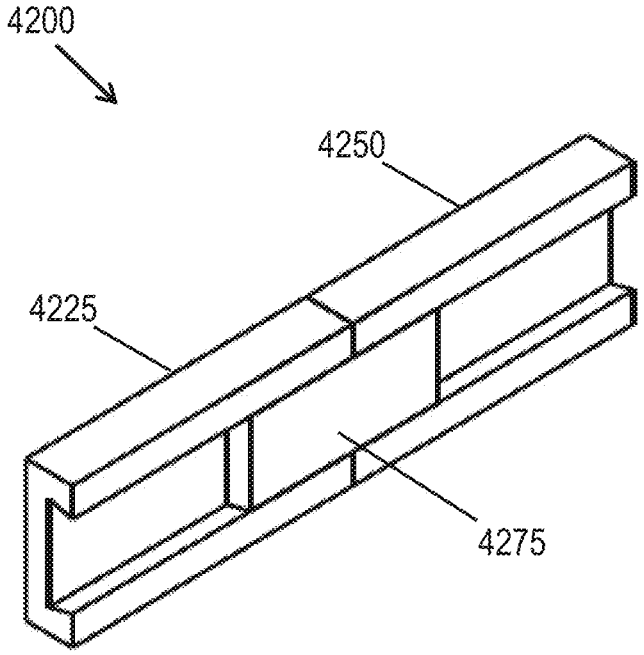
FIG. 38 is an illustration of an assembled view of another embodiment of the compartment divider assembly.

FIG. 38 is an illustration of an assembled view of another embodiment of the compartment divider assembly. As shown in FIG. 38, another embodiment of a compartment divider assembly 4200 may comprise: dividers 4225, 4250 and a coupler 4275. FIG. 38 shows that the coupler 4275 may be coupled to the dovetail grooves of both dividers 4225, 4250.

Figure 39A:
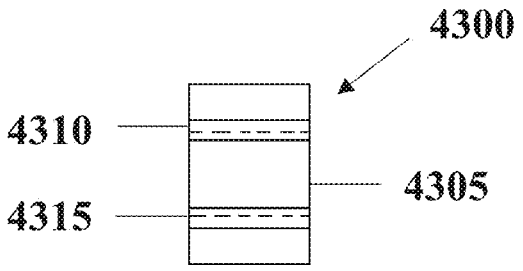
FIGS. 39A and 39B are illustrations of one embodiment of a snap-on coupler of one embodiment of the compartment divider assembly.
Figure 39B:
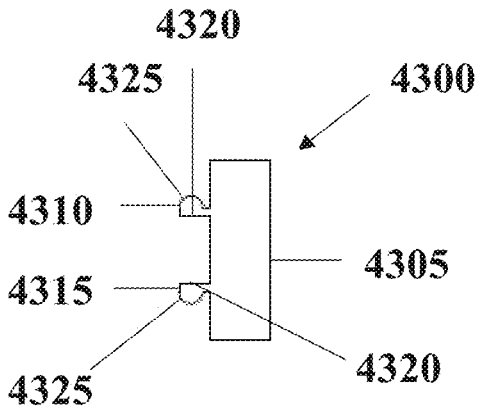

FIGS. 39A and 39B are illustrations of one embodiment of a snap-on coupler of a compartment divider assembly. FIG. 39A is a rear elevational view of the snap-on coupler 4300. FIG. 39B is an elevational right-side view of the snap-on coupler 4300. As shown in FIGS. 39A and 39B, one embodiment of the snap-on coupler 4300 may comprise at least one support coupler 4305 and one or more male prongs 4310, 4315. The support coupler 4305 may be disposed in a generally vertical manner. The one or more male prongs may comprise a first prong 4310 and a second prong 4315, and may be disposed in a generally horizontal manner. The support coupler 4305 may be coupled or integral to the prongs 4310, 4315, such that at least one side of the support coupler 4305 is disposed in a substantially perpendicular or reasonably acute or obtuse angle with respect to at least one side of the prongs 4310, 4315.

Figure 41:
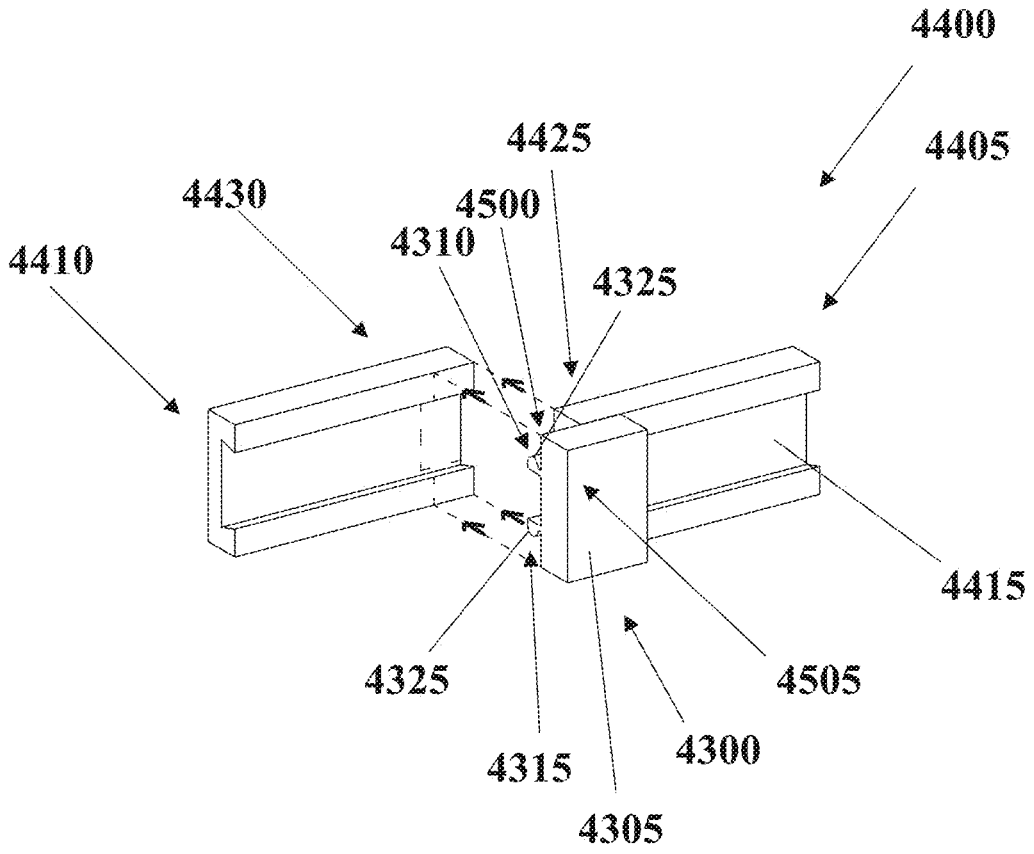
FIG. 41 is an illustration of a partially exploded view of one embodiment of the compartment divider assembly, shown in FIG. 40, and shows the snap-on coupler engaged with a dovetail groove of the first divider, before the first divider engages with the second divider.
Figure 42:
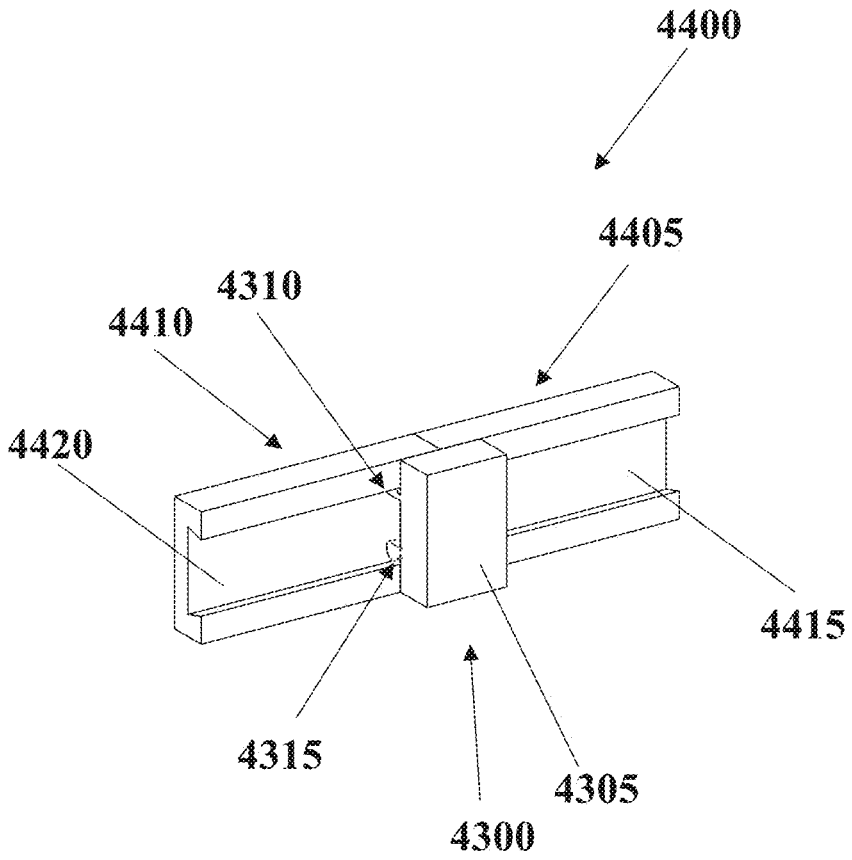
FIG. 42 is an illustration of an assembled view of one embodiment of the compartment divider assembly, shown in FIG. 40, and shows the compartment divider assembly in the lock configuration with the first divider engaged with the second divider.

FIG. 39B shows that the prongs 4310, 4315 may comprise one or more planar and/or non-planar outer faces 4320, 4325. A first face 4320 may comprise a substantially planar surface, which may be a base or a stem, and a protrusion 4325. The protrusion 4325 may be configured to removably engage with a top or a bottom of a divider groove, so it may have a substantially rounded surface to smoothly squeeze or pass into and out of the groove. The first face 4320 and the second face 4325 of the prongs 4310, 4315 may be configured to snap into one or more grooves on one or more dividers, as shown in FIGS. 41 and 42. In order to snap into the groove, the prongs 4310, 4315 are preferably deformable or flexible so that they can be bent inward and then spring outward once inside the groove.

Figure 40:
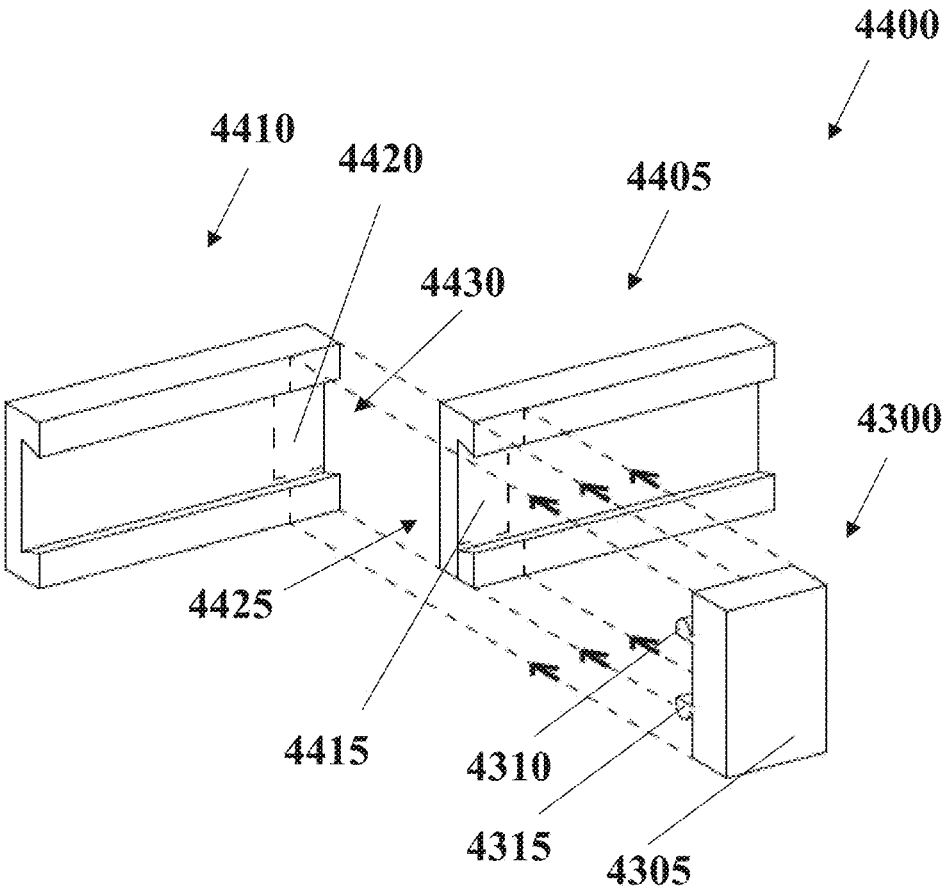
FIG. 40 is an illustration of an exploded view of one embodiment of the compartment divider assembly and shows the snap-on coupler and two dividers.

FIG. 40 is an illustration of an exploded view of one embodiment of the compartment divider assembly and shows the snap-on coupler. As shown in FIG. 40, one embodiment of the compartment divider assembly 4400 may comprise: one or more dividers 4405, 4410, which may comprise a first divider 4405 and a second divider 4410, and at least one snap-on coupler 4300, which may comprise at least one support coupler 4305 and one or more prongs 4310, 4315.

One embodiment of the dividers 4405, 4410 may comprise dovetail grooves 4415, 4420. Preferably, the first divider 4405 may comprise a first dovetail groove 4415 and the second divider 4410 may comprise a second dovetail groove 4420. The dovetail grooves 4415, 4420 may traverse or travel across a longitudinal path of the dividers 4405, 4410. Preferably, the dovetail grooves 4415, 4420 are adapted to allow the dividers 4405, 4410 to couple or removably attach to additional dividers via one or more prongs 4310, 4315. In particular, additional snap-on couplers having prongs may be snapped into the dovetail grooves 4415, 4420 of the dividers 4405, 4410. The dovetail grooves 4415, 4420, as shown, may be tapered or angled sided channels. In other embodiments, each divider 4405, 4410 may have two or more dovetail grooves at different heights such as a single unit, triple unit, or higher unit of measurement. In other embodiments, each snap-on coupler 4300 may have as many prongs as necessary at different heights to engage with two or more dovetail grooves at different heights.

In the embodiment shown, the compartment divider assembly 4400 may be used to create an end-to-end connection in which an end 4425 of the first divider 4405 and an end 4430 of the second divider 4410 may be coupled, attached, or held in place by the prongs 4310, 4315 of the snap-on coupler 4300.

FIG. 41 is another illustration of a partially exploded view of one embodiment of the compartment divider assembly, shown in FIG. 40, and shows the snap-on coupler engaged with a dovetail groove of the first divider, before the first divider engages with the second divider. As shown in FIG. 41, one embodiment of the compartment divider assembly 4400 may comprise: one or more dividers 4405, 4410, which may comprise a first divider 4405 and a second divider 4410, and at least one snap-on coupler 4300, which may comprise at least one support coupler 4305 and one or more prongs 4310, 4315. FIG. 41 shows that the prongs 4310, 4315 of the snap-on coupler 4300 may be adapted to snap into the dovetail groove 4415 of the first divider 4405. As a result, the prongs 4310, 4315 preferably engage with the inner sides of the dovetail groove 4415. This in turn allows the second face 4325 of the prongs 4315, 4310 to engage with the inner sides of the dovetail groove 4415 such that the prongs 4310, 4315 are secured and flushed within the dovetail groove 4415. Preferably, a gap 4500 is then formed between an end 4425 of the first divider 4405 and an end 4505 of the snap-on coupler 4300. The gap 4500 may be preferably dimensioned to fittingly receive an end 4430 of the second divider 4410.

FIG. 42 is another illustration of an assembled view of one embodiment of the compartment divider assembly, shown in FIG. 40, and shows the compartment divider assembly in the lock configuration with the first divider engaged with the second divider. As shown in FIG. 42, one embodiment of the compartment divider assembly 4400 may comprise: one or more dividers 4405, 4410, which may comprise a first divider 4405 and a second divider 4410, and at least one snap-on coupler 4300, which may comprise at least one support coupler 4305 and one or more prongs 4310, 4315. FIG. 42 shows the prongs 4310, 4315 of the snap-on coupler 4300 engaged with the dovetail groove 4415 of the first divider 4405 and the dovetail groove 4420 of the second divider 4410. FIG. 42 also shows how the compartment divider assembly 4300 may be used to form a longer divider in a compartment that is held together by tension and/or friction. In particular, the dividers may be held firmly together by the snap-on coupler 4300. Although FIG. 42 shows the second divider 4410 to be coupled end-to-end with the first divider 4405, the second divider 4410 may be positioned at various angles.

FIGS. 39A to 42 also show that the two prongs are separate and distinct. This may make them more pliable. The prongs may be one structure that extends the height of the two prongs as shown.

Figure 43A:
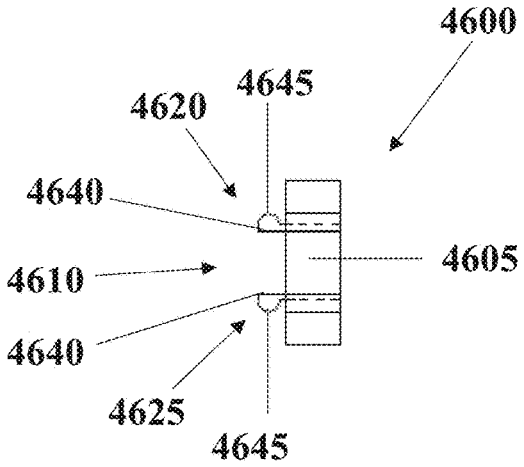
FIGS. 43A and 43B are illustrations of one embodiment of a corner snap-on coupler of one embodiment of the compartment divider assembly.
Figure 43B:
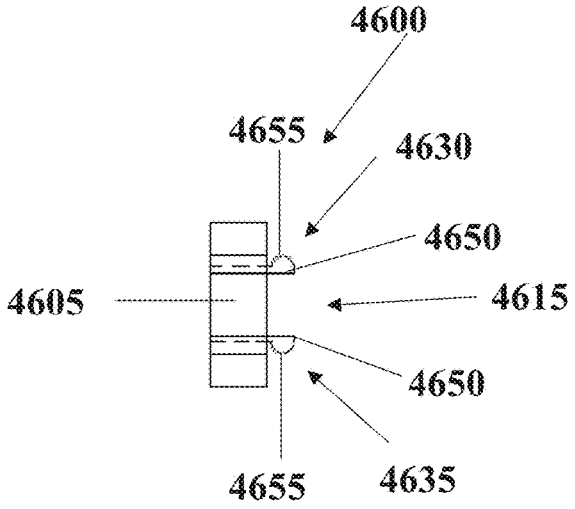

FIGS. 43A and 43B are illustrations of another embodiment of a corner snap-on coupler of the compartment divider assembly. FIG. 43A is an elevational right-side view of the snap-on coupler 4600. FIG. 43B is an elevational left-side view of the snap-on coupler 4600. As shown in FIGS. 43A and 43B, one embodiment of the snap-on coupler 4600 may comprise at least one support coupler 4605 and one or more sets of prongs 4610, 4615. Each set of prongs 4610, 4615 may comprise first set of prongs 4610 and a second set of prongs 4615. The first set of prongs 4610 and the second set of prongs 4615 may comprise one or more prongs 4620, 4625, 4630, 4635. Preferably, the first set of prongs 4610 may comprise prongs 4620, 4625 and the second set of prongs 4615 may comprise prongs 4630, 4635. The support coupler 4605 may be disposed in a generally vertical manner. The prongs 4620, 4625, 4630, 4635 may be disposed in a generally horizontal manner. The support coupler 4605 may be coupled or integral to the prongs 4620, 4625, 4630, 4635 such that at least one side of the support coupler 4605 is disposed in a substantially perpendicular or reasonably acute or obtuse angle with respect to at least one side of the prongs 4620, 4625, 4630, 4635.

Figure 45:
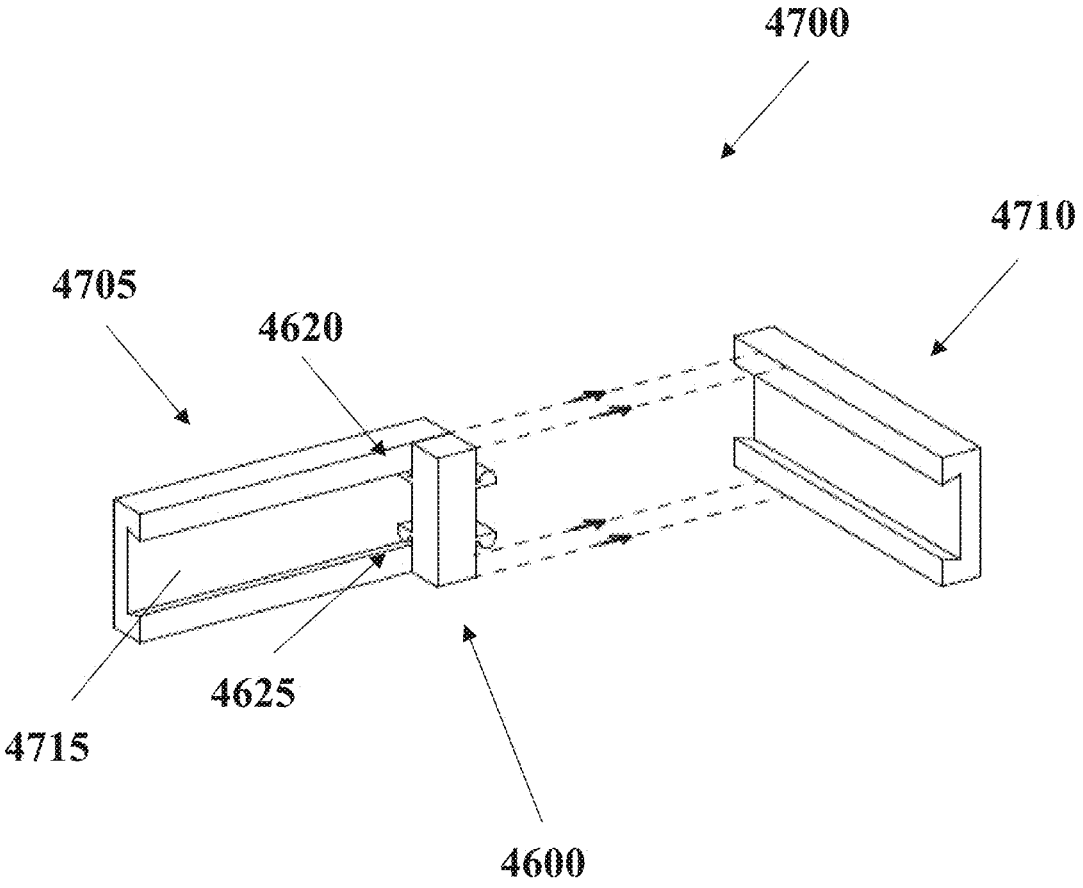
FIG. 45 is an illustration of a partially exploded view of another embodiment of the compartment divider assembly, shown in FIG. 44, and shows the snap-on coupler engaged with a dovetail groove of the first divider, before the first divider engages with the second divider.
Figure 46:
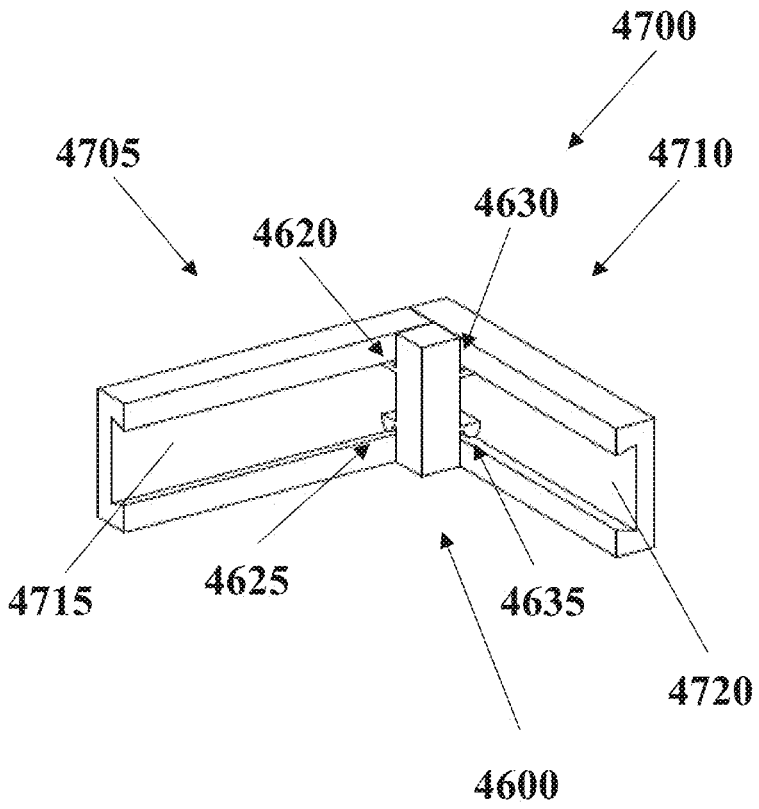
FIG. 46 is an illustration of an assembled view of another embodiment of the compartment divider assembly, shown in FIG. 44, and shows the compartment divider assembly in the lock configuration with the first divider engaged with the second divider to form a corner.

Importantly, FIG. 43A shows that the prongs 4620, 4625 may comprise one or more planar and/or non-planar faces 4640, 4645. A first face 4640 may comprise a substantially planar surface and a second face 4645 may comprise a substantially rounded surface. Similarly. FIG. 43B shows that the prongs 4630, 4635 may also comprise one or more planar and/or non-planar faces 4650, 4655. A first face 4650 may comprise a substantially planar surface and a second face 4655 may comprise a substantially rounded surface. Preferably, the prongs 4620, 4625, 4630, 4635 may be adapted to snap into one or more dovetail grooves of one or more dividers, as shown in FIGS. 45 and 46. FIGS. 43A and 43B show that the prongs 4630, 4635, 4620, 4625 may have an outer protrusion that is configured to removably engage with a top or a bottom of a divider groove, so it may have a substantially rounded surface to smoothly squeeze or pass into and out of the groove.

Figure 44:
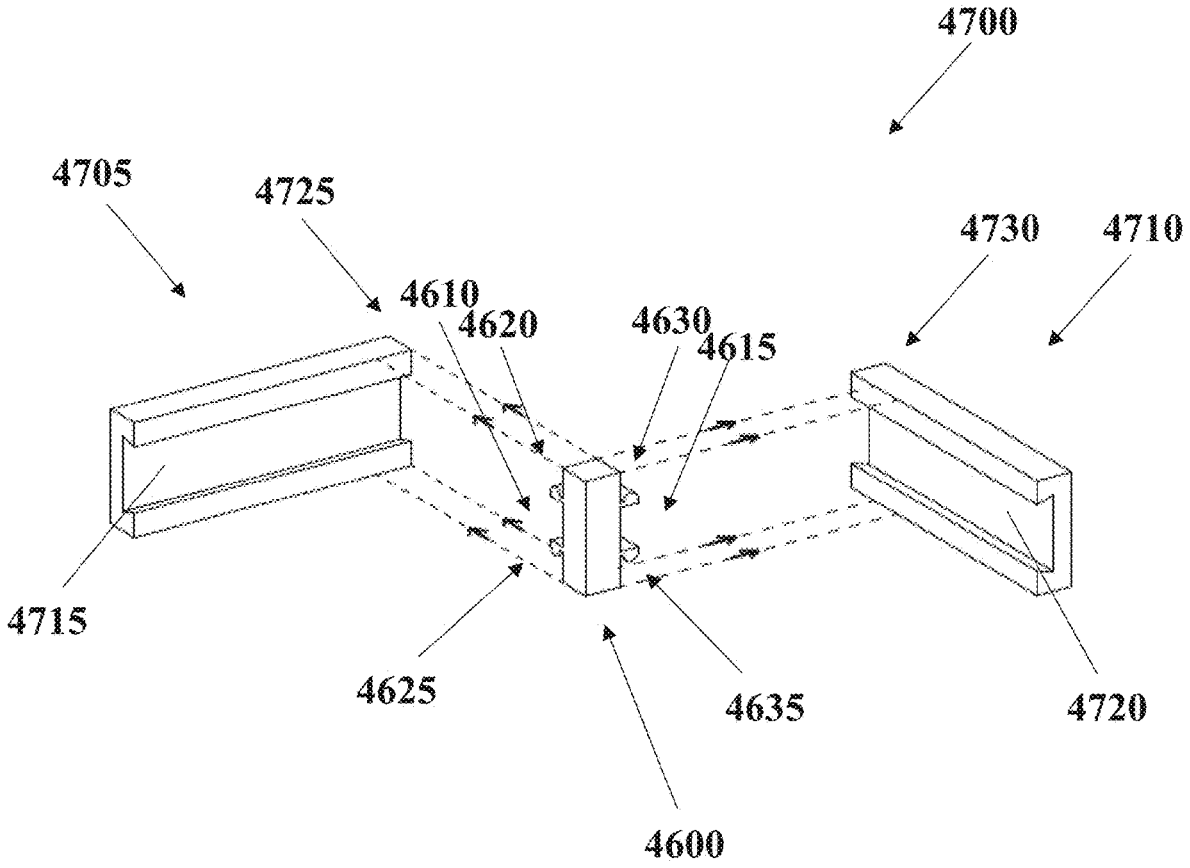
FIG. 44 is an illustration of an exploded view one embodiment of a corner snap-on coupler of one embodiment of the compartment divider assembly.

FIG. 44 is an illustration of an exploded view of another embodiment of the compartment divider assembly and shows the corner snap-on coupler. As shown in FIG. 44, one embodiment of the compartment divider assembly 4700 may comprise at least one snap-on coupler 4600 and one or more dividers 4705, 4710, which may comprise a first divider

4705, a second divider 4710. FIG. 44 shows that each divider 4705, 4710 may further comprise at least one dovetail groove 4715, 4720, respectively, such that each divider 4705, 4710 may engage with the snap-on coupler 4600. In other embodiments, each divider 4705, 4710 may have two or more dovetail grooves at different heights such as a single unit, triple unit, or higher unit of measurement. In other embodiments, the snap-on coupler 4600 may have three or more prongs at different heights to engage with two or more dovetail grooves at different heights.

FIG. 44 also shows that the snap-on coupler 4600 may comprise at least a first set of prongs 4610 and a second set of prongs 4615. The first set of prongs 4610 may comprise one or more prongs 4620, 4625. Similarly, the second set of prongs 4615 may also comprise one or more prongs 4630, 4635. The prongs 4620, 4625 of the first set 4610 may be adapted to snap into the dovetail groove 4715 of the first divider 4705 and the prongs 4630, 4635 of the second set 4615 may be adapted to snap into the dovetail groove 4720 of the second divider 4710. Preferably, the dividers 4705, 4710 may couple perpendicularly with one another at their ends 4725, 4730, respectively, to create one embodiment of a compartment divider assembly 4700 (shown in FIG. 46). When coupled, the dividers 4705, 4710 are substantially immobile on an axis perpendicular to the engagement, which may form a corner in a drawer that would benefit from being divided.

FIG. 44 shows that the prongs 4620, 4625, 4630, 4635 of the snap-on coupler 4600 may be disposed near the top and bottom portions of the snap-on coupler 4600 and may be at substantially the same height as the top and bottom portions of the dovetail grooves 4715, 4720. Preferably, the prongs 4620, 4625, 4630, 4635 may snap into the dovetail grooves 4715, 4720, located near or at the top and bottom portion of the dividers 4705, 4710, respectively. Although FIG. 44 shows the prongs 4620, 4625, 4630, 4635 of snap-on coupler 4600 to be near the top and bottom portion of the snap-on coupler 4600, the prongs 4620, 4625, 4630, 4635 may be disposed at different heights. Additionally, the parts of the compartment divider assembly 4700 may be turned around, inverted, and/or flipped, such that they may connect in different ways and heights. It should also be understood that the prongs, which are shown in pairs of two, may be a single unitary piece that spans the height of the groove with which it is configured to engage.

FIG. 45 is an illustration of a partially exploded view of another embodiment of the compartment divider assembly, shown in FIG. 44, and shows the snap-on coupler engaged with a dovetail groove of the first divider, before engagement with the second divider. As shown in FIG. 45, one embodiment of the compartment divider assembly 4700 may comprise one or more dividers 4705, 4710, which may comprise a first divider 4705, a second divider 4710, and at least one snap-on coupler 4600. FIG. 45 shows that the dovetail groove 4715 of the first divider 4705 may engage with the prongs 4620, 4625 of the snap-on coupler 4600. FIG. 45 shows that first divider 4705 may engage with the prongs 4620, 4625 by snapping onto the prongs 4620, 4625, such that the first divider 4705 is prevented from being pulled perpendicularly away from the snap-on coupler 4600. The prongs 4620, 4625 may be made from a flexible, deformable, and/or memory material, such as plastic, but any non-substantially rigid material may be used, including wood and metal. The prongs preferably may deform or squeeze toward each other and then spring back into their original position after the protrusions are in the groove. FIG. 45 shows the protrusions as rounded, which may be helpful for moving, engaging, and disengaging the coupler 4600 from the dividers 4705, 4710.

FIG. 46 is an illustration of an assembled view of another embodiment of the compartment divider assembly, shown in FIG. 44, and shows the compartment divider assembly in the lock configuration with the first divider engaged with the second divider. As shown in FIG. 46, one embodiment of the compartment divider assembly 4700 may comprise one or more dividers 4705, 4710, which may comprise a first divider 4705, a second divider 4710, and at least one snap-on coupler 4600. FIG. 46 shows that the dovetail groove 4715 of the first divider 4705 may engage with prongs 4620, 4625 of the snap-on coupler 4600 and that the dovetail groove 4720 of the second divider 4710 may engage with prongs 4630, 4635 of the snap-on coupler 4600. Importantly, FIG. 46 shows that the second divider 4710 may snap further inwards such that the second divider 4710 may overlap an end of the first divider 4705. The first divider 4705 or the second divider 4710 may snap or move further at the expense of the other divider. Although not shown, the ends of the dividers may be mitered.

In another embodiment, the snap-on coupler 4600 may create or provide further tension or pressure to help the snap-on coupler 4600 remain engaged with the dovetail groove 4715 of the first divider 4705 and the dovetail groove 4720 of the second divider 4710. The tension or pressure may be created by an insert coupled or integral to the snap-on coupler 4600. The insert may be comprised of any material or object that creates or provides further tension or pressure, such as, but not limited to, a dimple, wedge, coil, spring, and/or screw. When the insert is engaged with the snap-on coupler 4600 and the dovetail grooves 4715, 4720 of the dividers 4705, 4710, the angle of the first divider 4705 with respect to second divider 4710 may be greater than or less than 90 degrees. Similarly, when the insert is engaged with the snap-on coupler 4600 and the dovetail grooves 4715, 4720 of the dividers 4705, 4710, the dividers 4705, 4710 may arc inward or outward to create or provide further tension or pressure.

Figure 47:
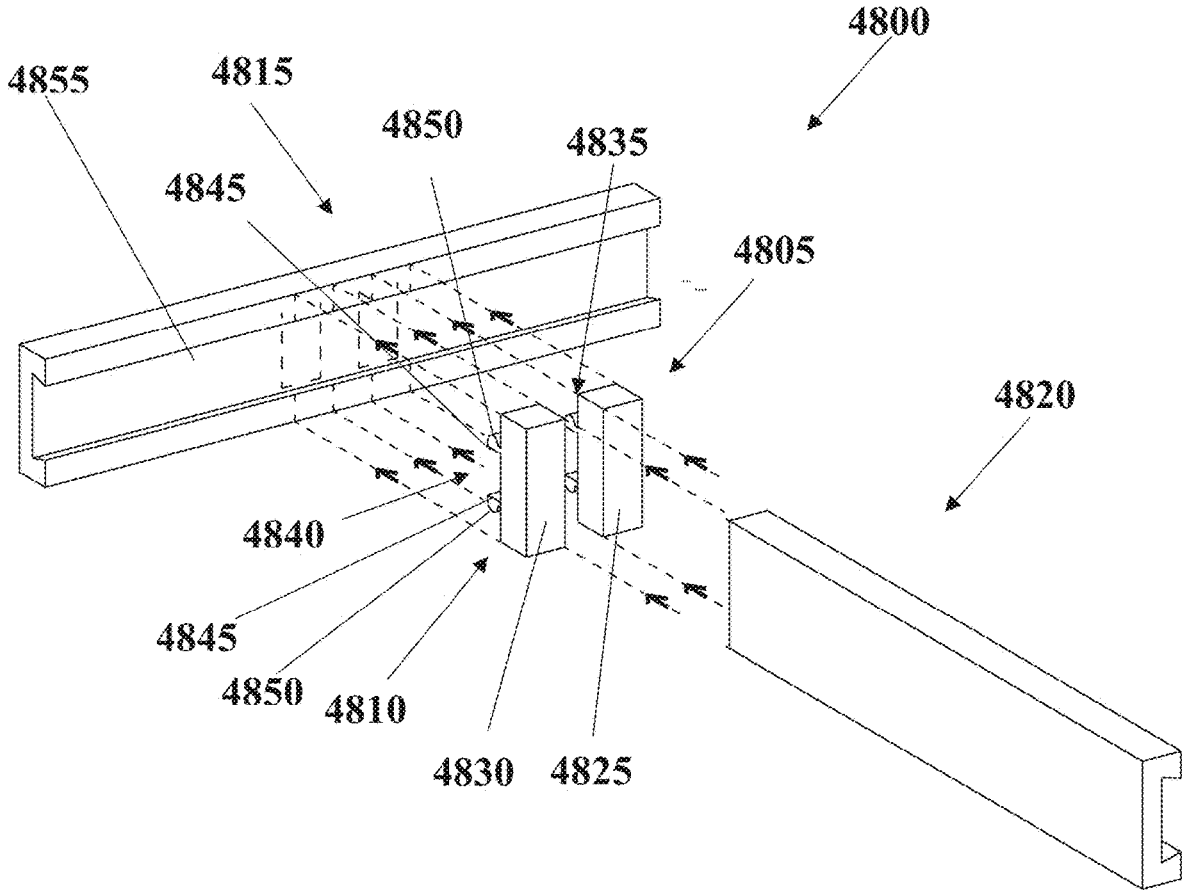
FIG. 47 is an illustration of an exploded view of another embodiment of the compartment divider assembly and shows a first snap-on coupler and a second snap-on coupler joining two dividers.

FIG. 47 is an illustration of an exploded view of another embodiment of the compartment divider assembly and shows a first snap-on coupler and a second snap-on coupler in the release configuration. As shown in FIG. 47, one embodiment of the compartment divider assembly 4800 may comprise: one or more snap-on couplers 4805, 4810 and one or more dividers 4815, 4820. The snap-on couplers may comprise a first snap-on coupler 4805 and a second snap-on coupler 4810. The dividers 4815, 4820 may comprise a first divider 4815, and a second divider 4820. The first snap-on coupler 4805 may further comprise at least one support coupler 4825 and one or more prongs 4835. Similarly, the second snap-on coupler 4810 may further comprise at least one support coupler 4830 and one or more prongs 4840. The support couplers 4825, 4830 may be disposed in a generally vertical manner and the prongs 4835, 4840 may be disposed in a generally horizontal manner. The support couplers 4825, 4830 may be coupled or integral to the prongs 4835, 4840 such that at least one side of the support couplers 4825, 4830 may disposed in a substantially perpendicular or reasonably acute or obtuse angle with respect to at least one side of the prongs 4835, 4840.

Importantly, FIG. 47 shows that the prongs 4835, 4840 may comprise one or more planar and/or non-planar faces or portions 4845, 4850. The first face 4845 may comprise a substantially planar surface and the second face or protrusion 4850 may comprise a substantially rounded surface. The first face 4845 and the second face 4850 of the prongs

Figure 48:
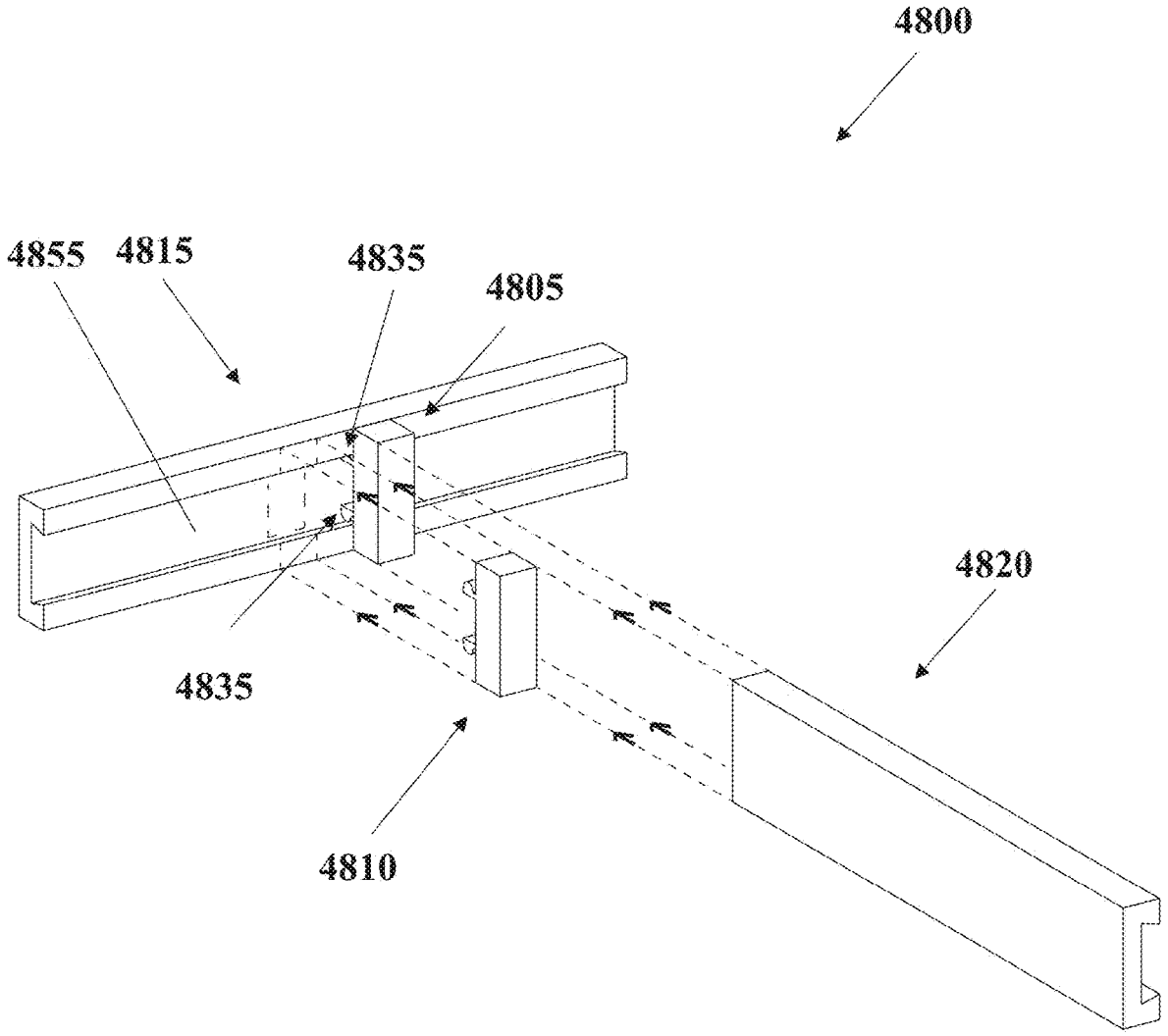
FIG. 48 is an illustration of a partially exploded view of one embodiment of the compartment divider assembly, shown in FIG. 47, and shows the first snap-on coupler engaged with a dovetail groove of a first divider, before the second snap-on coupler engages with the dovetail groove of the first divider.
Figure 49:
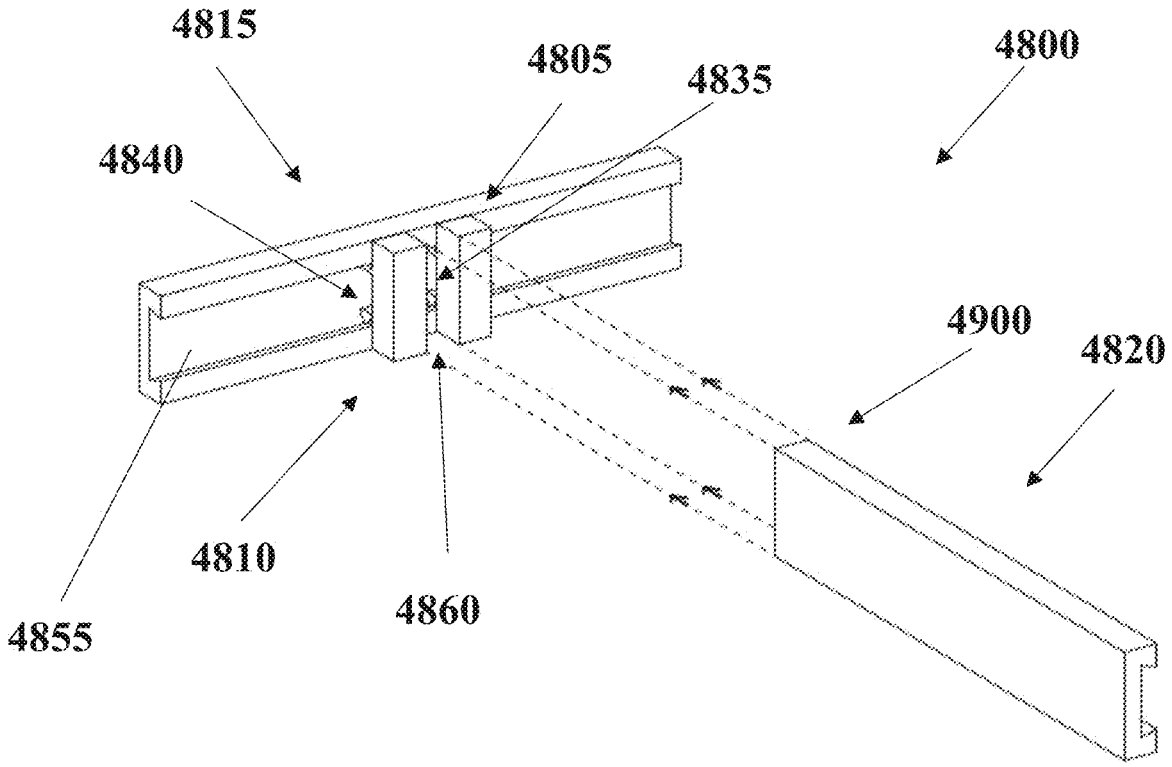
FIG. 49 is an illustration of a partially exploded view of one embodiment of the compartment divider assembly, shown in FIG. 47, and shows a first snap-on coupler and a second snap-on coupler engaged with a dovetail groove of a first divider, before the second divider engages with the first divider.
Figure 50:
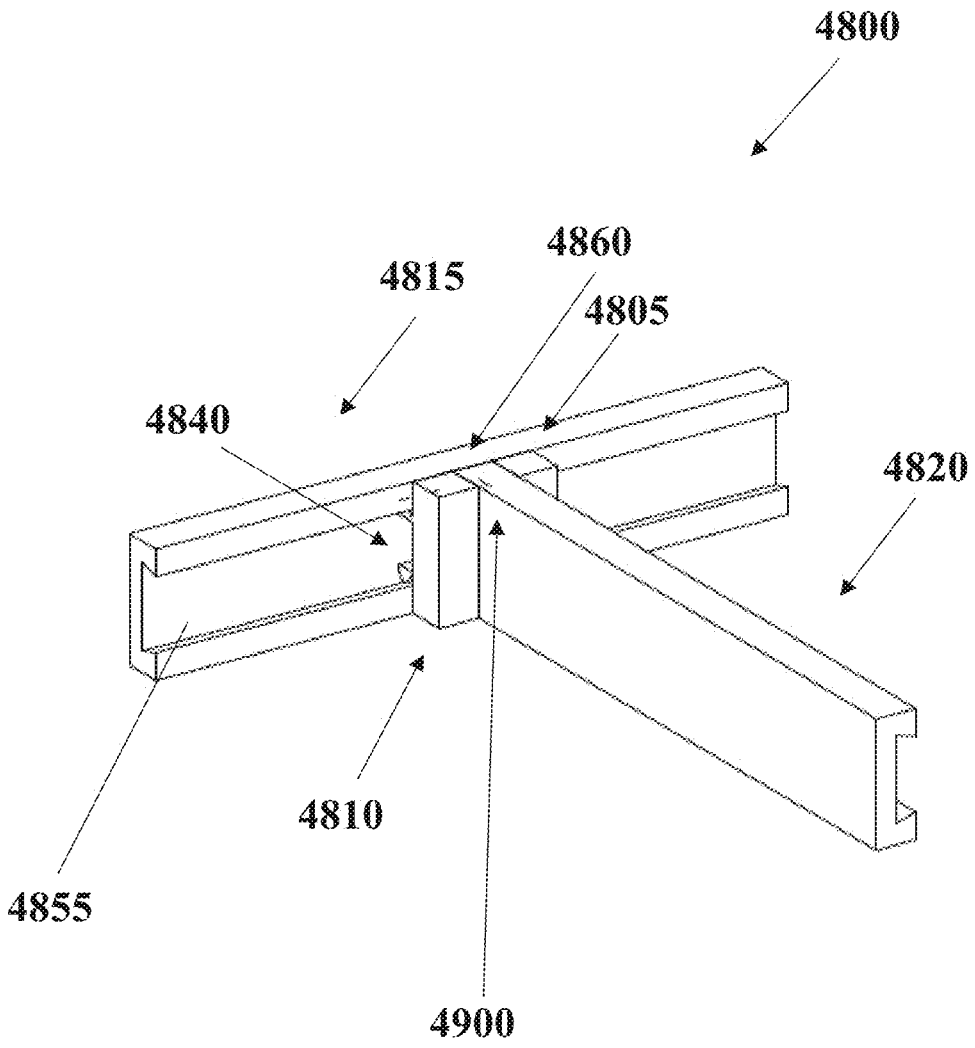
FIG. 50 is an illustration of an assembled view of another embodiment of the compartment divider assembly, shown in FIG. 47, and shows the compartment divider assembly in the lock configuration with the first divider engaged with the second divider.

4835, 4840 are adapted to snap into the dovetail groove 4855 of the first divider 4815, as shown in FIGS. 48 through 50. The protrusions 4850 and/or the prongs 4835, 4840 may be made from a flexible, deformable, and/or memory material, such as plastic, but any non-substantially rigid material may be used, including wood and metal. The protrusions and/or the prongs preferably may deform or squeeze inward and then spring back into their original position after the protrusions are in the groove. Although the protrusions are shown as rounded, which is helpful for moving engaging and disengaging the coupler from the dividers, other shapes may be used. When there are two prongs and not a single unitary prong, the protrusions do not have to be deformable because the prong preferably deforms to snap into place.

The snap-on coupler may have a prong that is one unitary prong that has a base, a top protrusion, and a bottom protrusion. In this embodiment, the protrusions are preferably deformable.

FIG. 48 is an illustration of a partially exploded view of another embodiment of the compartment divider assembly, shown in FIG. 47, and shows a first snap-on coupler engaged with a dovetail groove of a first divider, before the second snap-on coupler engages with the dovetail groove of the first divider. As shown in FIG. 48, one embodiment of the compartment divider assembly 4800 may comprise: one or more snap-on couplers 4805, 4810 and one or more dividers 4815, 4820. The snap-on couplers may comprise a first snap-on coupler 4805 and a second snap-on coupler 4810. The dividers 4815, 4820 may comprise a first divider 4815, and a second divider 4820. FIG. 48 shows that one or more prongs 4835 of the first snap-on coupler 4805 may snap into the dovetail groove 4855 of the first divider 4815. As a result, the prongs 4835 preferably engage with the inner sides of the dovetail groove 4855 of the first divider 4815. This in turn allows the first and second face of the prongs 4835 to engage with the inner sides of the dovetail groove 4855 such that the prongs 4835 may be secured and flushed within the dovetail groove 4855 of the first divider 4815.

FIG. 49 is an illustration of a partially exploded view of another embodiment of the compartment divider assembly, shown in FIG. 47, and shows a first snap-on coupler and a second snap-on coupler engaged with a dovetail groove of a first divider, before the second divider engages with the first divider. As shown in FIG. 49, one embodiment of the compartment divider assembly 4800 may comprise: one or more snap-on couplers 4805, 4810 and one or more dividers 4815, 4820. The snap-on couplers may comprise a first snap-on coupler 4805 and a second snap-on coupler 4810. The dividers 4815, 4820 may comprise a first divider 4815, and a second divider 4820. FIG. 49 further shows that the compartment divider assembly 4800 may be used to create a T connection, as shown in FIG. 50, where an end 4900 of the second divider 4820 couples, attaches, or is held in place at a mid-section or area of the first divider 4815. Preferably, when the prongs 4835, 4840 of the snap-on couplers 4805, 4810, respectively, are engaged with the dovetail groove 4855 of the first divider 4815, a gap 4860 may form between the snap-on couplers 4805, 4810. The gap 4860 may be preferably dimensioned to fittingly receive an end 4900 of the second divider 4820. FIG. 49 further shows that the groove 4855 may be slanted inward and downward, or dovetailed, such that the outer diameter of the groove is less than the inner diameter of the groove.

FIG. 50 is an illustration of an assembled view of another embodiment of the compartment divider assembly, shown in FIG. 47, and shows the compartment divider assembly in the lock configuration with the first divider engaged with the second divider. As shown in FIG. 50, one embodiment of the compartment divider assembly 4800 may comprise: one or more snap-on couplers 4805, 4810 and one or more dividers 4815, 4820. The snap-on couplers may comprise a first snap-on coupler 4805 and a second snap-on coupler 4810. The dividers 4815, 4820 may comprise a first divider 4815, and a second divider 4820. FIG. 50 shows that after the prongs 4840 of the snap-on couplers 4805, 4810 are engaged with the dovetail groove 4855 of the first divider 4815, the snap-on couplers 4805, 4810 may create a gap 4860, which, as shown, may be used to receive an end 4900 of the second divider 4820. FIG. 50 shows how the assembly 4800 may be used to form a divider in a compartment that may be held together by tension and/or friction. In particular, the parts may be held firmly in place by the prongs of the snap-on couplers 4805, 4810. Although FIG. 50 shows the second divider 4820 to be perpendicular to the first divider 4815, the second divider 4820 may be positioned at various angles.

Figure 51:
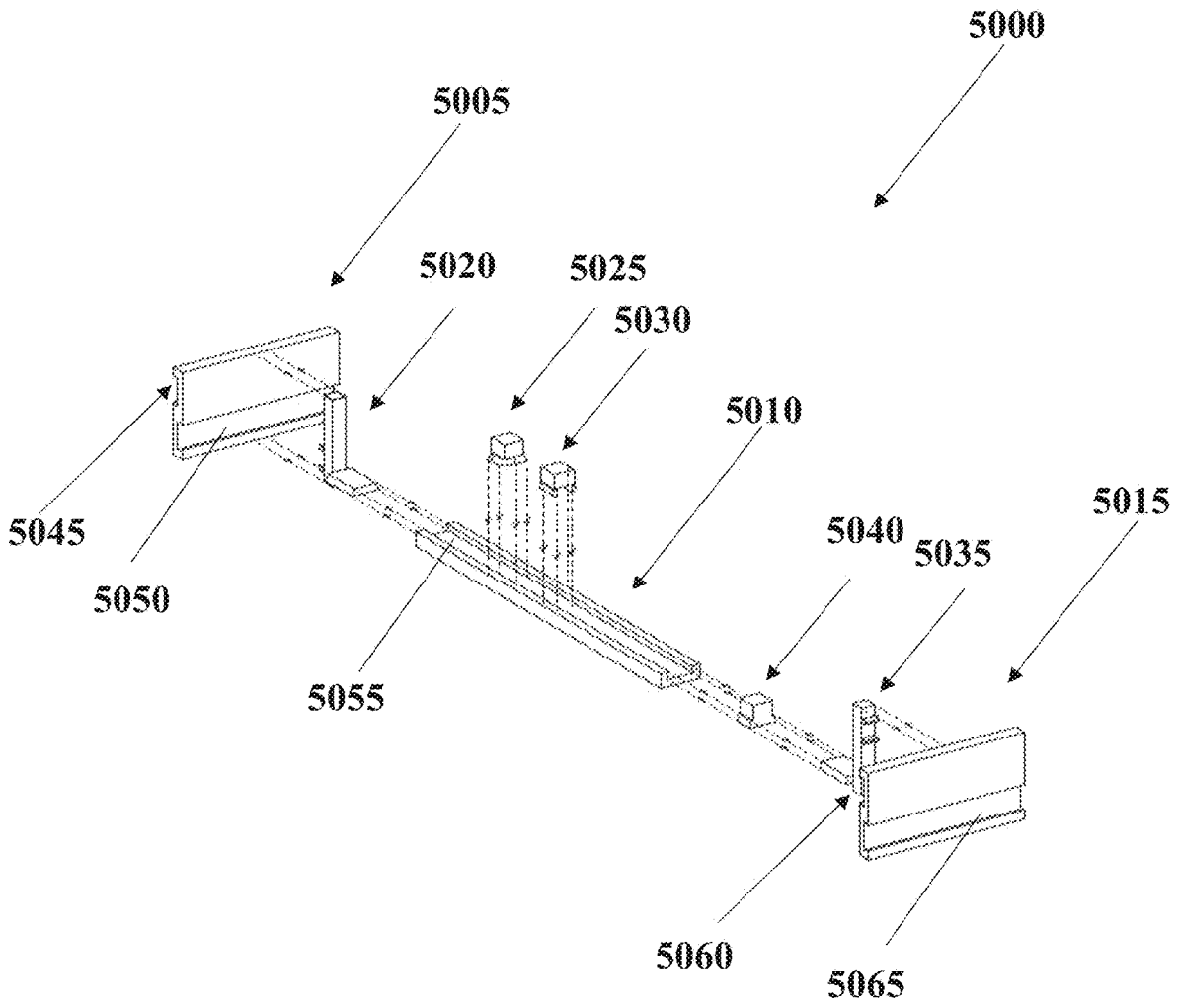
FIG. 51 is an illustration of an exploded view of another embodiment of a compartment divider assembly with one or more snap-on couplers and a horizontal second divider.
Figure 52:
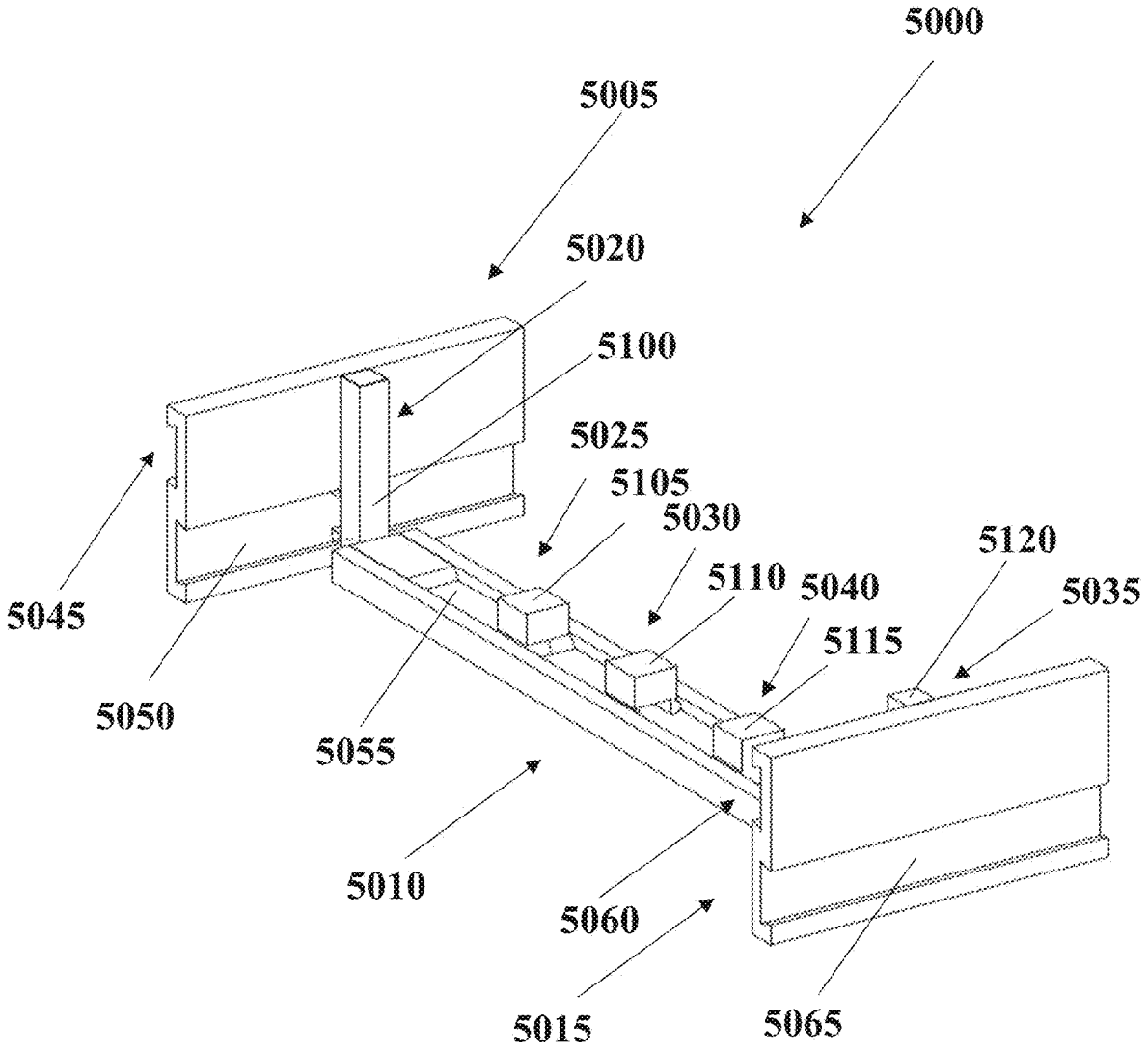
FIG. 52 is an illustration of an assembled view of another embodiment of the compartment divider assembly with one or more snap-on couplers and a horizontal second divider.

FIG. 51 is an illustration of an exploded view of another embodiment of a compartment divider assembly with one or more snap-on couplers and a horizontal divider. As shown in FIG. 51, one embodiment of a compartment divider assembly 5000 may comprise: one or more dividers 5005, 5010, 5015, one or more snap-on couplers 5020, 5030, 5035, at least one twist-on coupler 5025, and at least one slide-on space 5040. The dividers 5005, 5010, 5015, snap-on couplers 5020, 5030, 5035, twist-on coupler 5025, and slide-on spacer 5040 may be coupled together to form a compartment divider assembly 5000 (shown assembled in FIG. 52), which may be used to create a smaller sub-compartment within a drawer compartment. Each divider 5005, 5010, 5015 may have different heights as a single unit, triple unit, or higher unit of measurement. Further, each coupler/divider 5020, 5025, 5030, 5035, 5040 may have multiple prongs at different heights to engage with dovetail grooves at different heights. Generally, the dovetail grooves and prongs may be disposed horizontally along the dividers, such that they may engage each other at various heights and ways. The snap-on couplers 5020, 5030, 5035 may snap into one or more dovetail grooves 5045, 5050, 5055, 5060, 5065 on one or more dividers 5005, 5010, 5015, as shown in FIG. 52. The twist-on coupler 5025 and the slide-on spacer 5040 may engage with divider 5010. In this manner, the twist-on coupler 5025 may twist onto the dovetail groove 5055 and the slide-on spacer 5040 may slide into and along the length of the dovetail groove 5055, which may prevent the twist-on coupler 5025 and the slide-on spacer 5040 from being pulled perpendicularly away from divider 5010. FIG. 51 shows how the T-divider 5010 may be horizontal and flat to a surface, rather than edge to the surface. FIG. 51 shows that the snap-on coupler 5035 may have the prongs on an upper portion, it just depends on what height the groove is at.

FIG. 52 is an illustration of an assembled view of another embodiment of the compartment divider assembly with one or more snap-on couplers. As shown in FIG. 52, one embodiment of a compartment divider assembly 5000 may comprise: one or more dividers 5005, 5010, 5015, one or more snap-on couplers 5020, 5030, 5035, at least one twist-on coupler 5025, and at least one slide-on spacer 5040. FIG. 52 shows one way the dividers 5005, 5010, 5015 with reciprocal dovetail grooves 5045, 5050, 5055, 5060, 5065 inter-connect with one another. FIG. 52 also shows how the dividers 5005, 5010, 5015 of various lengths and heights may be interconnected in numerous different ways. The divider support couplers 5100, 5105, 5110, 5115, 5120 may also be used to couple to the dovetail grooves 5045, 5050, 5055, 5060, 5065 of the dividers 5005, 5010, 5015 to create additional sub-compartments within the compartment divider assembly.

FIGS. 51 and 52 show how snap-on couplers 5020, 5035 may comprise one or more couplers comprise at least one support coupler, at least one prong, and a male connector. The male connector may be horizontal to slideably engage with the dovetail groove 5055 of the second divider 5010. The prongs may engage with the dovetail groove 5050 of the first divider 5005.

Figure 53:
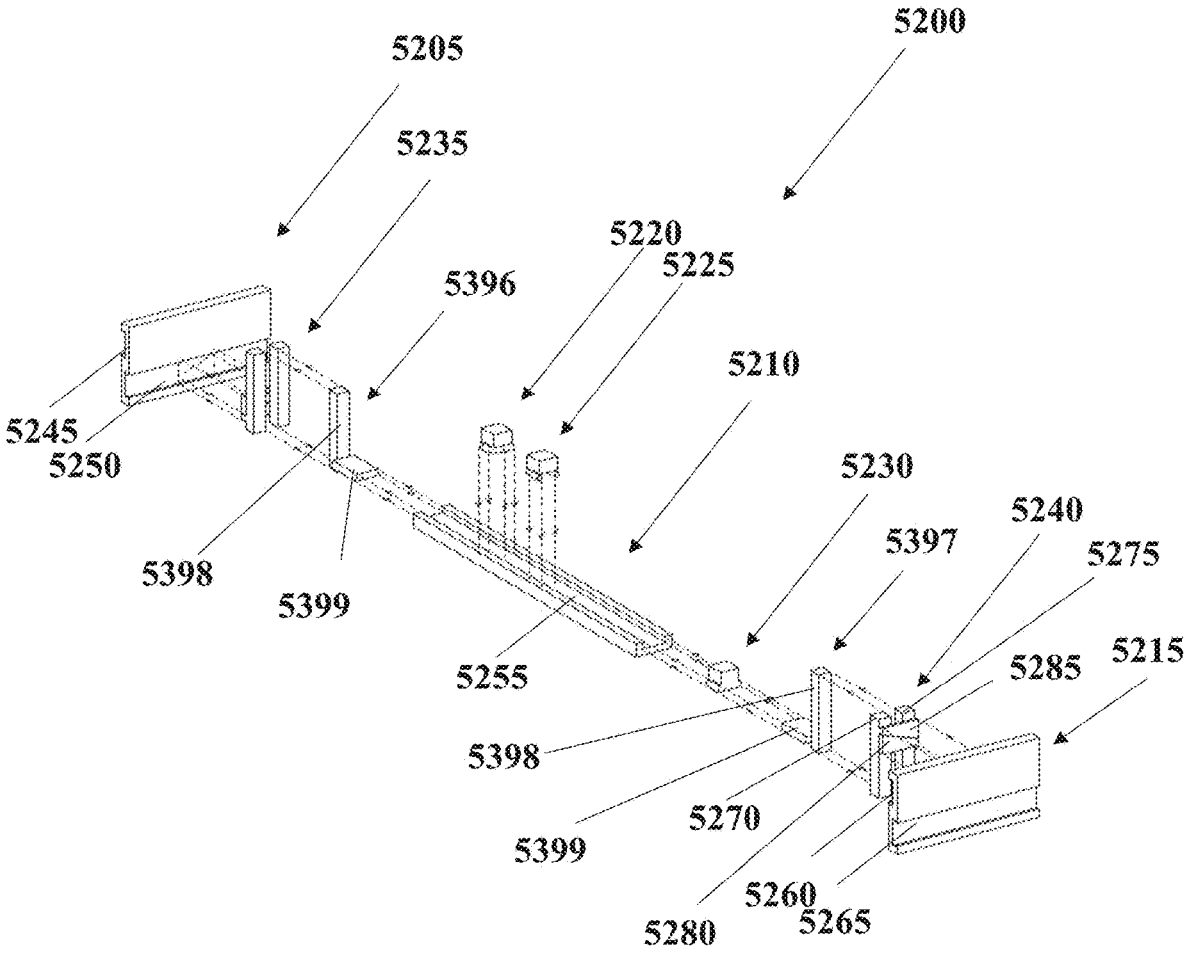
FIG. 53 is an illustration of an exploded view of another embodiment of a compartment divider assembly with two slide couplers supporting the divider.
Figure 54:
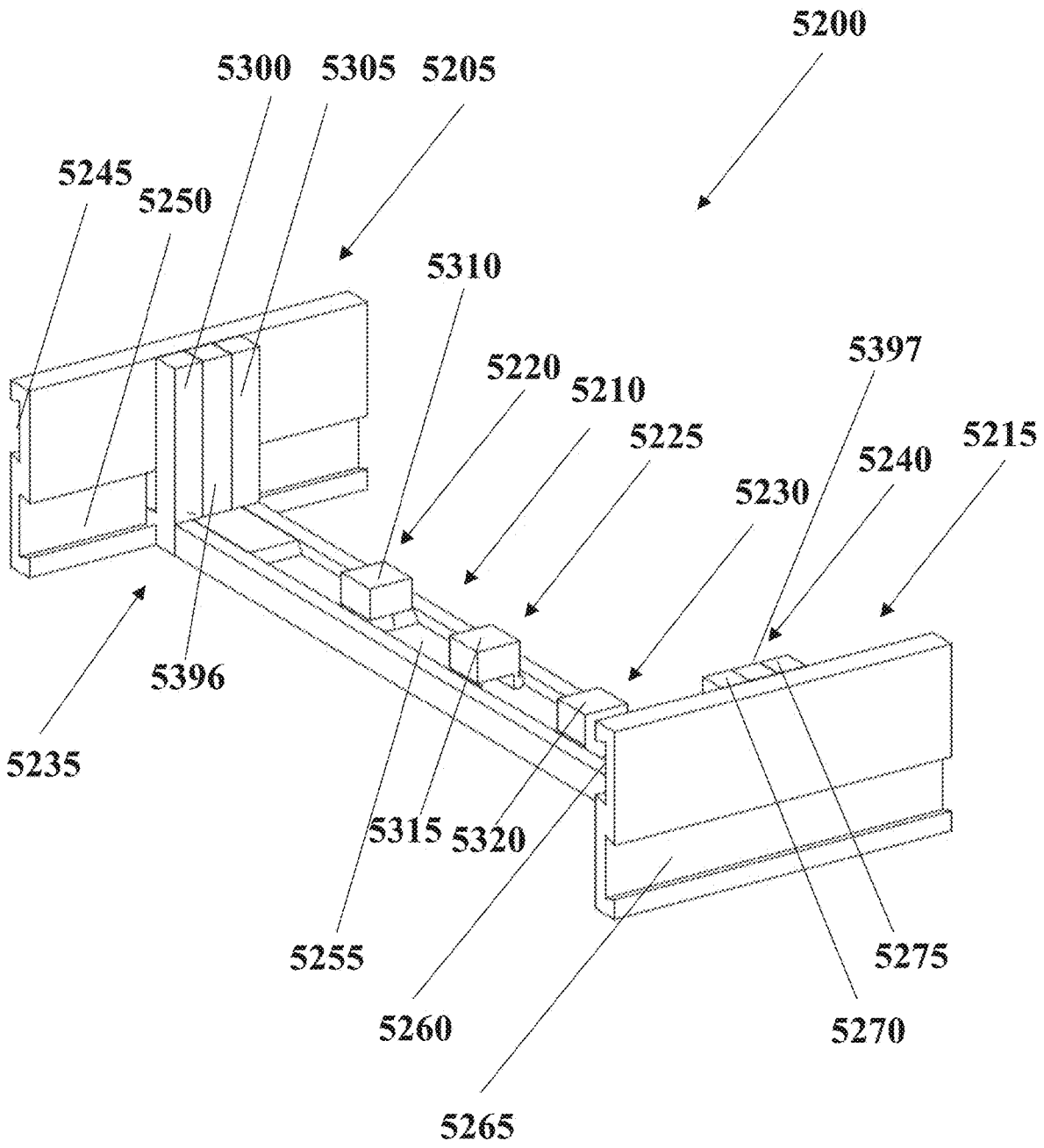
FIG. 54 is an illustration of an assembled view of another embodiment of a compartment divider assembly, shown in FIG. 53, and shows two slide couplers in the locked configuration holding a horizontal second divider.

FIG. 53 is an illustration of an exploded view of another embodiment of a compartment divider assembly. As shown in FIG. 53, which is similar to what is shown in FIG. 12, one embodiment of the compartment divider assembly 5200 may comprise: a first divider 5205, second divider 5210, third divider 5215, and two divider support groove assemblies 5235 and 5240, which, as detailed in FIG. 12, may comprise a first support groove and second support groove. FIG. 54 shows that after the male dovetail of the divider support groove assembly 5235 is engaged with the dovetail grooves 5250 of the first divider 5205, the first groove portion and the second groove portion may create a gap, which, as shown, may be used to receive an end of the second divider 5210. FIGS. 53 and 54 show how the assembly 5200 may be used to form a horizontal divider 5210 in a compartment that is held together by tension and/or friction. The parts are held firmly in place by the sliding dovetails. Although FIGS. 53 and 54 show the second divider 5210 to be perpendicular to dividers 5205, 5215 the second divider 5210 may be positioned in various angles. Specifically, the second divider 5210 may be greater than or less than 90° degrees, such that the angle between the first divider 5205 and second divider 5210 is acute or obtuse.

As shown in FIG. 53, one embodiment of a compartment divider assembly 5200 may also comprise one or more snap-on couplers 5225, at least one twist-on coupler 5220, and at least one slide-on spacer 5230. The dividers 5205, 5210, 5215, snap-on coupler 5225, twist-on coupler 5220, and slide-on spacer 5230, and divider support groove assemblies 5235, 5240 may be coupled together to form a compartment divider assembly 5200 (shown assembled in FIG. 54), which may be used to create a smaller sub-compartment within a drawer compartment. Each divider 5205, 5210, 5215 may have different heights as a single unit, triple unit, or higher unit of measurement. Further, each coupler 5220, 5225, 5230 and assembly 5235, 5240 may have male engagements at different heights to engage with dovetail grooves at different heights. Generally, the dovetail grooves 5245, 5250, 5255, 5260, 5265 and male engagements may be disposed horizontally along the dividers 5205, 5210, 5215, such that they may engage with each other at various heights and ways. The snap-on coupler 5225 may snap into one or more dovetail grooves 5245, 5250, 5255, 5260, 5265 on one or more dividers 5205, 5210, 5215, as shown in FIG. 54. The twist-on coupler 5220 and the slide-on spacer 5230 may engage with divider 5210. In this manner, the twist-on coupler 5220 may twist onto the dovetail groove 5255 and the slide-on spacer 5230 may slide into and along the length of the dovetail groove 5255, which may prevent the twist-on coupler 5220 and the slide-on spacer 5230 from being pulled perpendicularly away from divider 5210. One embodiment of the divider support groove assemblies 5235, 5240 may comprise a first support groove 5270 and second support groove 5275. FIG. 53 shows that the first support groove 5270 may engage with the second support groove 5275 by having the second planar face of the first support groove 5270 contact with the fourth planar face of the second support groove 5275. In this manner, the first dovetail portion 5280 and the second dovetail portion 5285 may slide with respect to one another at a sliding angle. The sliding, in turn, may cause the height or thickness of the prong to increase or decrease. Preferably, this allows the prong of the divider support groove assembly 5240 to engage with a dovetail groove 5260.

FIGS. 53 and 54 show that the divider support groove assemblies 5235, 5240 may engage with horizontal couplers 5396, 5397. The horizontal couplers 5396, 5397 may comprise coupler 5398 and slide portion 5399. The slide portion 5399 may be a male connector that may engage with groove 5255, which may be on horizontally situated divider 5210.

FIG. 54 is an illustration of an assembled view of another embodiment of a compartment divider assembly, shown in FIG. 53, and shows one or more snap-on couplers, at least one twist-on coupler, and at least one slide on spacer in the locked configuration. As shown in FIG. 54, one embodiment of a compartment divider assembly 5200 may comprise: one or more dividers 5205, 5210, 5215, one or more snap-on couplers 5225, at least one twist-on coupler 5220, at least one slide-on spacer 5230, and at least one divider support groove assembly 5235, 5240. FIG. 54 shows how the dividers 5205, 5210, 5215 with reciprocal dovetail grooves 5245, 5250, 5255, 5260, 5265 interconnect with one another. FIG. 54 also shows how the dividers 5205, 5210, 5215 of various lengths and heights may be interconnected in numerous different ways. The divider support grooves 5270, 5275, 5300, 5305, 5310, 5315, 5320 may also couple to the dovetail grooves 5245, 5250, 5255, 5260, 5265 of the dividers 5205, 5210, 5215 to create additional sub-compartments within the compartment divider assembly. FIGS. 53 and 54 show that the divider support groove assemblies 5235, 5240 may engage with horizontal couplers 5396, 5397. The horizontal couplers 5396, 5397 may comprise coupler and slide portion. The slide portion may be a male connector that may engage with groove 5255, which may be on horizontally situated divider 5210.

Figure 55:
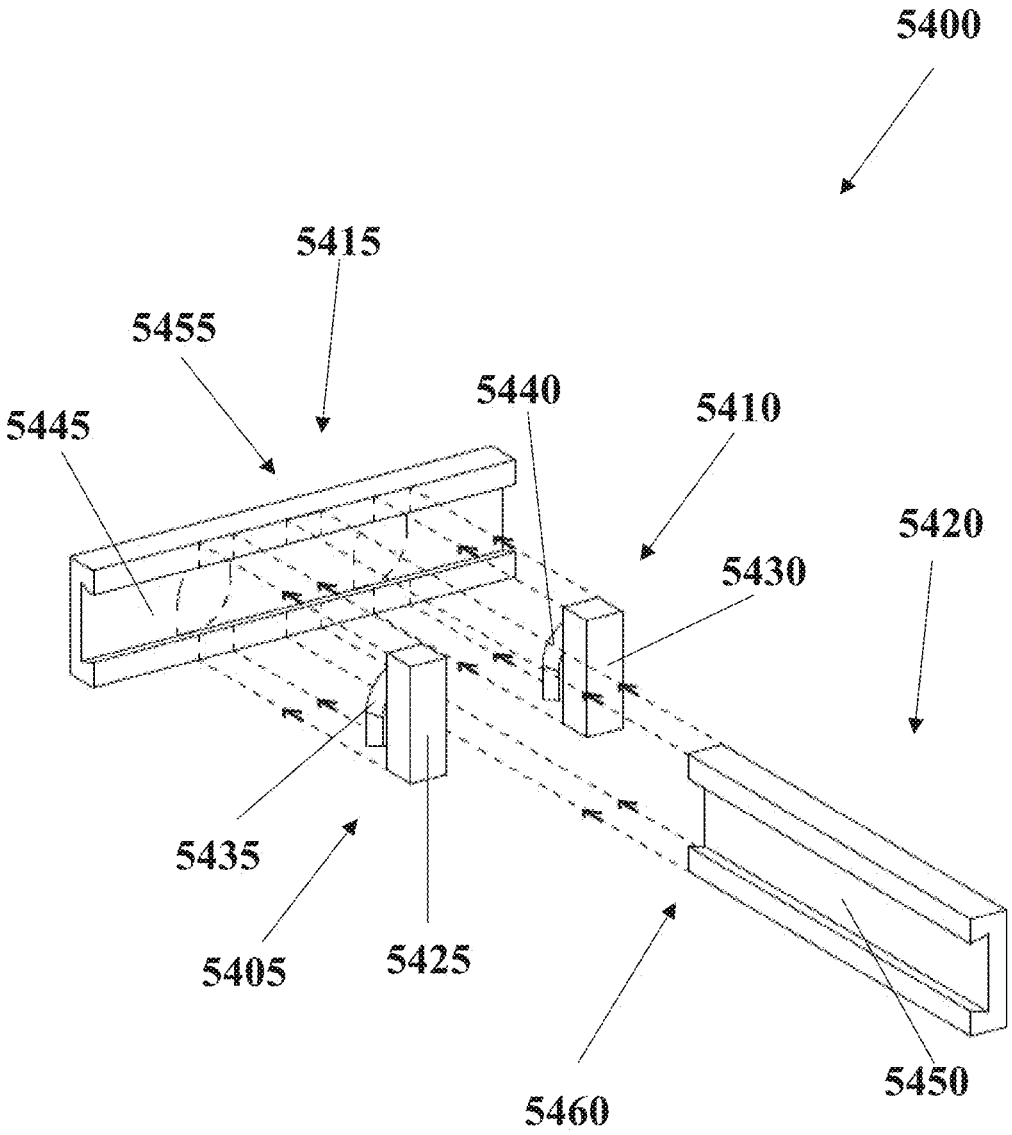
FIG. 55 is an illustration of an exploded view of another embodiment of a compartment divider assembly and shows a first twist-on coupler and a second twist-on coupler.

FIG. 55 is an illustration of an exploded view of another embodiment of a compartment divider assembly and shows a first twist-on coupler and a second twist-on coupler. As shown in FIG. 55, one embodiment of the compartment divider assembly 5400 may comprise: one or more twist-on couplers 5405, 5410 and one or more dividers 5415, 5420. The dividers may comprise a first divider 5415 and a second divider 5420. The twist-on couplers may comprise a first twist-on coupler 5405 and a second twist-on coupler 5410. Each twist-on coupler 5405, 5410 may comprise at least one support coupler and one or more prongs. Preferably, the first twist-on coupler 5405 may comprise a first support coupler 5425 and prong 5435. In this case the prong 5435 is a dovetailed twist protrusion. Further, the second twist-on coupler 5410 may comprise a second support coupler 5430 and prong 5440, which is also a dovetailed twist protrusion. The support couplers 5425, 5430 and the prongs 5435, 5440 of the twist-on couplers 5405, 5410 may be disposed in a generally vertical manner. The support couplers 5425, 5430 may be coupled or integral to the prongs 5435, 5440 such that at least one side of the support couplers 5425, 5430 may disposed in a substantially perpendicular or reasonably acute or obtuse angle with respect to at least one side of the prongs 5435, 5440, respectively.

One embodiment of the dividers 5415, 5420 may comprise one or more dovetail grooves 5445, 5450, respectively, that traverse or travel across a longitudinal path. Dovetail groove 5445 may allow divider 5415 to couple or removably attach to divider 5420 via prongs 5435, 5440. Additionally, the dovetail grooves 5445, 5450 may generally allow the dividers 5415, 5420 to couple or removably attach to additional dividers via one or more prongs. The prongs 5435, 5440 may couple or removably attach to the dovetail grooves 5445, 5450 of the dividers 5415, 5420 by twisting on. Preferably, the twist-on couplers 5405, 5410 may be rotated such that the prongs 5435, 5440 are generally horizontal in order to engage with the dovetail grooves 5445, 5450 of the dividers 5415, 5420, as shown in FIGS. 56-60. Further, additional twist-on couplers comprising prongs may engage with the dovetail grooves 5445, 5450. The dovetail grooves 5445, 5450 may be tapered or angled sided channels.

In this embodiment, the compartment divider assembly 5400 may be used to create a T connection with a mid-section or area 5455 of the first divider 5415 and an end portion 5460 of the second divider 5420 coupled, attached, or held in place by one or more twist-on couplers 5405, 5410.

Figure 56:
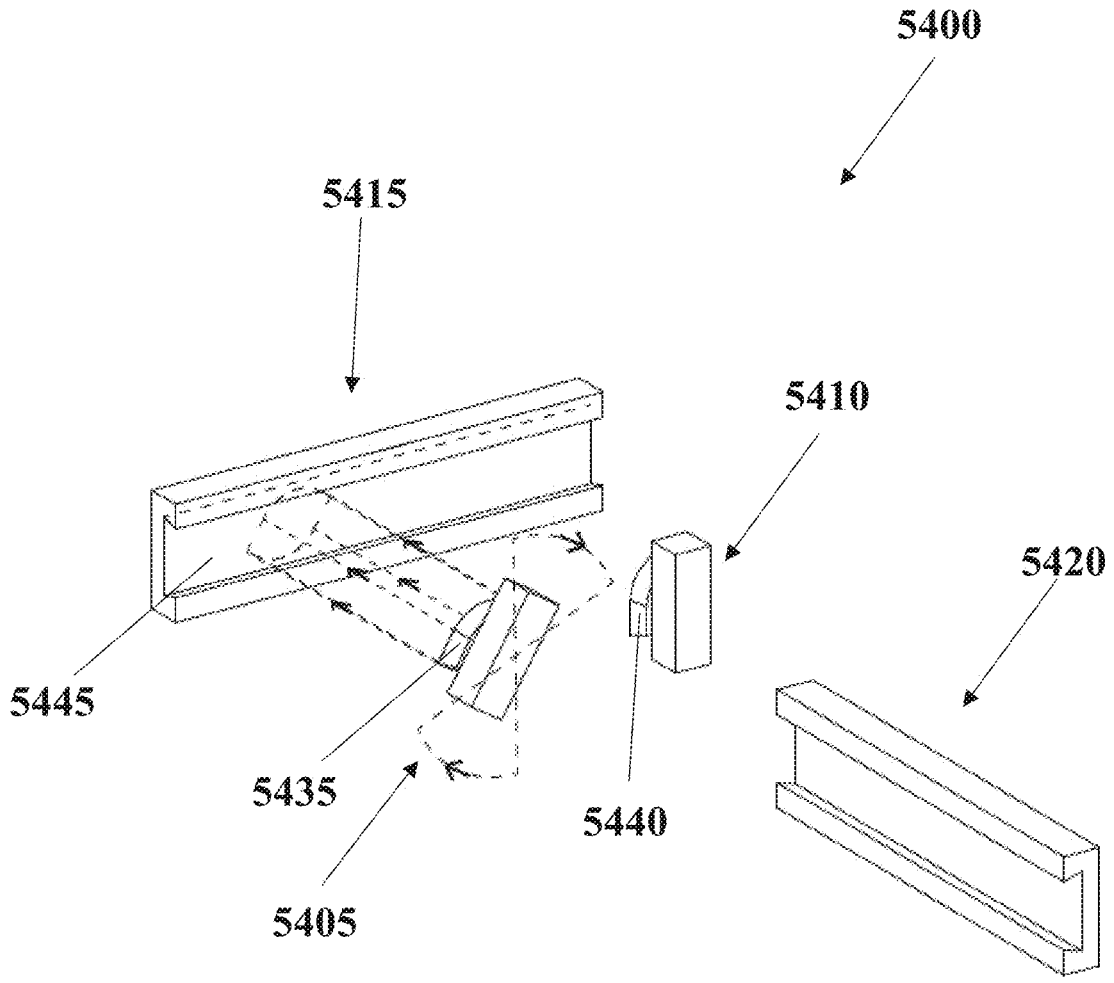
FIG. 56 is an illustration of an exploded view of another embodiment of a compartment divider assembly, shown in FIG. 55, and shows a first twist-on coupler twisted for engagement with a dovetail groove of a first divider.

FIG. 56 is an illustration of an exploded view of another embodiment of a compartment divider assembly, shown in FIG. 55, and shows a first twist-on coupler twisted for engagement with a dovetail groove of a first divider. As shown in FIG. 56, one embodiment of the compartment divider assembly 5400 may comprise: one or more twist-on couplers 5405, 5410 and one or more dividers 5415, 5420. The dividers may comprise a first divider 5415 and a second divider 5420. The twist-on couplers may comprise a first twist-on coupler 5405 and a second twist-on coupler 5410. The prongs 5435, 5440 of the twist-on couplers 5405, 5410 may couple or removably attach to the dovetail groove 5445 of the first dividers 5415 by twisting on. Preferably, the twist-on couplers 5405 may be rotated such that the prong 5435 is generally horizontal in order to engage with the dovetail groove 5445 of the first divider 5415. When the twist-on couplers 5405, 5410 are engaged with the dovetail groove 5445 of the first divider 5415, the first divider 5415 may be able to receive the second divider 5420 in order to form one or more sub-compartments spaces for organization.

Figure 57:
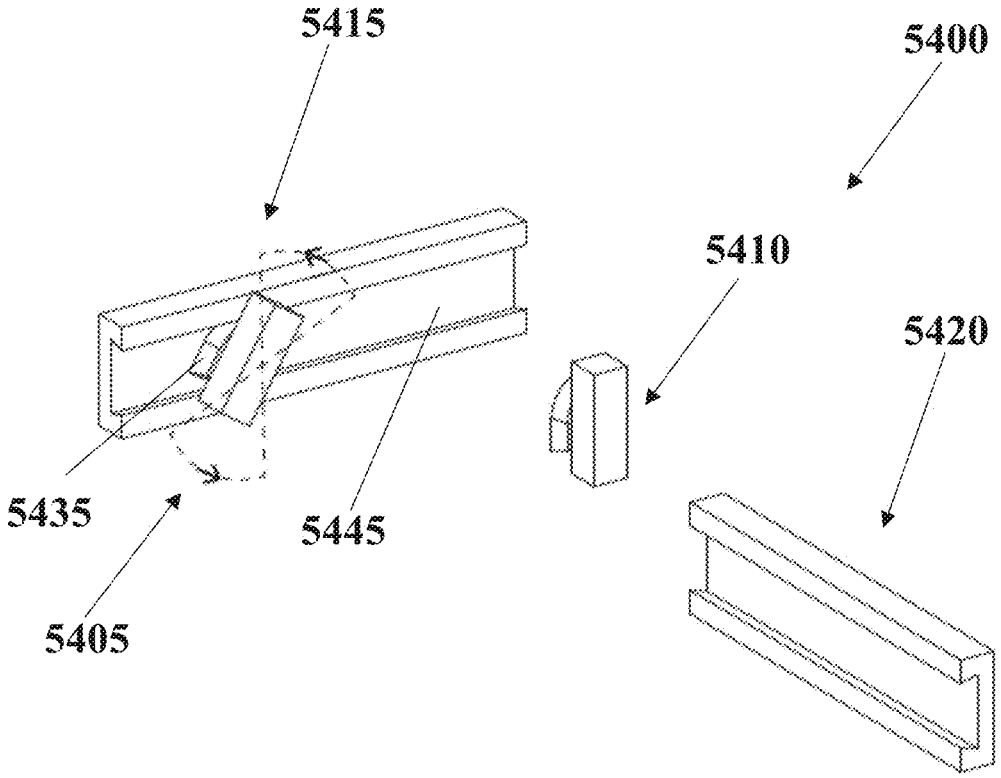
FIG. 57 is an illustration of an exploded view of another embodiment of a compartment divider assembly, shown in FIG. 55, and shows a first twist-on coupler engaging with a dovetail groove of a first divider.
Figure 58:
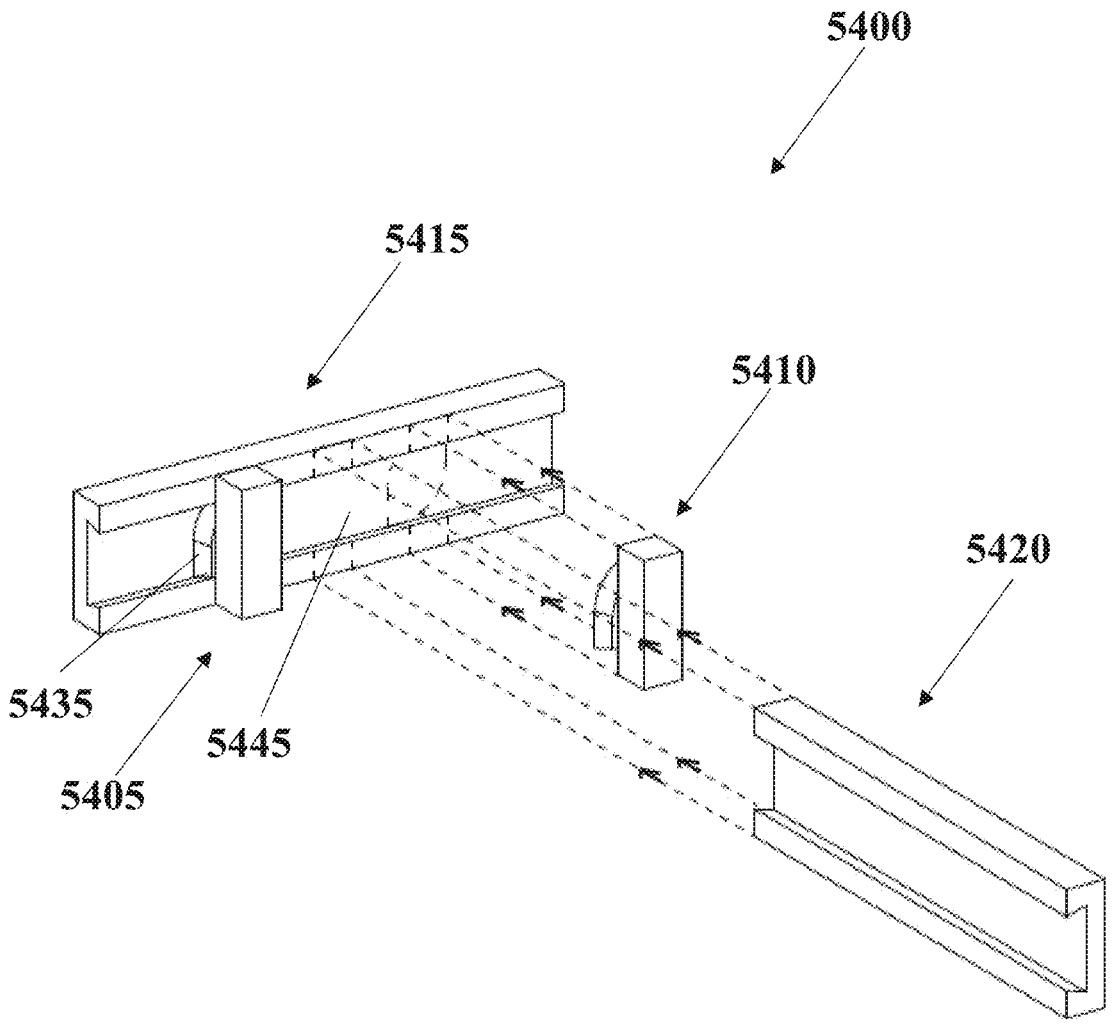
FIG. 58 is an illustration of an exploded view of another embodiment of a compartment divider assembly, shown in FIG. 55, and shows a first twist-on coupler engaged with a dovetail groove of a first divider in a locked configuration.

FIG. 57 is an illustration of an exploded view of another embodiment of a compartment divider assembly, shown in FIG. 55, and shows a first twist-on coupler engaging with a dovetail groove of a first divider. As shown in FIG. 57, one embodiment of the compartment divider assembly 5400 may comprise: one or more twist-on couplers 5405, 5410 and one or more dividers 5415, 5420. The dividers may comprise a first divider 5415 and a second divider 5420. The twist-on couplers may comprise a first twist-on coupler 5405 and a second twist-on coupler 5410. FIG. 57 shows that the prong 5435 of the first twist-on coupler 5405 may couple or removably attach to the dovetail groove 5445 of the first divider 5415 by twisting on. In particular, the first twist-on coupler 5405 may be rotated such that the prong 5435 is generally horizontal in order to engage with the dovetail groove 5445 of the first divider 5415. Once the first twist-on coupler 5405 is engaged with the dovetail groove 5445 of the first divider 5420, the first twist-on coupler 5405 may be rotated back to a generally vertical and locked configuration, as shown in FIG. 58. As a result, the prong 5435 of the first twist-on coupler 5405 preferably engages with the inner sides of the dovetail groove 5445 of the first divider 5415 such that the prong 5435 is secured and flushed within the dovetail groove 5445.

FIG. 58 is an illustration of an exploded view of another embodiment of a compartment divider assembly, shown in FIG. 55, and shows a first twist-on coupler engaged with a dovetail groove of a first divider in a locked configuration. As shown in FIG. 58, one embodiment of the compartment divider assembly 5400 may comprise: one or more twist-on couplers 5405, 5410 and one or more dividers 5415, 5420. The dividers may comprise a first divider 5415 and a second divider 5420. The twist-on couplers may comprise a first twist-on coupler 5405 and a second twist-on coupler 5410. FIG. 58 shows the prong 5435 of the first twist-on coupler 4805 in a generally vertical and locked configuration with the dovetail groove 5445 of the first divider 5415. As a result, the prong 5435 preferably engages with the inner sides of dovetail groove 5445 such that the prong 5435 is secured and flushed within the dovetail groove 5445.

Figure 59:
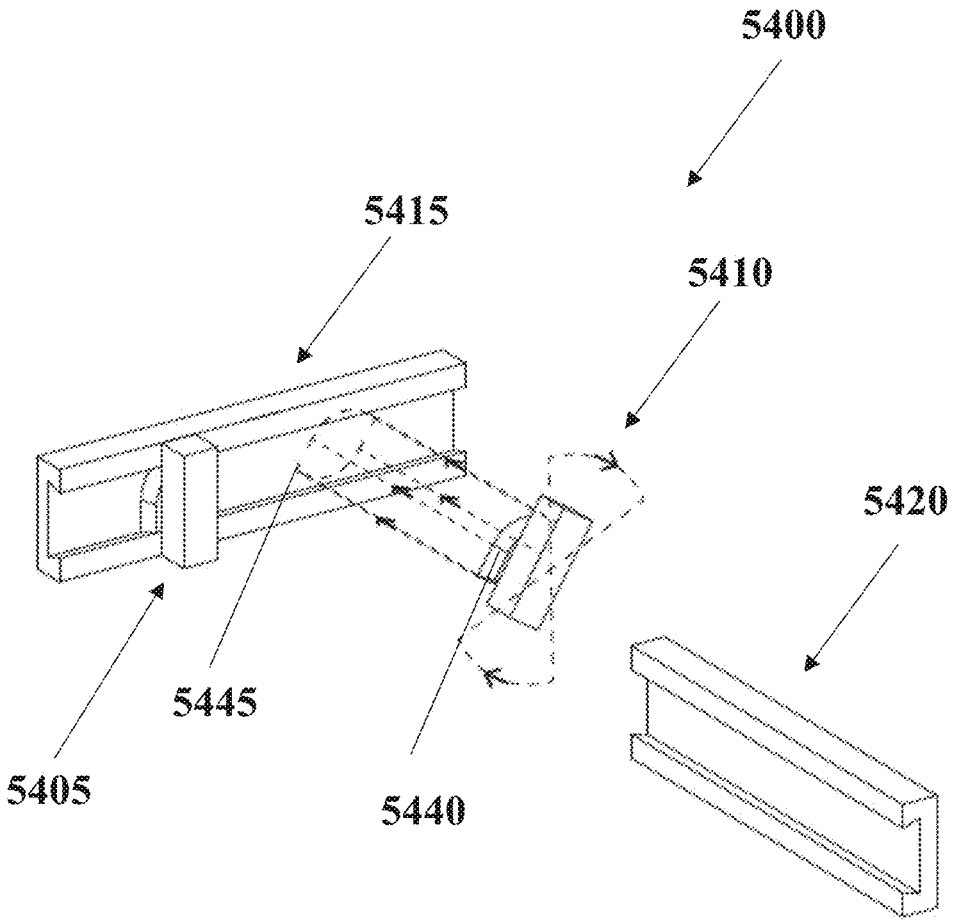
FIG. 59 is an illustration of an exploded view of another embodiment of a compartment divider assembly, shown in FIG. 55, and shows a second twist-on coupler twisted for engagement with a dovetail groove of a first divider.

FIG. 59 is an illustration of an exploded view of another embodiment of a compartment divider assembly, shown in FIG. 55, and shows a second twist-on coupler twisted for engagement with a dovetail groove of a first divider. As shown in FIG. 59, one embodiment of the compartment divider assembly 5400 may comprise: one or more twist-on couplers 5405, 5410 and one or more dividers 5415, 5420. The dividers may comprise a first divider 5415 and a second divider 5420. The twist-on couplers may comprise a first twist-on coupler 5405 and a second twist-on coupler 5410. FIG. 59 shows the prong 5440 of the second twist-on coupler 5410 may couple or removably attach to the dovetail groove 5445 of the first divider 5415. Specifically, the second twist-on coupler 5410 may be rotated such that the prong 5440 is generally horizontal in order to engage with the dovetail groove 5445 of the first divider 5415. When the second twist-on coupler 5410 is engaged with the dovetail groove 5445 of the first divider 5415, the first divider 5415 may be configured to receive the second divider 5420 in order to form one or more sub-compartments spaces for organization.

Figure 60:
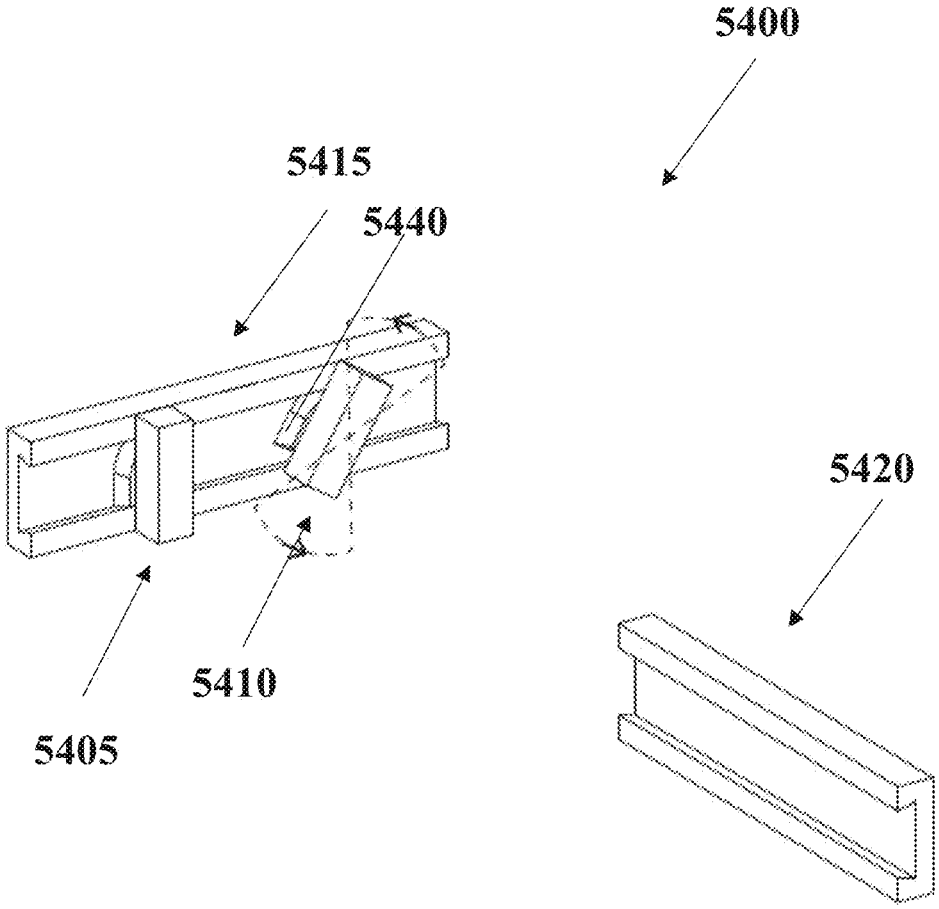
FIG. 60 is an illustration of an exploded view of another embodiment of a compartment divider assembly, shown in FIG. 55, and shows a second twist-on coupler engaging with a dovetail groove of a first divider.
Figure 61:
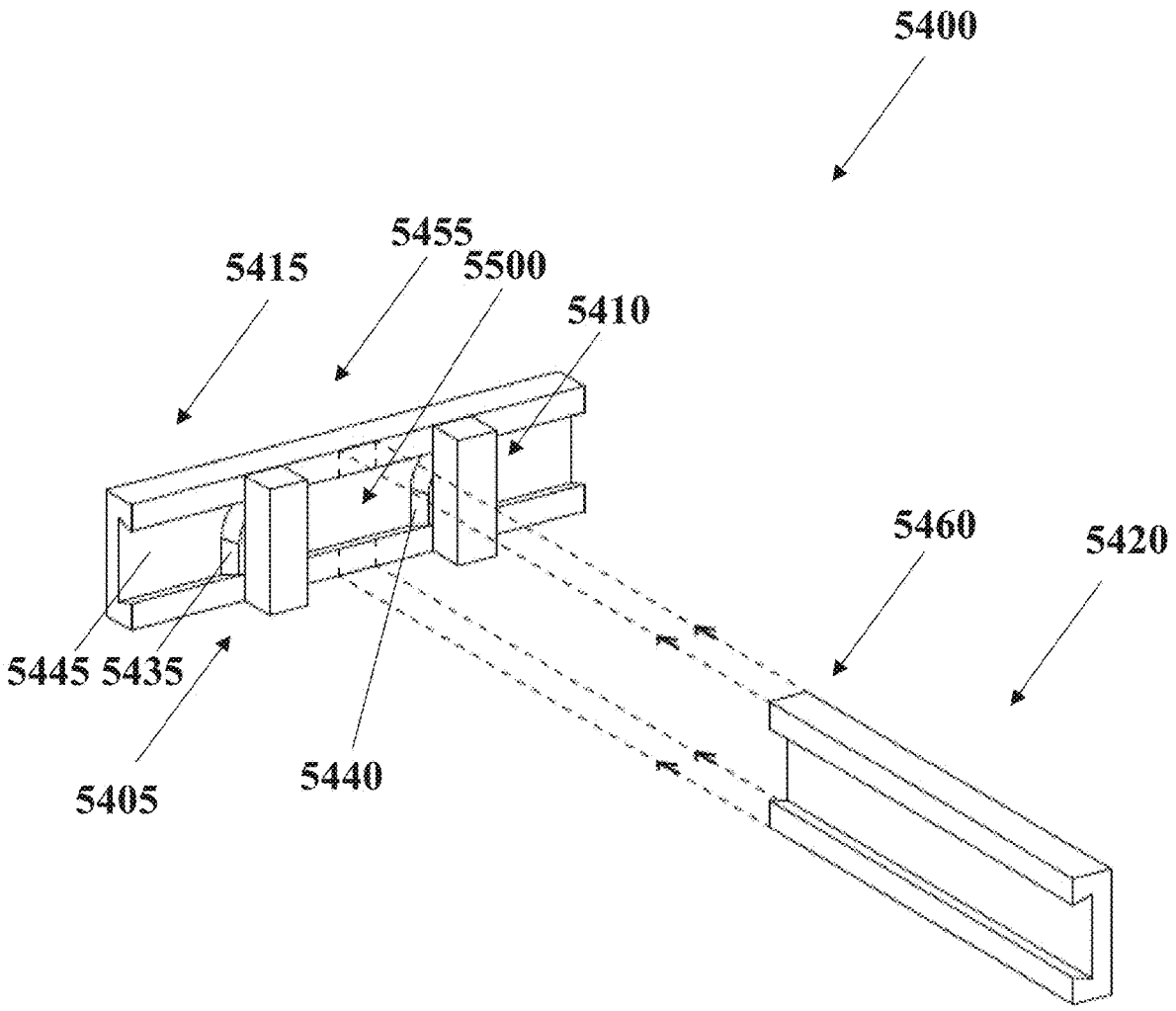
FIG. 61 is an illustration of an exploded view of another embodiment of a compartment divider assembly, shown in FIG. 55, and shows a second twist-on coupler engaged with a dovetail groove of a first divider in a locked configuration.

FIG. 60 is an illustration of an exploded view of another embodiment of a compartment divider assembly, shown in FIG. 55, and shows a second twist-on coupler engaging with a dovetail groove of a first divider. As shown in FIG. 60, one embodiment of the compartment divider assembly 5400 may comprise: one or more twist-on couplers 5405, 5410 and one or more dividers 5415, 5420. The dividers may comprise a first divider 5415 and a second divider 5420. The twist-on couplers may comprise a first twist-on coupler 5405 and a second twist-on coupler 5410. FIG. 60 shows that the prong 5440 of the second twist-on coupler 5410 may couple or removably attach to the dovetail groove 5445 of the first divider 5415. In particular, the second twist-on coupler 5410 may be rotated such that the prong 5440 of the second twist-on coupler 5410 may be generally horizontal in order to engage with the dovetail groove 5445 of the first divider 5415. Once the second twist-on coupler 5410 is engaged with the dovetail groove 5445 of the first divider 5415, the second twist-on coupler 5410 may be rotated back to a generally vertical and locked configuration, as shown in FIG. 61. As a result, the prong 5440 of the second twist-on coupler 5410 preferably engages with the inner sides of the dovetail groove 5445 of the first divider 5415 such that the prong 5440 is secured and flushed within the dovetail groove 5445.

Figure 62:
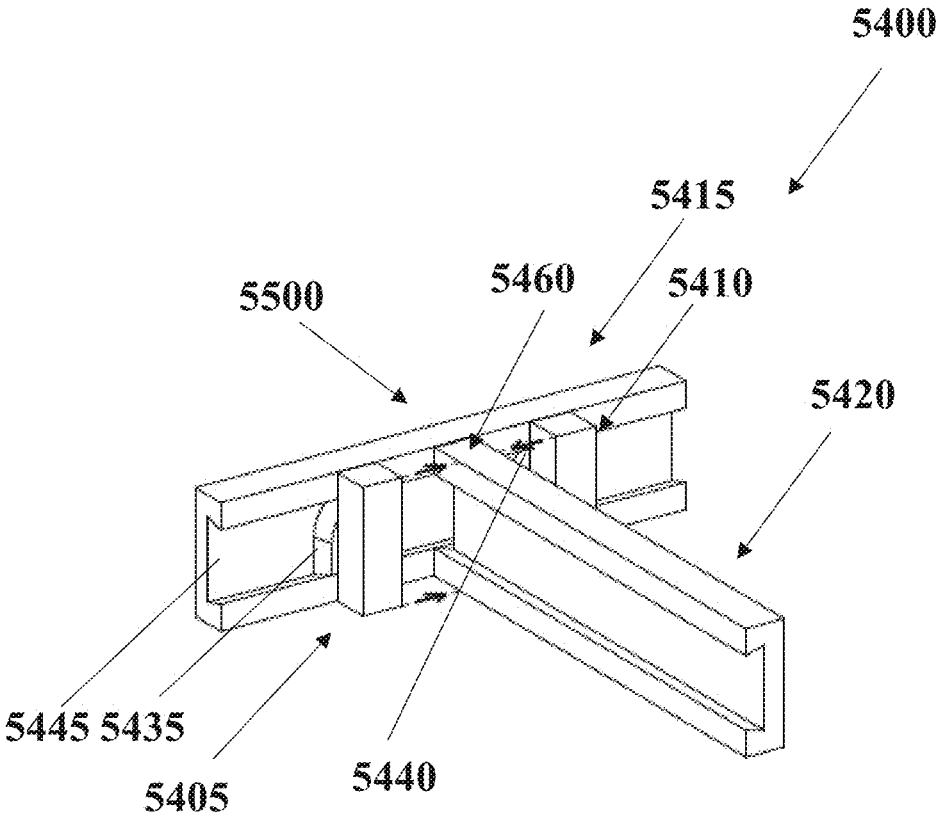
FIG. 62 is an illustration of another embodiment of a compartment divider assembly, shown in FIG. 55, and shows a second divider engaged with a dovetail groove for a first divider.

FIG. 61 is an illustration of an exploded view of another embodiment of a compartment divider assembly, shown in FIG. 55, and shows a second twist-on coupler engaged with a dovetail groove of a first divider in a locked configuration. As shown in FIG. 61, one embodiment of the compartment divider assembly 5400 may comprise: one or more twist-on couplers 5405, 5410 and one or more dividers 5415, 5420. The dividers may comprise a first divider 5415 and a second divider 5420. The twist-on couplers may comprise a first twist-on coupler 5405 and a second twist-on coupler 5410. FIG. 61 further shows that when the prong 5435 of the first twist-on coupler 5405 and the prong 5440 of the second twist-on coupler 5410 are engaged with the dovetail groove 5445 of the first divider 5415, the compartment divider assembly 5400 may be used to create a T connection, as shown in FIG. 62, where an end portion 5460 of the second divider 5420 couples, attaches, or is held in place at a mid-section or area 5455 of the first divider 5415. Preferably, when the prong 5435 of the first twist-on coupler 5405 and the prong 5440 of the second twist-on coupler 5410 are engaged with dovetail groove 5445 of the first divider 5415, a gap 5500 may form between the first twist-on coupler 5405 and the second twist-on coupler 5410. The gap 5500 may be preferably dimensioned to fittingly receive an end portion 5460 of the second divider 5420.

FIG. 62 is an illustration of another embodiment of a compartment divider assembly, shown in FIG. 56, and shows a second divider engaged with a dovetail groove for a first divider. As shown in FIG. 62, one embodiment of the compartment divider assembly 5400 may comprise: one or more twist-on couplers 5405, 5410 and one or more dividers 5415, 5420. The dividers may comprise a first divider 5415 and a second divider 5420. The twist-on couplers may comprise a first twist-on coupler 5405 and a second twist-on coupler 5410. FIG. 62 shows that after the prong 5435 of the first twist-on coupler 5405 and the prong 5440 of the second twist-on coupler 5410 are engaged with the dovetail groove 5445 of the first divider 5415, the twist-on couplers 5405, 5410 may create a gap 5500, which, as shown, may be used to receive an end portion 5460 of the second divider 5420. Once the end portion 5460 of the second divider 5420 is coupled to the first divider 5415, the twist-on couplers 5405, 5410 may slide along the dovetail groove 5445 of the first divider 5415 in order to secure the second divider 5420.

Figure 63:
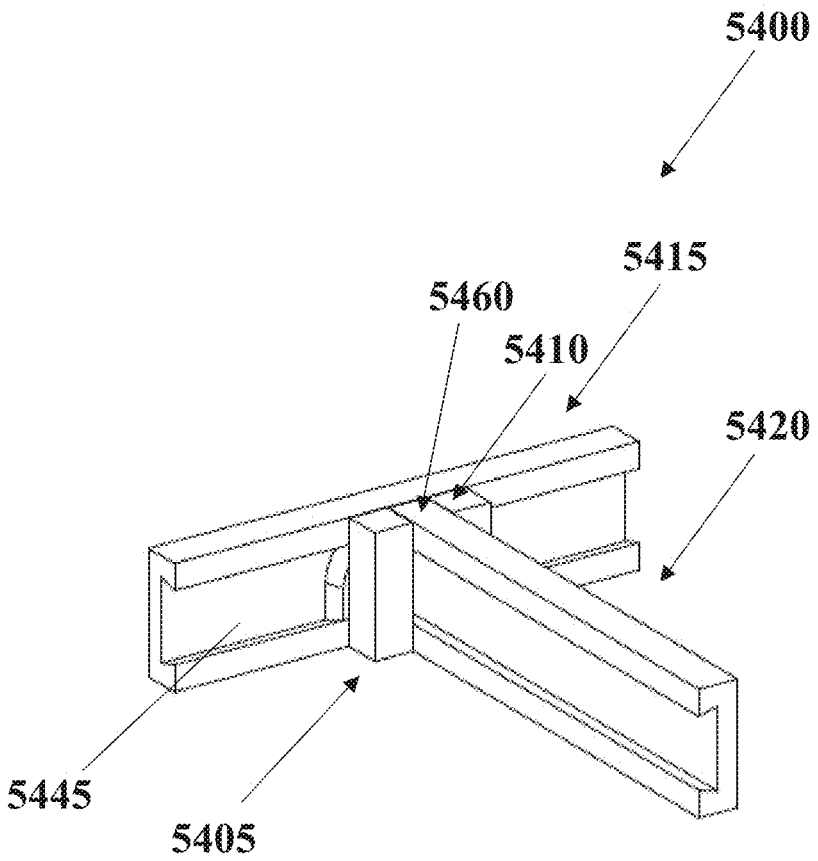
FIG. 63 is an illustration of an assembled view of another embodiment of a compartment divider assembly, shown in FIG. 55, and shows the compartment divider assembly in a locked configuration.

FIG. 63 is an illustration of an assembled view of another embodiment of a compartment divider assembly, shown in FIG. 55, and shows the compartment divider assembly in a locked configuration. As shown in FIG. 63, one embodiment of the compartment divider assembly 5400 may comprise: one or more twist-on couplers 5405, 5410 and one or more dividers 5415, 5420. The dividers may comprise a first divider 5415 and a second divider 5420. The twist-on couplers may comprise a first twist-on coupler 5405 and a second twist-on coupler 5410. FIG. 63 shows that once the end portion 5460 of the second divider 5420 is coupled to the first divider 5415, the twist-on couplers 5405, 5410 may slide along the length of the dovetail groove 5445 of the first divider 5415 in order to secure the second divider 5420. FIG. 63 shows how the divider compartment assembly 5400 may be used to form a divider in a compartment that is held together by tension and/or friction. The parts may be held firmly in place by the twist prongs. Although FIG. 63 shows the second divider 5420 to be perpendicular to the first divider 5415, the second divider 5420 may be positioned in various angles.

Figure 64:
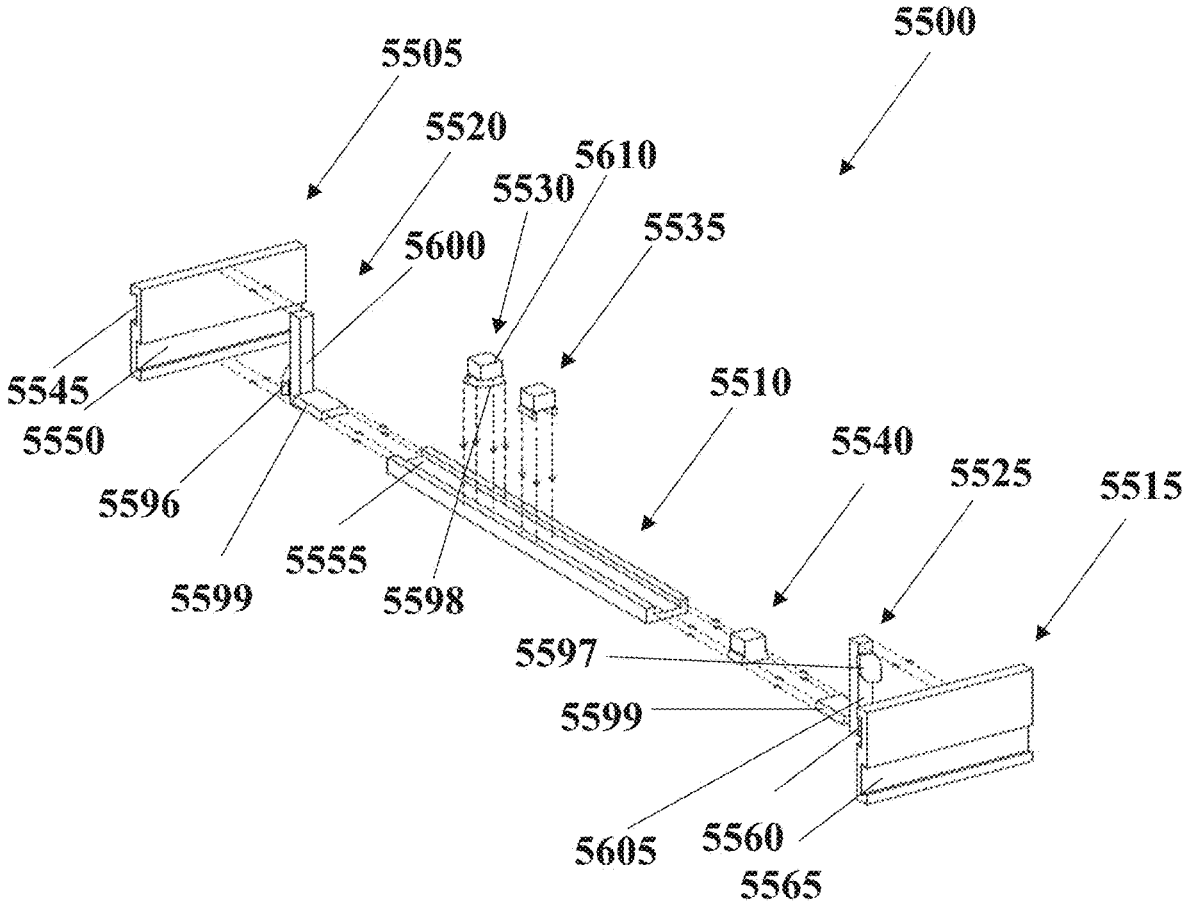
FIG. 64 is an illustration of an exploded view of another embodiment of a compartment divider assembly with a twist-on connector that engages a horizontal second divider.
Figure 65:
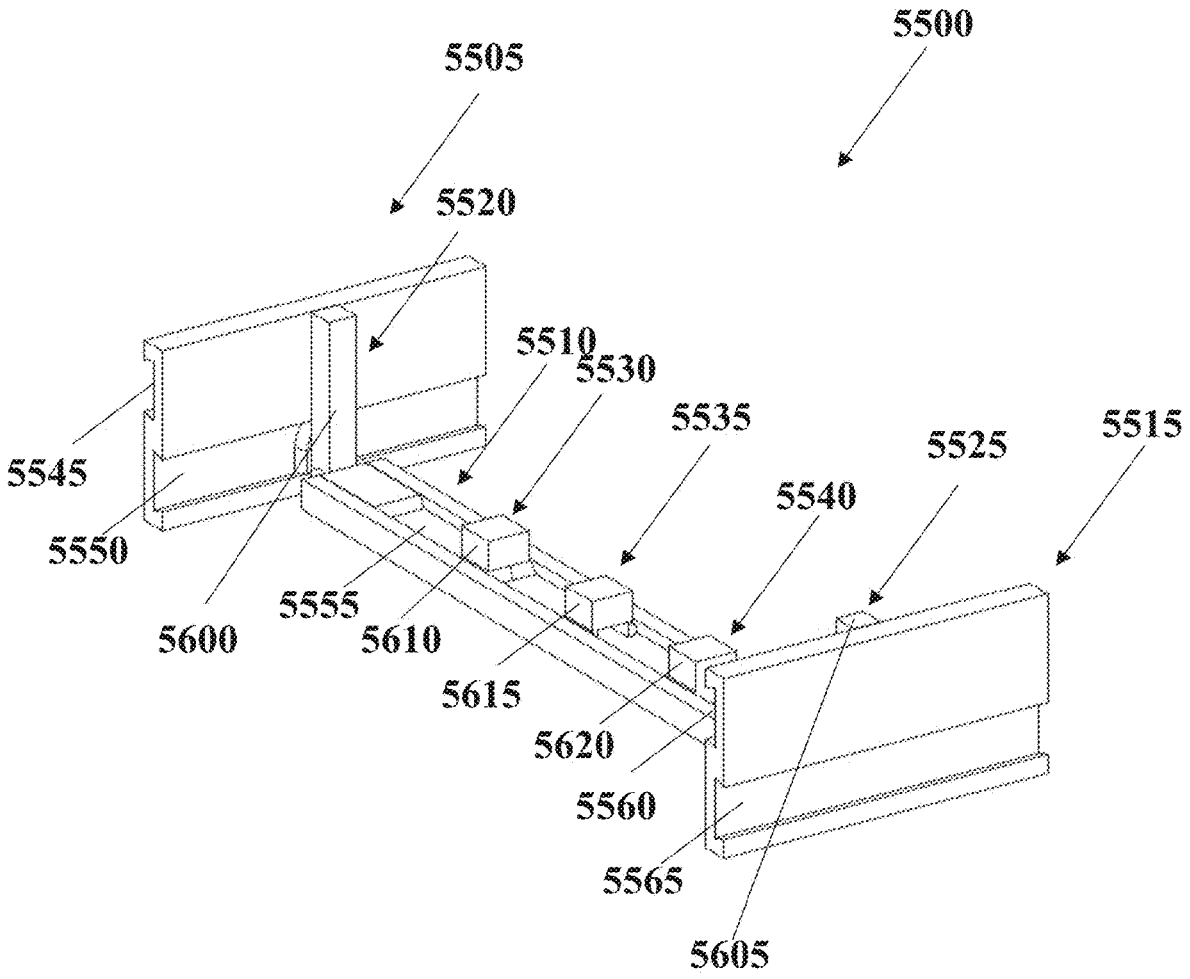
FIG. 65 is an illustration of an assembled view of another embodiment of a compartment divider assembly, shown FIG. 64, and shows a twist-on connector that is engaged to a horizontal second divider.

FIG. 64 is an illustration of an exploded view of another embodiment of a compartment divider assembly with one or more snap-on, twist-on, and slide-on couplers. As shown in FIG. 64, one embodiment of a compartment divider assembly 5500 may comprise: one or more dividers 5505, 5510, 5515, one or more twist-on couplers 5520, 5525, 5530, at least one snap-on coupler 5535, and at least one slide-on coupler 5540. The dividers 5505, 5510, 5515, twist-on couplers 5520, 5525, 5530, snap-on coupler 5535, and slide-on coupler 5540 may be coupled together to form a compartment divider assembly 5500 (shown assembled in FIG. 65), which may be used to create a smaller sub-compartment within a drawer compartment. Each divider 5505, 5510, 5515 may have different heights as a single unit, triple unit, or higher unit of measurement. Generally, the dovetail grooves and prongs may be disclosed horizontally along the dividers, such that they may engage each other at various heights and ways. The twist-on couplers 5520, 5525, 5530 may twist into one or more dovetails grooves 5545, 5550, 5555, 5560, 5565 on one or more dividers 5505, 5510, 5515, as shown in FIG. 65. Similarly, the snap-on coupler 5535 may snap into one or more dovetail grooves 5545, 5550, 5555, 5560, 5565 on one or more dividers 5505, 5510, 5515, as shown in FIG. 64. The slide-on coupler 5540 may engage with divider 5510. In this manner, the slide-on coupler 5540 may slide into and along the length of the dovetail groove 5555, which may prevent the slide-on coupler 5540 from being pulled perpendicularly away from divider 5510. The twist on couplers 5520, 5525, 5530 may be slanted or dovetailed so they matingly fit with the grooves in order to lock them into position. Twist couplers 5520, 5525, 5530 may comprise support couplers 5600, 5605, 5610, twist prongs 5596, 5597, 5598, and male connectors 5599. The male connectors 5599 may slideably engage with dovetail groove 5555 and the twist prongs 5596, 5597 may engage with grooves 5550 and 5560 to form a compartment divider assembly.

FIG. 65 is an illustration of an assembled view of another embodiment of a compartment divider assembly, shown FIG. 64, and shows one or more snap-on, twist-on, and slide-on couplers in a locked configuration. As shown in FIG. 64, one embodiment of a compartment divider assembly 5500 may comprise: one or more dividers 5505, 5510, 5515, one or more twist-on couplers 5520, 5525, 5530, at least one snap-on coupler 5535, and at least one slide-on coupler 5540. FIG. 65 shows how the dividers 5505, 5510, 5515 with reciprocal dovetail grooves 5545, 5550, 5555, 5560, 5565 interconnect with one another. FIG. 64 also shows how the dividers 5505, 5510, 5515 of various lengths and heights may be interconnected in numerous different ways. The support couplers 5600, 5605, 5610, 5615, 5620 may also be used to couple to the dovetail grooves 5545, 5550, 5555, 5560, 5565 of the dividers 5505, 5510, 5515 to create additional sub-compartments within the compartment divider assembly. FIGS. 64 and 65 shows how twist couplers 5520, 5530 may engage with both the first divider 5505 and second divider 5510.

Figure 66A:
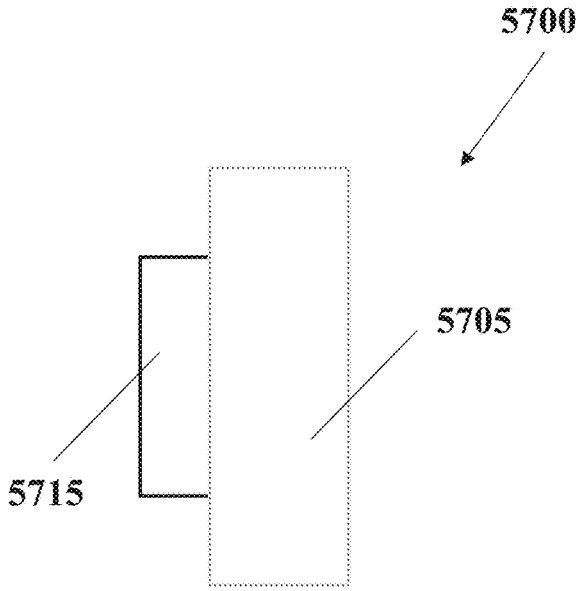
FIGS. 66A through 66C are illustrations of one embodiment of a held-on coupler of the compartment divider assembly.
Figure 66B:
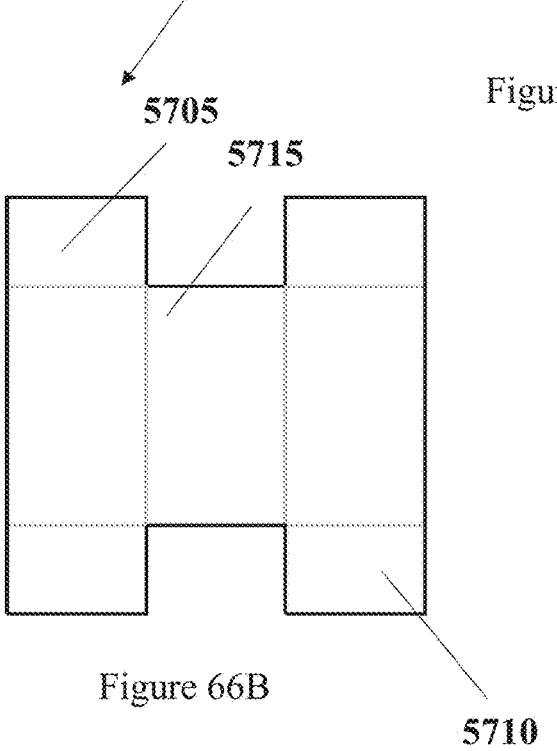
Figure 66C:
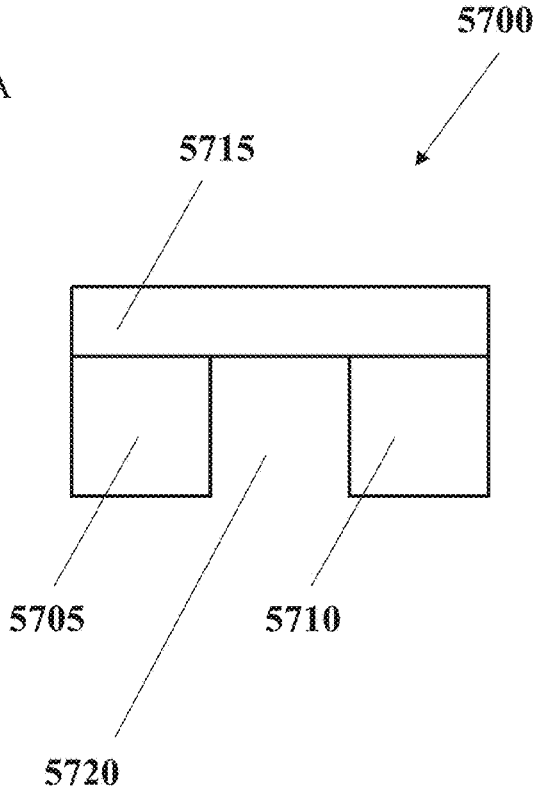
Figure 70:
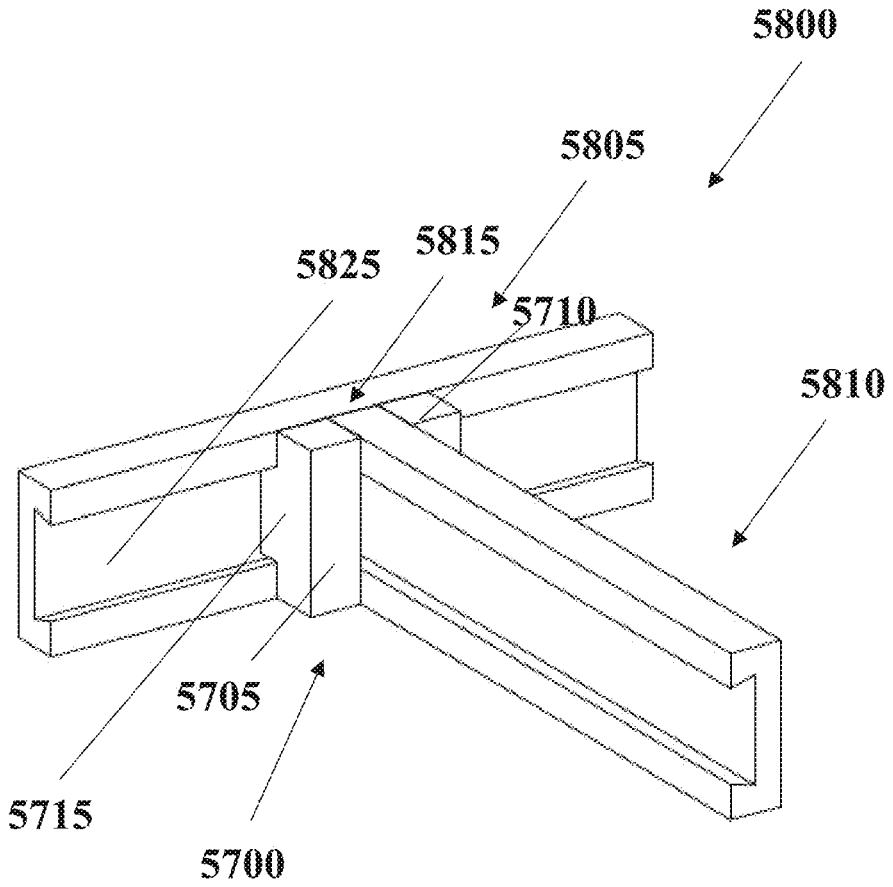
FIG. 70 is an illustration of an assembled view of another embodiment of the compartment divider assembly, shown in FIG. 68, and shows the compartment divider assembly in a locked configuration.

FIGS. 66A through 66C are illustrations of one embodiment of a held-on coupler of the compartment divider assembly. FIG. 66A is a right side elevational view of the held-on coupler 5700. FIG. 66B is an elevational front view of the held-on coupler 5700. FIG. 66C is a top plan view of the held-on coupler 5700. As shown in FIGS. 66A through 66C, one embodiment of the held-on coupler 5700 may comprise at least two coupler supports 5705, 5710 and one or more prongs 5715. In this case the prong is a block protrusion. The coupler supports 5705, 5710 may be disposed in a generally vertical manner. A prong 5715 may be disposed in a generally horizontal manner. The coupler supports 5705, 5710 may be coupled or integral to the prong 5715 such that at least one side of the coupler supports 5705, 5710 may be disposed in a substantially perpendicular or reasonably acute or obtuse angle with respect to at least one side of the prong 5715. Further, coupler support 5705 may be parallel to coupler support 5710 so as to engage with a second divider coupler. The coupler supports 5705, 5710 may be positioned in such a way as to form a gap 5720 between coupler support 5705 and coupler support 5710. The gap 5720 may then be preferably dimensioned to fittingly receive an end portion of a divider, as shown in FIG. 70.

Figure 67:
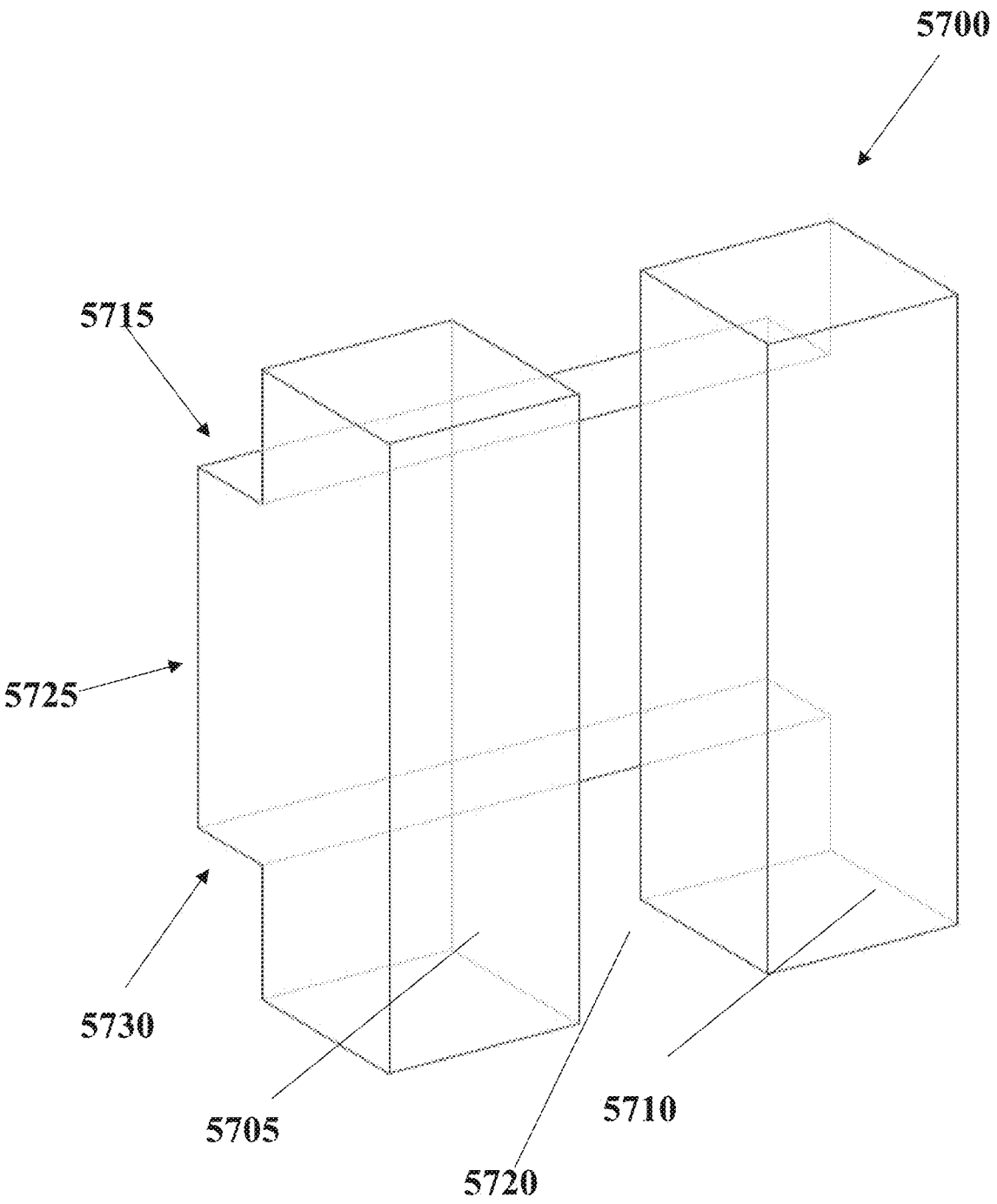
FIG. 67 is an illustration of a front perspective view of one embodiment of a held-on coupler.

FIG. 67 is an illustration of a front perspective view of one embodiment of a held-on coupler. As shown in FIG. 67, one embodiment of the held-on coupler 5700 may comprise at least two coupler supports 5705, 5710 and one or more prongs 5715. The coupler supports 5705, 5710 may be may be coupled or integral to the prong 5715. Further, coupler support 5705 may be parallel to coupler support 5710. The coupler supports 5705, 5710 may be positioned in such a way as to form a gap 5720 between coupler support 5705 and coupler support 5710. The gap 5720 may then be preferably dimensioned to fittingly receive an end portion of a divider, as shown in FIG. 70.

Importantly. FIG. 67 shows that the prong 5715 may comprise one or more planar faces 5725, 5730. The planar faces 5725, 5730 of the prong 5715 may allow the prong 5715 to engage with one or more dovetail grooves on one or more dividers, as shown in FIGS. 69 and 70.

Figure 68:
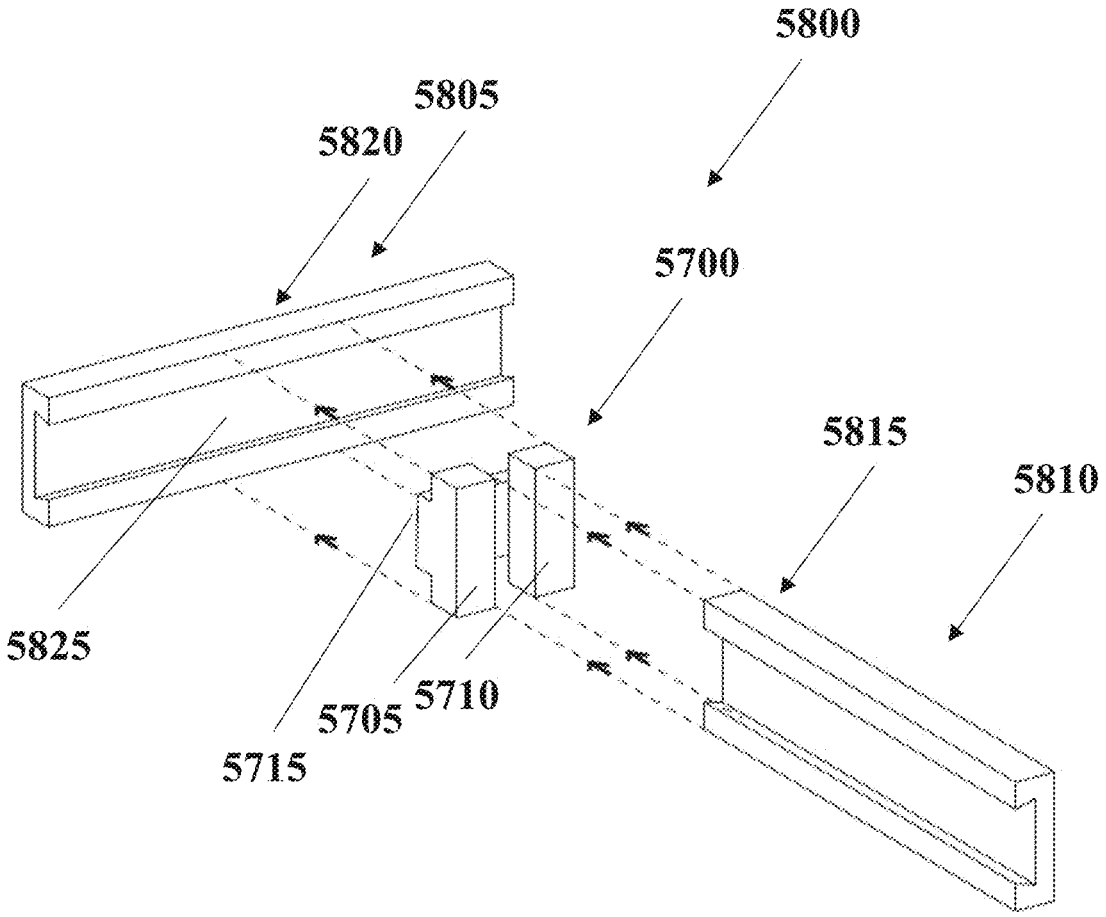
FIG. 68 is an illustration of an exploded view of another embodiment of the compartment divider assembly with held-on couplers.

FIG. 68 is an illustration of an exploded view of another embodiment of the compartment divider assembly and shows a held-on coupler in the release configuration. As shown in FIG. 68, one embodiment of the compartment divider assembly 5800 may comprise: one or more held-on couplers 5700, a first divider 5805, and a second divider 5810. The held-on coupler 5700 may further comprise at least two coupler supports 5705, 5710 and one or more prongs 5715. The coupler supports 5705, 5710 may be disposed in a generally vertical manner whereas the prong 5715 may be disposed in a generally horizontal manner. FIG. 68 further shows that the compartment divider assembly 5800 may be used to create a T connection where an end 5815 of the second divider 5810 couples, attaches, or is held in place at a mid-section or area 5820 of the first divider 5805. The prong 5715 of the held-on coupler 5700 may be preferably adapted to fit within the edges of dovetail groove 5825 to receive an end 5815 of the second divider 5810.

Figure 69:
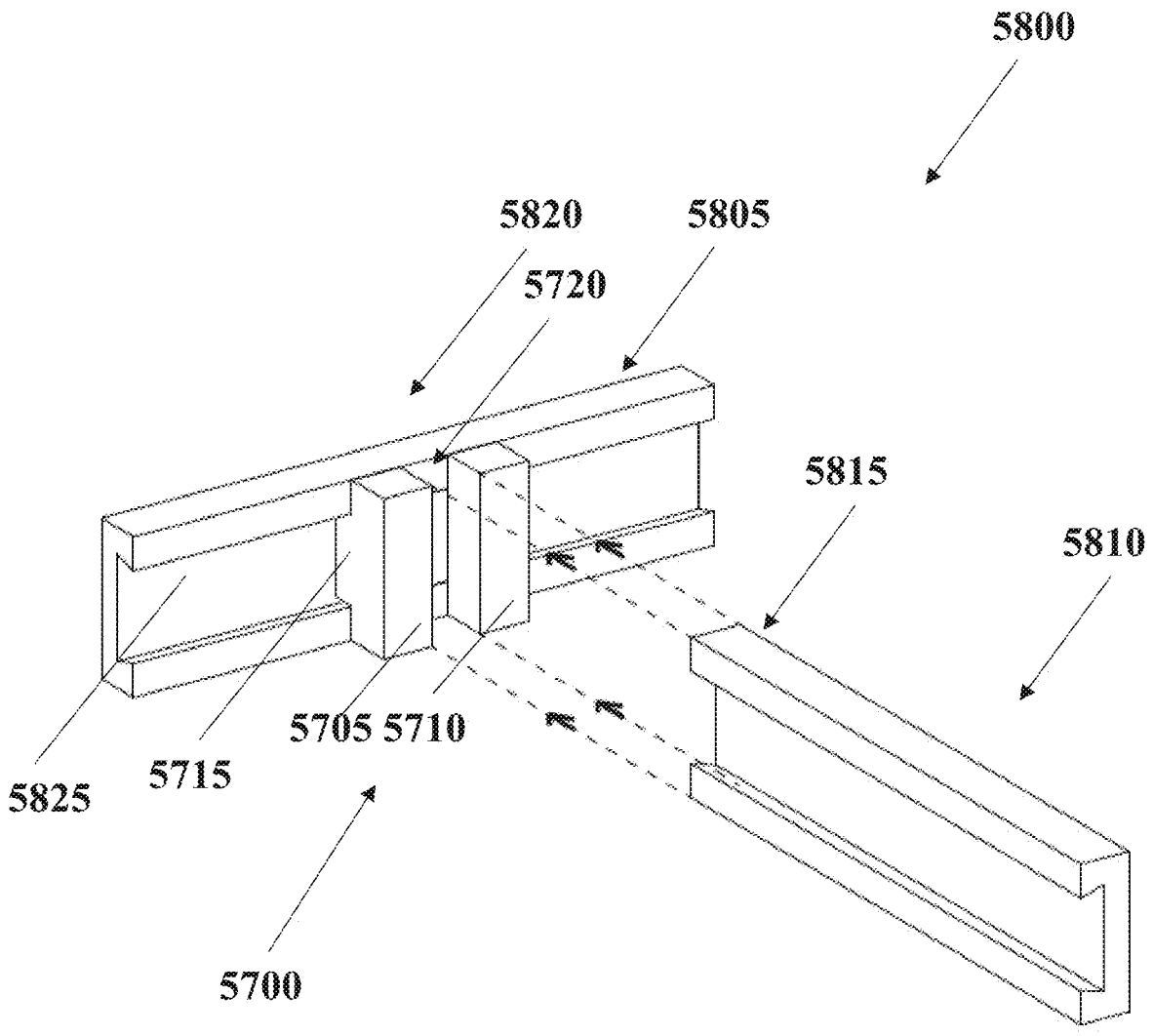
FIG. 69 is an illustration of a partially exploded view of another embodiment of the compartment divider assembly, shown in FIG. 68, and shows the held-on couplers engaged with a first divider.

FIG. 69 is an illustration of a partially exploded view of another embodiment of the compartment divider assembly, shown in FIG. 68, and shows a held-on coupler engaged with a first divider. As shown in FIG. 69, one embodiment of the compartment divider assembly 5800 may comprise: one or more held-on couplers 5700, a first divider 5805, and a second divider 5810. The held-on coupler 5700 may further comprise at least two coupler supports 5705, 5710 and one or more prongs 5715. FIG. 69 further shows that the compartment divider assembly 5800 may be used to create a T connection, as shown in FIG. 70, where an end 5815 of the second divider 5810 couples, attaches, or is held in place at a mid-section or area 5820 of the first divider 5805. Preferably, when the prong 5715 of the held-on coupler 5700 is engaged with the dovetail groove 5825 of the first divider 5805, a gap 5720 between the coupler supports 5705, 5710 may receive an end 5815 of the second divider 5810.

FIG. 70 is an illustration of an assembled view of another embodiment of the compartment divider assembly, shown in FIG. 68, and shows the compartment divider assembly in a locked configuration. As shown in FIG. 70, one embodiment of the compartment divider assembly 5800 may comprise: one or more held-on couplers 5700, a first divider 5805, and a second divider 5810. The held-on coupler may further comprise at least two coupler supports 5705, 5710 and one or more prongs 5715. FIG. 70 shows that after the prong 5715 of the held-on coupler 5700 is engaged with the dovetail groove 5825 of the first divider 5805, a gap between the coupler supports 5705, 5710 may receive an end 5815 of the second divider 5810. FIG. 70 shows how the assembly 5800 may be used to form a divider in a compartment that may be held together by tension and/or friction. In particular, the parts may be held firmly in place by the prong 5715 of the held-on coupler 5700. Although FIG. 70 shows the second divider 5810 to be perpendicular to the first divider 5805, the second divider 5810 may be positioned at various angles. In various embodiments, the held-on coupler 5700 may be held in place by friction by just fitting in the groove 5825. The groove 5825 may be flat or slanted. In another embodiment the prong 5715 may be held in place by divider 5810 when this divider is put into place.

Figure 71A:
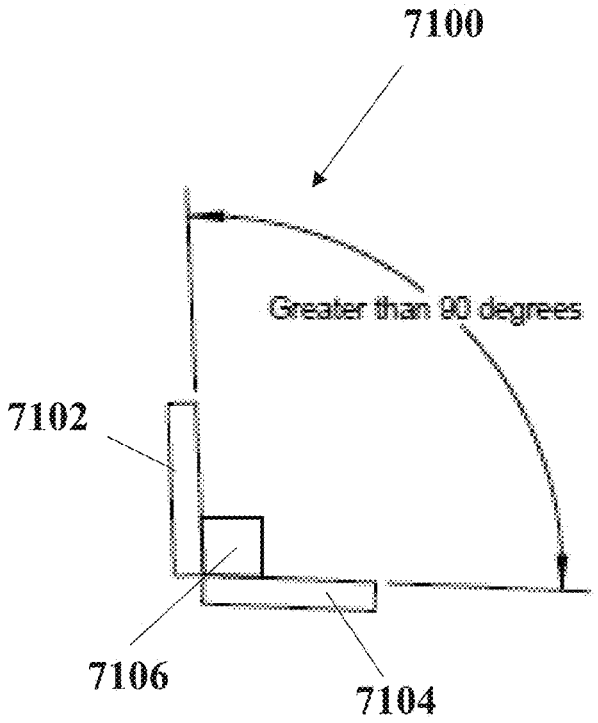
FIGS. 71A and 71B are illustrations of a corner coupler showing the prongs disposed at more or less than 90 degrees from each other.
Figure 71B:
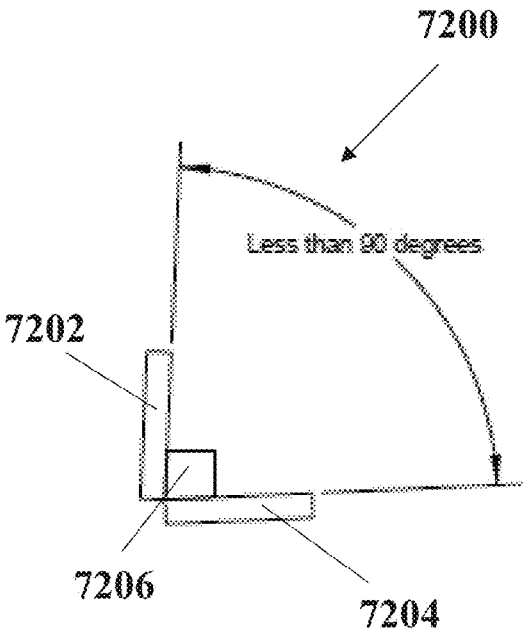

FIGS. 71A and 71B are illustrations of a corner coupler that have male connectors that are less than or greater than 90° relative to each other. As shown in FIGS. 71A and 71B, the corner couplers 7100, 7200 may comprise a support coupler 7106, 7206, and two male connectors 7102, 7104, 7202, 7204. Male connectors 7102, 7104, 7202, 7204 may be slide on connectors or prongs that are configured to engage with a groove, such as a dovetail groove of a divider. FIG. 71A shows that the male connectors 7102, 7104 may be disposed at greater than 90°, typically approximately 90.5° to approximately 99°. This obtuse configuration provides tension to the corner of the divider assembly when it is positioned within a compartment. This tension prevents unwanted sliding of the dividers relative to each other and the rest of the assembly. FIG. 71*b* shows that the male connectors 7202, 7204 may be disposed at less than 90°, typically approximately 89.5° to approximately 81°. This acute configuration provides tension to the corner of the divider assembly when it is positioned within a compartment. This tension prevents unwanted sliding of the dividers relative to each other and the rest of the assembly.

In various embodiments, one or more dividers of the compartment divider assemblies may include a two unit or double unit height of measurement with a single dovetail groove on each side of the divider. In these embodiments, the placement of the dovetail grooves may be disposed or arranged in an alternating pattern. This alternating pattern of the dovetail groove may be consistent or uniform regardless of the height of the divider and may be located near the bottom portion of the divider. For example, as shown in the embodiments in FIGS. 31-35, some of the dividers of the dovetail grooves may be positioned in a consistent and alternating pattern near the bottom portion of the dividers and may be approximately at the same height. In this manner, these compartment divider assemblies may form taller assemblies while utilizing a consistent dovetail groove pattern for ease of coupling.

In various embodiments, the compartment divider assemblies disclosed in the foregoing description may also utilize interference fit (e.g., press fit, friction fit) in areas where portions of the components contact, mate, or engage with one another, such as the corner and coupling connections. Interference fit may achieve fastening between two parts by utilizing friction after the parts are pushed together, rather than by any other means of fastening. These embodiments of the compartment divider assemblies may utilize various materials to achieve interference fit or friction fit such as wood, polymers (e.g., plastic), or any man-made and/or non-manmade materials. Importantly, in addition to friction, various embodiments may utilize additional features such as dimples, graduating friction fits, set screws, adhesives, springs or other technology in order to help fasten the components of the compartment divider assemblies.

The foregoing description of the specific embodiments will so fully reveal the general nature of the present disclosure that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments of the present disclosure have been described in terms of preferred embodiments, those skilled in the art will recognize that the embodiments of the present disclosure can be practiced with modification within the spirit and scope of the appended claims.

Unless otherwise stated, all measurements, values, ratings, positions, magnitudes, sizes, locations, and other specifications which are set forth in this specification, including in the claims which follow, are approximate, not exact. They are intended to have a reasonable range which is consistent with the functions to which they relate and with what is customary in the art to which they pertain.

The foregoing description of the embodiments has been presented for the purposes of illustration and description. While multiple embodiments are disclosed, still other embodiments will become apparent to those skilled in the art from the above detailed description. As will be realized, these embodiments are capable of modifications in various obvious aspects, all without departing from the spirit and scope of the protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that these embodiments not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A compartment divider assembly, comprising:

a first divider; and at least two twist couplers, comprising at least a first twist coupler and a second twist coupler;

wherein said first twist coupler comprises a first support coupler and a first twist prong, and said second twist coupler comprises a second support coupler and second twist prong;

wherein said first divider comprises at least one dovetail groove traversing along a longitudinal axis;

wherein said first twist prong and said second twist prong have a height that is greater than a width such that when said first and second twist couplers are rotated to a substantially horizontal position, said first twist prong and said second twist prong are configured to pass into said at least one dovetail groove of said first divider and then said first twist coupler and said second twist coupler are configured to be rotated to a substantially vertical position, such that said first twist prong and said second twist prong engage with said at least one dovetail groove of said first divider, such that said first twist prong and second twist prong are prevented from being pulled out of said at least one dovetail groove when in said substantially vertical position;

wherein said first twist coupler and second twist coupler are configured to be positioned in parallel along said dovetail groove of said first divider such that a gap is created, wherein said gap is configured to engage with an end of a second divider; wherein when said gap receives said end of said second divider, said second divider is positioned substantially perpendicular to said first divider.

2. The compartment divider assembly of claim 1, wherein said second divider is in a vertical configuration relative to a compartment that contains said compartment divider assembly.

3. The compartment divider assembly of claim 1, wherein said first and second twist couplers are configured to slide transversely along said first at least one dovetail groove when substantially transverse force is applied to said first and second twist couplers.

4. A compartment divider assembly, comprising:

a first divider;

a first twist coupler; and a second divider;

wherein said first twist coupler comprises a first support coupler, a first twist prong, and a first male connector;

wherein said first divider comprises at least one dovetail groove traversing along a longitudinal axis;

wherein said first twist prong has a height that is greater than a width, such that when said first twist coupler is rotated to a substantially horizontal position, said first twist prong is configured to pass into said at least one dovetail groove of said first divider and then said first twist coupler is configured to be rotated to a substantially vertical position, such that said first twist prong engages with said at least one dovetail groove of said first divider, such that said first twist prong is prevented from being pulled out of said at least one dovetail groove when in said substantially vertical position;

wherein said second divider comprises at least one dovetail groove; and wherein said first male connector slideably engages with said dovetail groove of said second divider.

5. The compartment divider assembly of claim 4, wherein said first twist coupler engages with said at least one dovetail groove of said first divider and is held substantially in place by tension or friction relative to said first divider.

6. The compartment divider assembly of claim 4, wherein when said first male connector slideably engages with said second divider, said second divider is positioned substantially perpendicular to said first divider.

7. The compartment divider assembly of claim 6, wherein said second divider and said first male connector are each in a horizontal configuration relative to a compartment that contains said compartment divider assembly.

8. The compartment divider assembly of claim 4, further comprising:

a third divider; and a second twist coupler;

wherein said second twist coupler comprises a second support coupler, a second twist prong, and a second male connector;

wherein third divider comprises at least one dovetail groove traversing along a longitudinal axis;

wherein said second twist prong has a height that is greater than a width, such that when said second twist coupler is rotated to a substantially horizontal position, said second twist prong is configured to pass into said at least one dovetail groove of said third divider and then said second twist coupler is configured to be rotated to a substantially vertical position, such that said second twist prong engages with said at least one dovetail groove of said third divider, such that said second twist prong is prevented from being pulled out of said at least one dovetail groove when in said substantially vertical position.

9. The compartment divider assembly of claim 8, wherein said second twist coupler engages with said at least one dovetail groove of said third divider and is held substantially in place by tension or friction relative to said third divider.

10. The compartment divider assembly of claim 8, wherein said second male connector slideably engages with a second end of said dovetail groove of said second divider.

11. The compartment divider assembly of claim 10, wherein when said second male connector slideably engages with said second divider, said second divider is positioned substantially perpendicular to said third divider.

12. The compartment divider assembly of claim 8, wherein said second divider and said second male connector are each in a horizontal configuration relative to a compartment that contains said compartment divider assembly.

* * * * *